US009500985B1

(12) United States Patent
Li et al.

(10) Patent No.: US 9,500,985 B1
(45) Date of Patent: Nov. 22, 2016

(54) TONER SUPPLY CONTAINER AND APPLICATIONS OF SAME

(71) Applicant: GENERAL PLASTIC INDUSTRIAL CO., LTD., Taichung County (TW)

(72) Inventors: Kuan-Tung Li, Taichung County (TW); Yueh-Chun Lee, Taichung County (TW)

(73) Assignee: GENERAL PLASTIC INDUSTRIAL CO., LTD., TAICHUNG (TW)

( * ) Notice: Subject to any disclaimer, the term of this patent is extended or adjusted under 35 U.S.C. 154(b) by 0 days.

(21) Appl. No.: 15/070,185

(22) Filed: Mar. 15, 2016

Related U.S. Application Data

(63) Continuation-in-part of application No. 14/877,625, filed on Oct. 7, 2015.

(51) Int. Cl.
*G03G 15/08* (2006.01)

(52) U.S. Cl.
CPC ..... *G03G 15/0867* (2013.01); *G03G 15/0834* (2013.01); *G03G 15/0865* (2013.01); *G03G 2215/066* (2013.01)

(58) Field of Classification Search
CPC ..... G03G 15/0822; G03G 15/0834; G03G 15/0836; G03G 15/0837; G03G 15/0839; G03G 15/0867; G03G 15/0868; G03G 15/087; G03G 15/0872; G03G 15/0877; G03G 2215/066; G03G 2215/0663; G03G 2215/0665; G03G 2215/0678; G03G 2215/0685
See application file for complete search history.

(56) References Cited

U.S. PATENT DOCUMENTS

| | | | | |
|---|---|---|---|---|
| 5,217,262 | A * | 6/1993 | Kurosaki | E05C 19/022 292/6 |
| 5,273,328 | A * | 12/1993 | Kurosaki | E05C 19/022 292/19 |
| 7,647,012 | B2 | 1/2010 | Yamada et al. | |
| 7,729,644 | B2 * | 6/2010 | Thornton | G03G 15/087 399/262 |
| 2011/0115146 | A1 * | 5/2011 | Shimomura | B65H 5/26 271/10.13 |
| 2014/0169837 | A1 * | 6/2014 | Huang | G03G 15/0886 399/262 |

* cited by examiner

*Primary Examiner* — David Gray
*Assistant Examiner* — Carla Therrien
(74) *Attorney, Agent, or Firm* — Locke Lord LLP; Tim Tingkang Xia, Esq.

(57) ABSTRACT

A releasing mechanism usable for a toner supply container, includes a plate having a first groove and a second groove; a releasing member slidably sleeved on a front end of the container, and having an opening in fluid communication with the container, an urging section, and a fixing structure; an elastic member having two ends respectively urging the container and the urging section; and a hook member having a first end movably fixed to the fixing structure, a first pin slidably received in the first groove, and a second pin slidably received in the second groove. The releasing member receives a pressing force from an apparatus and an elastic force from the elastic member. The cooperation of the pressing force, the elastic force, the hook member, the first groove, and the second groove enables the first pin and the second pin moving in a one-way direction only.

20 Claims, 53 Drawing Sheets

TONER SUPPLY CONTAINER AND APPLICATIONS OF SAME

CROSS-REFERENCE TO RELATED APPLICATION

This application claims is a continuation-in-part application of U.S. application Ser. No. 14/877,625, filed Oct. 7, 2015, the entire content of which is hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The invention relates generally to a toner supply container, and more particularly to a toner supply container that is switchable between an open and a close state by a pressing force, and applications of the same.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

In a conventional electrophotographic image forming apparatus such as an electrophotographic copying machine or a printer, fine particles toner is used as a developer. When the toner in the main assembly of the electrophotographic image forming apparatus is used up, the toner is supplied into the main assembly of the image forming apparatus using a toner supply container (a toner accommodating container).

Here, the electrophotographic image forming apparatus is an apparatus which forms images on a recording material through an electrophotographic image formation type process. The electrophotographic image forming apparatus includes a, an electrophotographic copying machine, an electrophotographic printer (laser beam printer, LED printer, for example), a facsimile machine, word processor or the like.

Since the toner is very fine powder, it is known to place, upon toner supplying operation, a toner supply container inside the main assembly of the image forming apparatus and to gradually supply the toner through a small opening to avoid scattering of the toner.

Any one of the above-described toner supply containers receives a driving force from the main assembly of an image forming apparatus to drive the toner supply container to discharge the toner. Various drive transmission methods are proposed for driving the toner supply container. However, the conventional structures involve some problems.

Therefore, a heretofore unaddressed need exists in the art to address the aforementioned deficiencies and inadequacies.

SUMMARY OF THE INVENTION

In one aspect, the invention relates to a toner supply container. In one embodiment, the toner supply container includes a container body, a releasing mechanism, and a sealing member.

The container body has a first end surface and an opposite, second end surface defining an inner space therebetween for accommodating the toner, a main body portion, a first portion extending from the main body portion in a first direction that is along a longitudinal axis of the container body and toward the first end surface, and a second portion extending from the first portion in the first direction.

The releasing mechanism includes a first plate, an elastic member, a releasing member, a engage member and a hook member. The first plate is disposed on an outer surface of the second portion, and has a groove and an island surrounded by the groove. The elastic member is disposed outside the second portion, and engages with the releasing member. The first plate may be integrally formed with the second portion, or may be separately formed and then disposed on or attached to the second portion. The releasing member has a releasing portion and a protrusion portion. The releasing portion is slidably sleeved on the second portion of the container body, and comprising an opening in fluid communication with the inner space of the container body, an urging section located at an inner side of the releasing portion that faces the first portion of the container body, and a second plate extending from the inner side of the releasing portion toward the first portion of the container body. The second plate may be integrally formed with the releasing portion, or may be separately formed and then disposed on or attached to the releasing portion. Two ends of the elastic member urge against the first portion of the container and the urging section of the releasing portion respectively. The protrusion portion extends from the releasing portion along the first direction. The engaging member has a base portion sleevably attached to the protrusion portion of the releasing member, and an engaging portion configured to receive a pressing force from a driving member of the apparatus. The hook member has a hook body, a first hook extending downward from a first end of the hook body, and slidably received in the groove, and a fixing portion extending upward from an opposite, second end of the hook body, and fixed to the second plate.

In one embodiment, the releasing mechanism includes at least one pair of retaining plates. The at least one pair of retaining plates is disposed on the outer surface of the second portion, and the elastic member is located between the at least one pair of retaining plates. The retaining plate may be integrally formed with the second portion, or may be separately formed and then disposed on or attached to the second portion.

The sealing member is sleeved on the first portion, the second portion, and the releasing portion.

The groove has a first, a second, a third and a fourth groove portions. The first groove portion has a first free section, a first tail section and a first head section located between the first free section and the first tail section. The second groove portion has a second free section, a second tail section, and a second head section connected with the first tail section and located between the second free section and the second tail section. The third groove portion has a third head section connected with the second tail section, and a third tail section. The fourth groove portion has a third free section, a fourth tail section connected with the first head section, and a fourth head section connected with the third tail section and located between the third free section and the fourth tail section. The first tail section is higher than the second head section, the second tail section is higher than the third head section, the third tail section is higher than the fourth head section, and the fourth tail section is higher than the first head section, such that the first hook is movable only from the first tail section to the second head section, from the second tail section to the third head section, from the third tail section to the fourth head section, and from the fourth tail section to the first head section. The island forms a notch inside the third groove portion, the notch is located between the third head section and the third tail section, and is configured to accommodate the first hook.

In one embodiment, at an initial (or close) state, the first hook is located at the notch of the island.

In one embodiment, when the toner supply container is installed to a receiving space of the apparatus, the engaging member is pressed by the pressing force to move toward the first end surface, the engaging member subsequently presses the releasing member, the urging portion of the releasing member presses the elastic member, the second plate presses the fixing portion, and the first hook is then moved from the notch to the third free section of the fourth groove portion, and then released to the fourth tail section of the fourth groove portion, such that the at least one opening of the releasing portion is exposed from the sealing member for releasing toner from the container body. This process is the transition of the toner supply container from the initial (close) state to the work (or open) state.

In one embodiment, when the engaging member is pressed again by the pressing force to move toward the first end surface, the engaging member subsequently presses the releasing member, the urging portion of the releasing member presses the elastic member, the second plate presses the fixing portion, and the first hook is then moved from the fourth tail section of the fourth groove portion to the second free section of the second groove portion, and then released to the notch of the island, such that the at least one opening of the releasing portion is closed by the sealing member. This process is the transition of the toner supply container from the work (open) state to the close state, such that the empty toner supply container can be removed.

In one embodiment, the island has a first acute portion aligning with the first head section, a second acute portion aligning with the second head section, and a third acute portion aligning with the fourth head section. In one embodiment, the second acute portion and the third acute portion are located at two sides of the notch.

In one embodiment, a width of the groove is slightly greater than a width of the first hook.

In one embodiment, a depth difference between each of the first tail section and the second head section, the second tail section and the third head section, the third tail section and the fourth head section, and the fourth tail section and the first head section, is much smaller than a depth of the groove.

In one embodiment, a part of the groove between the first head section and the first tail section is substantially curved, and a part of the groove between the fourth head section and the fourth tail section is substantially curved.

In one embodiment, each of the first, the second and the third free sections is substantially straight.

In one embodiment, a diameter of the plate portion is greater than a diameter of the releasing portion, and the diameter of the base portion is substantially the same as a diameter of the sealing member.

In one embodiment, a diameter of the urging section is greater than a diameter of the releasing portion, and the diameter of the urging section is smaller than a diameter of the sealing member.

In one embodiment, a number of the at least one pair of retaining plates is three, and correspondingly, a number of the elastic member is three, and the three pair of retaining plates are distributed evenly along a circumference of the outer surface of the second portion.

In another aspect, the present invention relates to a releasing mechanism usable for a toner supply container. In one embodiment, the releasing mechanism includes a groove, a releasing portion, and a hook member.

The groove is located at the toner supply container. The releasing portion is slidably fixable to the toner supply container, and has at least one opening for releasing toner from the toner supply container, and a fixing structure disposed over the groove for cooperating with the groove. The hook member is disposed between the groove and the fixing structure, and has a first hook slidably received in the groove, and a fixing portion fixable to the fixing structure. The releasing portion is configured to receive a first force pushing the releasing portion toward the toner supply container and a second force pushing the releasing portion away from the toner supply container. By operations of the first force and the second force, the first hook is configured to slide along the groove and is stoppable at a first position of the groove close to the toner supply container and a second position of the groove away from the toner supply container, such that the releasing portion is movable in relative to the toner supply container to provide or to stop providing the toner.

In one embodiment, the releasing mechanism further includes an engage member fixed to the releasing portion, and configured to engage with an apparatus for receive the first force. The releasing portion further has an urging section for receiving the second force.

In one embodiment, the releasing mechanism further includes an elastic member located between the releasing portion and the toner supply container, for providing the second force.

In one embodiment, after the releasing mechanism is attached to the toner supply container: if the first hook is located at the first position, the opening is configured to be not in fluid communication with an inner space of the toner supply container; and if the first hook is located at the second position, the opening is configured to be in fluid communication with the inner space of the toner supply container for providing the toner.

In one embodiment, the groove has a first, a second, a third and a fourth groove portion. The first groove portion has a first free section, a first tail section and a first head section located between the first free section and the first tail section. The second groove portion has a second free section, a second tail section, and a second head section connected with the first tail section and located between the second free section and the second tail section. The third groove portion has a third head section connected with the second tail section, and a third tail section. The fourth groove portion has a third free section, a fourth tail section connected with the first head section, and a fourth head section connected with the third tail section and located between the third free section and the fourth tail section. The first tail section is higher than the second head section, the second tail section is higher than the third head section, the third tail section is higher than the fourth head section, and the fourth tail section is higher than the first head section, such that the first hook is movable only from the first tail section to the second head section, from the second tail section to the third head section, from the third tail section to the fourth head section, and from the fourth tail section to the first head section. The groove surrounds an island, the island forms the first position inside the third groove portion, the first position is located between the third head section and the third tail section, and is configured to accommodate the first hook.

In one embodiment, at an initial state, the first hook is located at the first position.

In one embodiment, when the toner supply container is installed to a receiving space of an apparatus, and the releasing portion is pressed by the first force, the fixing structure moves the hook member such that the first hook is moved from the first position to the second position, and thus the opening is exposable for releasing toner from the container supply container. When the releasing portion is pressed again by the first force, the fixing structure moves the hook member such that the first hook is moved from the second position to the first position, and thus the opening is sealable to prevent the toner from being released.

In another aspect, the present invention relates to a toner supply container for supplying toner to an apparatus. In one embodiment, the toner supply container includes a container body, a releasing mechanism, and a sealing member.

The container body has a middle member and a front member defining an inner space for accommodating the toner. The front member has a first capping portion, a first portion extending from the first capping portion in a first direction that is along a longitudinal axis of the container body and toward the front member, and a second portion extending from the first portion in the first direction.

The releasing mechanism includes a plate, at least one pair of retaining plates, an elastic member, a releasing member, an engaging member, and a hook member. The plate is attached to and perpendicular to an outer surface of the second portion, and has a first side and an opposite second side. The first side of the plate has a first groove and a first island surrounded by the first groove, and the second side of the plate has a second groove and a second island surrounded by the second groove. The at least one pair of retaining plates is attached to the outer surface of the second portion. The elastic member is located between the at least one pair of retaining plates. The releasing member includes a releasing portion and a protrusion portion. The releasing portion is slidably sleeved on the second portion of the container body, and has an opening in fluid communication with the inner space of the container body, an urging section located at a rear side of the releasing portion that faces the first portion of the container body, and a fixing structure extending from an outer side of the releasing portion. The fixing structure has a fixing groove. Two ends of the elastic member urge against the first portion of the container and the urging section of the releasing portion, respectively. The protrusion portion extends from the releasing portion along the first direction. The engaging member has a base portion sleevably attached to the protrusion portion of the releasing member, and an engaging portion configured to receive a pressing force from a driving member of the apparatus. The hook member has a first side and an opposite second side. The first side is movably fixed to the fixing groove, and the second side has a first pin slidably received in the first groove, and a second pin slidably received in the second groove.

The sealing member is sleeved on the first portion, the second portion, and the releasing portion.

The cooperation of the hook member, the first groove, and the second groove enables the first pin and the second pin moving in a one-way direction only.

In one embodiment, the first pin and the second pin substantially face each other.

In one embodiment, the first side of the plate has a front end away from the first portion and an opposite, rear end in contact with the first portion, a first protrusion extends from the rear end in the first direction. The first island has a second large protrusion and a second small protrusion extending toward a second direction opposite to the first direction, a second front protrusion extending in the first direction, and a first notch disposed between the second large protrusion and the second small protrusion. The first protrusion and the second small protrusion is close to the second portion, and the second large protrusion is away from the second portion.

In one embodiment, the second side of the plate has a front end away from the first portion and an opposite, rear end in contact with the first portion. A third protrusion extends from the rear end in the first direction, and has an inner straight side along the longitudinal direction and close to the second portion, an outer straight side along the longitudinal direction and away from the second portion, a peak facing the second notch, an inner slope connecting the peak and the inner straight side, and an outer slope connecting the peak and the outer straight side. The second island has a fourth large protrusion and a fourth small protrusion extending toward the second direction, a fourth front protrusion extending in the first direction, and a second notch disposed between the second large protrusion and the second small protrusion. The fourth small protrusion is away from the second portion, and the fourth large protrusion is close to the second portion, the peak is close to the second portion 218 than that of the second notch.

In one embodiment, at an initial state, the first pin is located at the first notch, and the second pin is located at the second notch.

In one embodiment, at the initial state, when the pressing force is applied to the engaging member, the engaging member moves toward a second direction opposite to the first direction, the engaging member subsequently presses the releasing member, the urging portion of the releasing member presses the elastic member, the fixing structure presses the hook member, the first pin moves in the second direction along an inner side of the second large protrusion, the second pin moves in the second direction and outward along the outer slope, and the first pin is prevented from moving inward toward the second portion, such that the first pin and the second pin only move in one direction.

In one embodiment, the first pin and the second pin move respectively from the first notch and the second notch outward and upward toward the first ends and of the first side and the second side of the plate, such that the opening of the releasing portion is exposed from the sealing member for releasing toner from the container body, and the toner supply container is at a work state.

In one embodiment, at the work state, when the pressing force is applied again on the engaging member, the engaging member moves toward the second direction, the engaging member subsequently presses the releasing member, the urging portion of the releasing member presses the elastic member, the fixing structure presses the hook member, the second pin moves in the second direction and inward along an inner side of the second island between the fourth front protrusion and the fourth large protrusion, and the first pin is prevented from moving outward, such that the first pin and the second pin only move in one direction.

In one embodiment, the first pin and the second pin are moved respectively from the first ends and of the first side and second side of the plate inward and downward toward the first notch and the second notch, such that the opening of the releasing portion is closed by the sealing member.

In one embodiment, the first island and the first protrusion separates the first groove into four sections: a first section located at the rear side of the first island that is close to the first portion, a second section located at one side of the first island that is away from the second portion, a third section located in the front of the first island, and a fourth section located at the other side of the first island that is close to the second portion, the first section connects the second section and the fourth section from the rear side of the first groove, and the third section connects the second section and the fourth section from the front side of the first groove. The second island and the third protrusion separates the second groove into four sections: a fifth section located at the rear side of the second island that is close to the first portion, a sixth section located at one side of the second island that is away from the second portion, a seventh section located in the front of the second island, and an eighth section located at the other side of the second island that is close to the second portion, the fifth section connects the sixth section and the eighth section from the rear side of the second groove, and the seventh section connects the sixth section and the eighth section from the front side of the second groove.

In one embodiment, a width of the third section is less than a width of the seventh section.

In one embodiment, the fourth front protrusion corresponds to an outside of the third section that is away from the second portion.

In one embodiment, a width of the fixing groove is slightly smaller than a diameter of the first side of the hook member.

In one aspect, the present invention relates to a releasing mechanism usable for a toner supply container. In one embodiment, the releasing mechanism includes a plate, a releasing member, an elastic member, and a hook member.

The plate is attached to the toner supply container, and has a first groove and a second groove. The releasing member is slidably sleeved on a front end of the toner supply container, and has an opening in fluid communication with an inner space of the toner supply container, and an urging section and a fixing structure located at a rear side of the releasing member. The elastic member provides an elastic force. Two ends of the elastic member urge against the toner supply container and the urging section of the releasing portion, respectively. The hook member has a first side and an opposite second side. The first side is movably fixed to the fixing structure, and the second side has a first pin slidably received in the first groove, and a second pin slidably received in the second groove. The releasing member is configured to receive a pressing force from a driving member of an apparatus and the elastic force from the elastic member. The cooperation of the pressing force, the elastic force, the hook member, the first groove, and the second groove enables the first pin and the second pin moving in a one-way direction only.

In one embodiment, the releasing mechanism further includes a pair of retaining plates attached to the outer surface of the toner supply container for holding the elastic member therebetween.

In one embodiment, the releasing mechanism further includes an engaging member. The engaging member has a base portion sleevably attached to the releasing member, and an engaging portion configured to receive the pressing force from the driving member of the apparatus.

In one embodiment, the first pin and the second pin substantially face each other.

In one embodiment, the fixing structure has a fixing groove. The first side of the hook member is fixed into the fixing groove, and is rotatable in the fixing groove.

In one embodiment, the plate further includes a first island surrounded by the first groove and a second island surrounded by the second groove. The first groove and the first island are disposed at a first side of the plate, and the second groove and the second island are disposed at a second side of the plate. The first side of the plate is opposite to the second side of the plate. A first protrusion extends forward from a rear end of the plate to the first groove, the first island has a second large protrusion and a second small protrusion extending backward, a second front protrusion extending forward, and a first notch disposed between the second large protrusion and the second small protrusion, the first protrusion and the second small protrusion is located at an inner side of the toner supply container, and the second large protrusion is located at an outer side of the toner supply container. A third protrusion extends forward from the rear end of the plate to the second groove, and has an inner straight side, an outer straight side, a peak facing the second island, an inner slope connecting the peak and the inner straight side, and an outer slope connecting the peak and the outer straight side, the second island has a fourth large protrusion and a fourth small protrusion extending backward, a fourth front protrusion extending forward, and a second notch disposed between the second large protrusion and the second small protrusion, the fourth small protrusion is located at the outer side of the toner supply container, and the fourth large protrusion is located at the inner side of the toner supply container. The peak of the third protrusion is close to the inner side of the toner supply container than that of the second notch.

In one embodiment, at an initial state, the first pin is located in the first notch, and the second pin is located in the second notch, when the pressing force is applied, the first pin and the second pin move respectively from the first notch and the second notch outward upward toward a front end of the plate, such that the opening of the releasing portion is exposed for releasing toner from the container body, and the toner supply container is at a work state. When the pressing force is applied again, the first pin and the second pin are moved respectively from the front end of the plate inward and downward toward the first notch and the second notch, such that the opening of the releasing portion is closed by the sealing member.

These and other aspects of the present invention will become apparent from the following description of the embodiment taken in conjunction with the following drawings, although variations and modifications therein may be affected without departing from the spirit and scope of the novel concepts of the present invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

FIG. 19A shows an initial state or close state, and FIG. 19B shows a work state or open state.

DETAILED DESCRIPTION OF THE INVENTION

Figure 1:
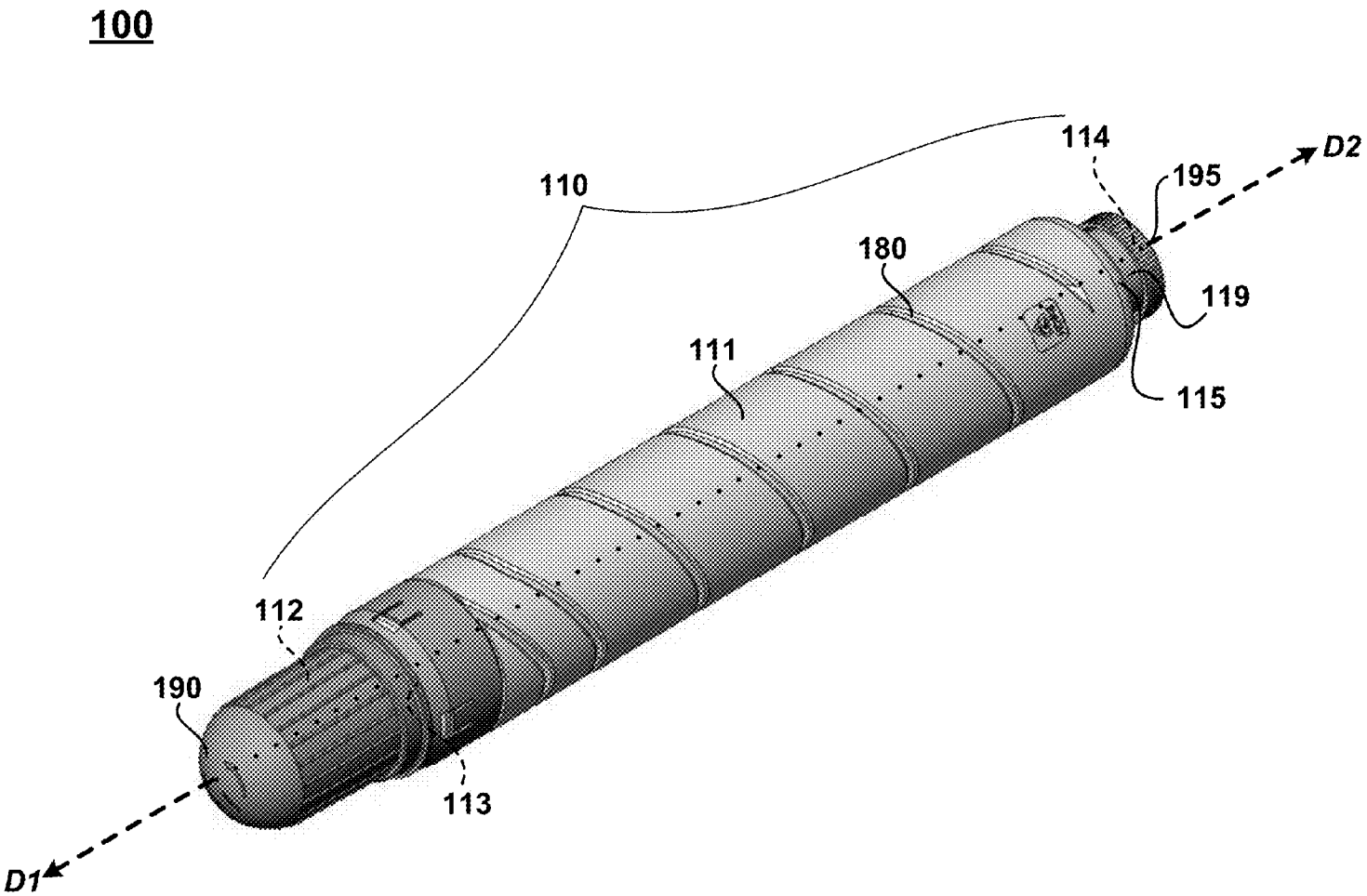
FIG. 1 schematically shows a three-dimensional view of a toner supply container according to one embodiment of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top", may be used herein to describe one element's relationship to another element as illustrated in the FIGS. It will be understood that relative terms are intended to encompass different orientations of the device in addition to the orientation shown in the FIGS. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present invention, and will not be interpreted in an idealized or overly formal sense unless expressly so defined herein.

As used herein, "around", "about", "substantially" or "approximately" shall generally mean within 20 percent, preferably within 10 percent, and more preferably within 5 percent of a given value or range. Numerical quantities given herein are approximate, meaning that the terms "around", "about", "substantially" or "approximately" can be inferred if not expressly stated.

As used herein, the terms "comprise" or "comprising", "include" or "including", "carry" or "carrying", "has/have" or "having", "contain" or "containing", "involve" or "involving" and the like are to be understood to be open-ended, i.e., to mean including but not limited to.

As used herein, the phrase "at least one of A, B, and C" should be construed to mean a logical (A or B or C), using a non-exclusive logical OR. It should be understood that one or more steps within a method may be executed in different order (or concurrently) without altering the principles of the invention.

The description will be made as to the embodiments of the invention in conjunction with the accompanying drawings. In accordance with the purposes of this invention, as embodied and broadly described herein, this invention, in one aspect, relates to a toner supply container and applications of the same.

Figure 2A:
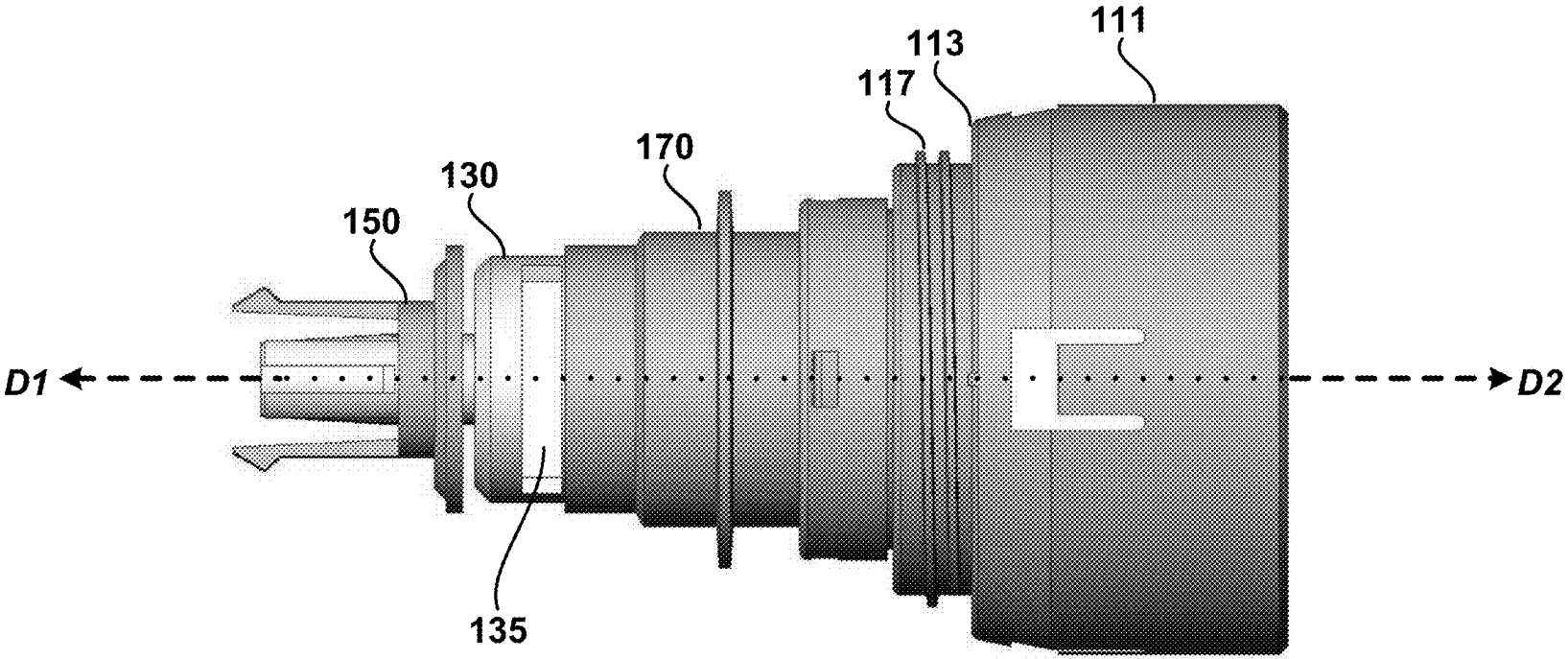
FIGS. 2A-2C schematically show views of a part of the toner supply container according to one embodiment of the invention from different angles, where the toner supply container is in an open state.

FIG. 1 schematically shows a three-dimensional view of a toner supply container according to one embodiment of the invention. As shown in FIG. 1, a toner supply container 100 includes a container body 110, a first cap 190 and a second cap 195. As shown in FIG. 2A, the toner supply container 100 further includes a releasing member 130, an engaging member 150, and a sealing member 170.

Referring back to FIG. 1, the container body 110 is basically in a shape of a cylinder, and has a first end surface 112 and a second end surface 114 opposite to the first end surface 112. The container body 110 has an axial along the longitudinal direction, and an radial direction located at the circular sectional plane of the cylinder. A direction D1 is defined as the direction from the second end surface 114 toward the first end surface 112, and a direction D2 is defined as the direction from the first end surface 112 toward the second end surface 114. The container body 110 defines an inner space between the first end surface 112 and the second end surface 114, for accommodating toner. In one embodiment, an outer surface of the container body 110 is concavely formed with a screw shaped groove 180 along the container body 110. When the container body 110 is rotated, the screw shaped groove 180 is configured to move the toner inside the container body 110 along the D1 direction.

Figure 11A:
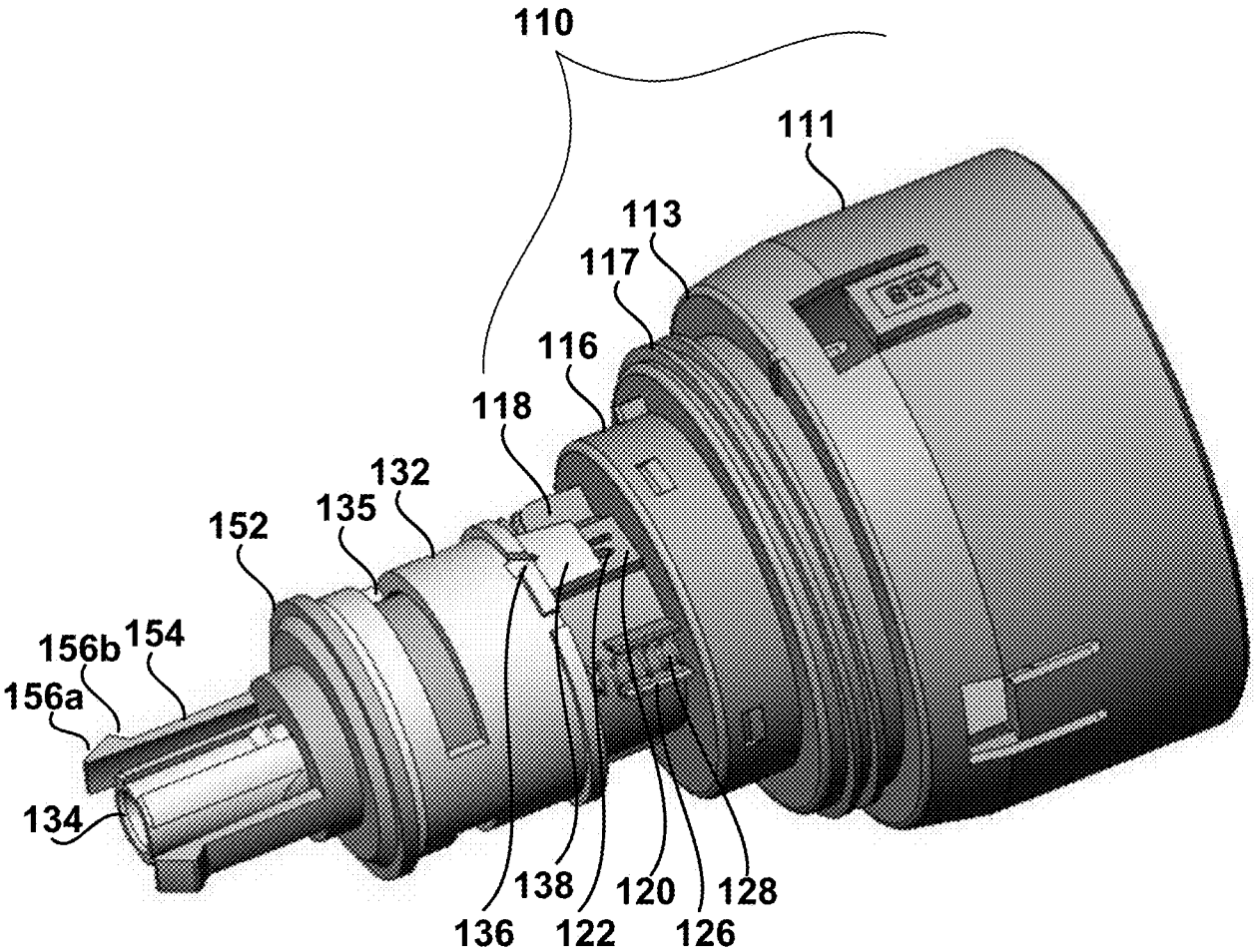
FIGS. 11A-11B schematically show a three-dimensional view of a part of the toner supply container in the close state according to one embodiment of the present invention, where the sealing member is hide to shown the inner structure.

The container body 110 has a main body portion 111. The main body portion 111 has a third end surface 113 close to the first end surface 112, and a fourth end surface 115 close to the second end surface 114. As shown in FIG. 11A, the main body portion 111 extends in the D1 direction from the third end surface 113 to form a first capping portion 117 matable with the first cap 190. The first capping portion 117 is in a cylindrical shape. A diameter of the first capping portion 117 is slightly smaller than a diameter of the main body portion 111. In certain embodiments, an outer surface of the first capping portion 117 is threaded, and an inner surface of the first cap 190 is threaded, such that the first cap 190 is fixable to the first capping portion 117 by screwing. A diameter of the opening of the first cap 190 is substantially the same as the diameter of the main body portion 111, such that when the first cap 190 is screwed onto the first capping portion 117, an end surface at the opening of the first cap 190 urges the third end surface 113 of the main body portion 111.

Referring back to FIG. 1, the fourth end surface 115 extends in the D2 direction to form a second capping portion 119. A diameter of the second capping portion 119 is much smaller than the diameter of the main body portion 111 or the first capping portion 117. A free end of the second capping portion 119 is threaded at the outer surface, the second cap 195 is threaded at the inner surface, such that the second cap 195 is fixable to the second capping portion 119 by screwing. When the second cap 195 is screwed on the second capping portion 119, the second cap 195 contacts the second surface 114.

In one embodiment, each of the first cap 190 and the second cap 195 is screwed to the first capping portion 117 and the second capping portion 119 respectively. In other embodiments, each of the first cap 190 and the second cap 195 may be fixable to the first capping portion 117 and the second capping portion 119 by other means, for example, press fitting.

As shown in FIG. 11A, the first capping portion 117 extends in the D1 direction to form a first portion 116. The first portion 116 may have a cylindrical shape, and a diameter of the first portion 116 is smaller than the diameter of the first capping portion 117.

The first portion 116 extends in the D1 direction to form a second portion 118. The second portion 118 may have a cylindrical shape, and a diameter of the second portion 118 is smaller than the diameter of the first portion 116.

A first plate 120 is disposed on an outer surface of the second portion 118. In one embodiment, the first plate 120 is in a rectangular shape having a top surface, a bottom surface, and four side surfaces. The bottom surface of the first plate 120 is attached to the outer surface of the second portion 118. One of the four side surfaces of the first plate 120 is in contact with the end surface of the first portion 116. Two other parallel side surfaces of the first plate 120 are substantially parallel to the longitudinal axial of the container body 110. The first plate 120 is concavely formed with a groove 122 from the top surface downward. The groove 122 may or may pass through the first plate 120, as long as the groove 122 has a certain depth to achieve its function. The groove 122 surrounds an island 124. The first plate 120 may be integrally formed with the second portion 118, or may be separately formed and then disposed on or attached to the second portion 118.

In this embodiment, the groove 122 is formed on the first plate 120. In other embodiments, the toner supply container 100 may not include the first plate 120. In one embodiment, the groove 122 may be formed on another type of structure other than the first plate 120. In one embodiment, the groove 122 may be formed directly on the outer surface of the second portion 118. The structure of the first plate 120 and the groove 122 are not limited to the above described embodiments, as long as there is a groove 122 for retaining the first hook 162 of the hook member 160, such that the first hook 162 is slidably movable in the groove 122.

Figure 4:
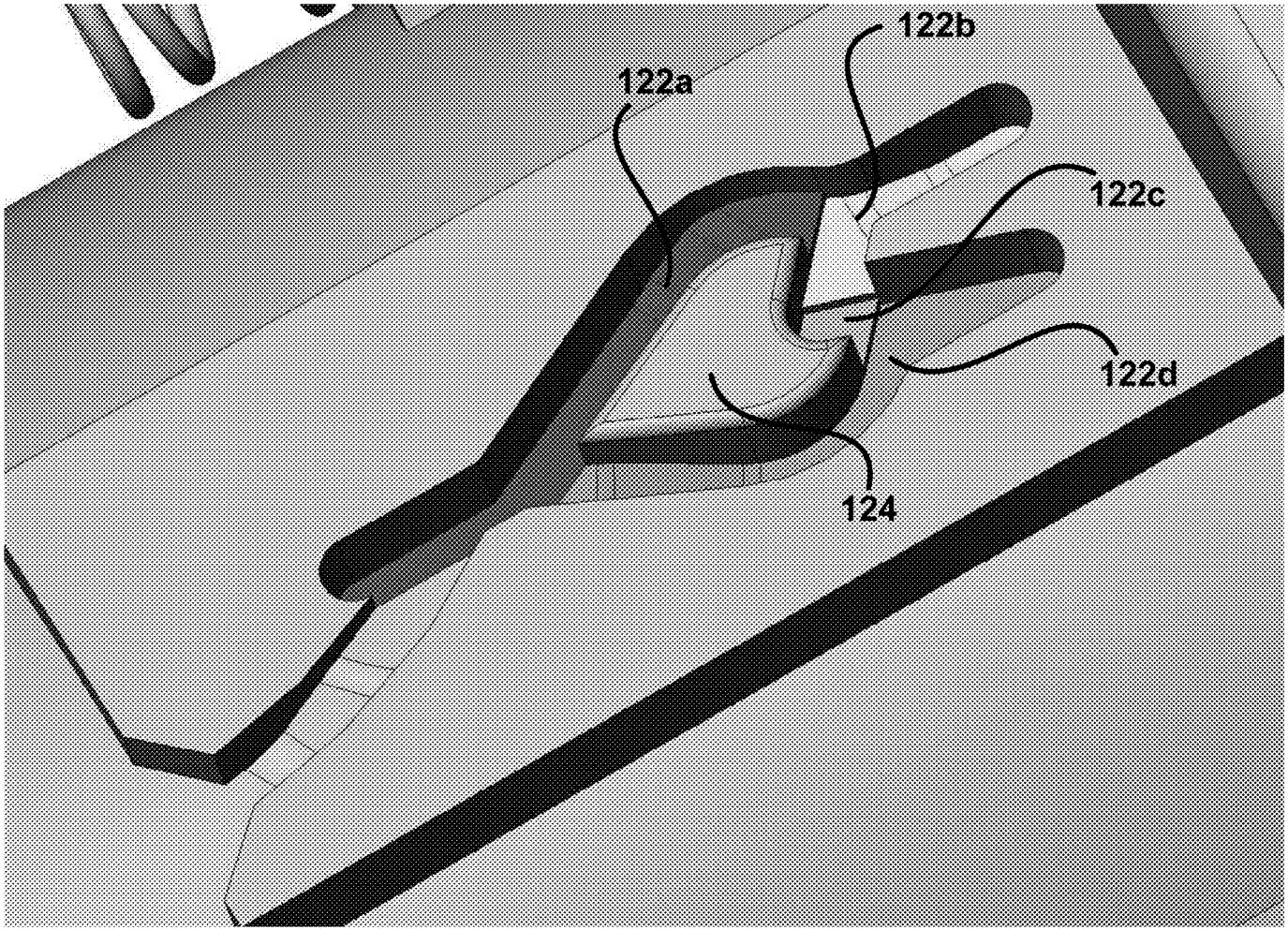
FIG. 4 schematically shows a three-dimensional view of a groove of the toner supply container according to one embodiment of the present invention.

As shown in FIG. 4, in certain embodiments, the groove 122 basically surrounds a heart shaped island 124. In addition, the groove 122 further includes two rabbit ear shaped protrusions from above the heart shaped island 124, and one substantially straight extension from below the heart shaped island 124.

Specifically, the groove 122 includes a first groove portion 122*a*, a second groove portion 122*b*, a third groove portion 122*c*, and a fourth groove portion 122*d*. The first groove 122*a* has a first free section, a first tail section, and a first head section located between the first free section and the first tail section. The second groove portion 122*b* has a second free section, a second tail section, and a second head section connected with the first tail section and located between the second free section and the second tail section. The third groove portion 122*c* has a third head section connected with the second tail section, and a third tail section. The fourth groove portion 122*d* has a third free section, a fourth tail section connected with the first head section, and a fourth head section connected with the third tail section and located between the third free section and the fourth tail section. The first free section is the straight extension described above, and the second free section and the third free section are the rabbit ear shaped protrusions. In one embodiment, the top of the heart, the second free section, and the third free section face toward the outer end surface of the first portion 116, and the first free section extend outward longitudinally toward the releasing member 130 or the engaging member 150.

The first tail section is higher than the second head section, the second tail section is higher than the third head section, the third tail section is higher than the fourth head section, and the fourth tail section is higher than the first head section, such that the first hook 164 is movable only from the first tail section to the second head section, from the second tail section to the third head section, from the third tail section to the fourth head section, and from the fourth tail section to the first head section. The island 124 forms a notch inside the third groove portion 122*c* and located between the third head section and the third tail section, for accommodating the first hook 164.

One or more pairs of retaining plates 126 are disposed on the outer surface of the second portion 118. In one embodiment, each of the retaining plates 126 has an upper surface and a lower surface opposite to each other, and four side surfaces. The retaining plate 126 is attached to the outer surface of the second portion 118 by a bottom side surface of the four side surfaces only, and the bottom side surface is parallel to the longitudinal axis of the container body 110. The other one of the four side surfaces, adjacent to the bottom side surface, is attached to the end surface of the first portion 116. The upper and lower surfaces of the retaining plate 126 are substantially perpendicular to the outer surface of the second portion 118. In certain embodiments, the number of the retaining plates 126 pairs is two or more, and the two or more pairs of the retaining plates 126 are distributed evenly around the outer surface of the second portion 118. The retaining plate 126 may be integrally formed with the second portion 118, or may be separately formed and then disposed on or attached to the second portion 118.

The distance between two retaining plates 126 of a pair is slightly greater or the same as a diameter of an elastic member 128, and the elastic member 128 is retained between the one pair of the retaining plates 126. One end of each elastic member 128 urges against the end surface of the first portion 116. In one example, there are three pairs of retaining plates 126, and three elastic members 128 are retained in the three pairs of retaining plates 126 respectively. In one embodiment, the elastic members 128 are springs.

The retaining structure for retaining the elastic member 128 may not be the retaining plates 126 as described above. In certain embodiments, the retaining structure may be a protrusion or a rib projected from the outer surface of the second portion 118. In one embodiment, the retaining structure may be a recess formed on the outer surface of the second portion 118. The retaining structure for retaining the elastic member 128 is not limited to the retaining plates 126, the protrusion, the rib, or the recess, as long as the retaining structure is configured to hold the elastic member 128 in place.

Figure 6A:
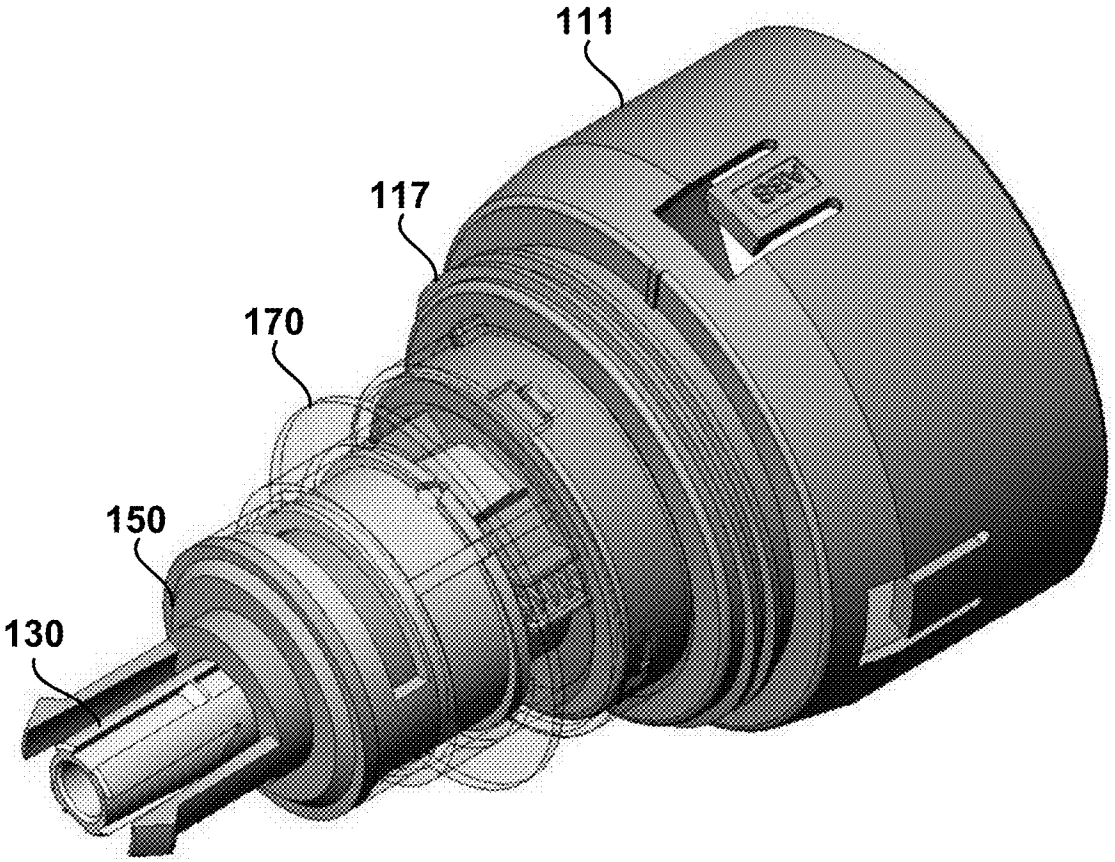
FIG. 6A schematically shows the three-dimensional view of FIG. 5, where a sealing member is shown as transparent according to one embodiment of the present invention.
Figure 6B:
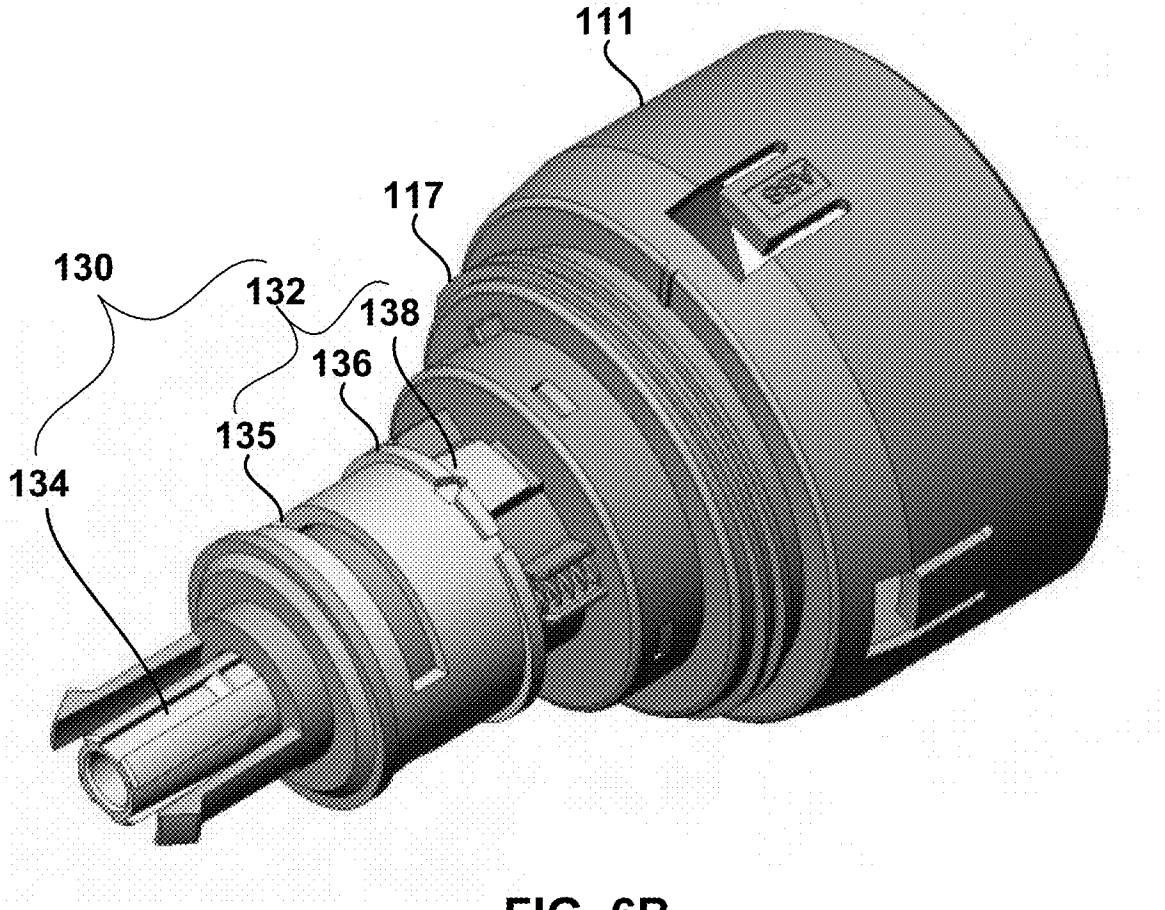
FIG. 6B schematically shows the three-dimensional view of FIG. 5, where a sealing member is hidden to show the structure inside the sealing member according to one embodiment of the present invention.

As shown in FIG. 6B, the toner supply container 100 further includes a releasing member 130. The releasing member 130 includes a releasing portion 132 sleeved on the second portion 118 and a protrusion portion 134 extending from the releasing portion 132 in the D1 direction. The releasing portion 132 is slidable, and has at least one opening 135, an urging section 136, and a second plate 138.

The releasing portion 132 may have a cylindrical shape, and includes an inner surface facing the outer surface of the second portion 118, and an outer surface facing outwards towards the inner surface of the sealing member 170. A diameter of the releasing portion 132 is slightly greater than the diameter of the second portion 118, slightly smaller than corresponding part of the sealing member 170, and smaller than the diameter of the first portion 116. The releasing portion 132 is sleeved on the second portion 118, and is slidable along the longitudinal axial of the toner supply container 100. The releasing portion 132 is not completely overlap with the second portion 118. In other words, the length of the releasing portion 132 is shorter than the length of the second portion 118 along the longitudinal direction, there is a clearance or distance between the inner side of the toner releasing portion 132 and the end surface of the first portion 116, such that a part of the outer surface of the second portion 118 is exposable from the clearance.

The at least one opening 135 is formed on and through the releasing portion 132, and configured to release toner from the toner supply container 100 to a receiving portion of the apparatus (not shown).

The opening 135 is slidable together with the releasing portion 132 between the second portion 118 and the sealing member 170, in relative to the second portion 118 and the sealing member 170. The opening 135 is in fluid communication with the inner space of the container body 110 under work state. At work or open state, the opening 135 is moved out of the space between the second portion 118 and the sealing member 170, and the toner is able to be dispensed from the inner space of the container body 110, through the opening 135, and provided to the apparatus. At a close condition, the opening 135 is located completely between the second portion 118 and the sealing member 170, is blocked by the second portion 118 and the sealing member 170, and is not in communication with the inner space of the container body 110 anymore.

The urging portion 136 is located at the inner end of the releasing portion 132 that is close to the first portion 116. The urging portion 136 may have a ring shaped structure attached to the outer surface of the releasing portion 132 at the inner end, or the urging portion 136 is part of the inner end of the releasing portion 132. In one embodiment, one end of the elastic member 128 urges against the end surface of the first portion 116, and the other end of the elastic member 128 urges against the urging portion 136 of the releasing portion 132.

The second plate 138 extends from the inner side of the releasing portion 132 at the inner end. In one embodiment, the second plate 138 covers on the first plate 120 and partially overlaps with the first plate 120 when viewing from outside of the toner supply container 100 radially. In certain embodiments, the second plate 138 is movable relative to the first plate 120. In certain embodiments, the second plate 138 has a through hole. The second plate 138 may be integrally formed with the releasing portion 132, or may be separately formed and then disposed on or attached to the releasing portion 132.

The protrusion portion 134 extends from the releasing portion 132 in the D1 direction. The protrusion portion 134 is configured to receive a driving force, such as a pressing force, from the apparatus so as to switch the releasing portion 132 between the open state and the close state. The protrusion portion 134 may have a column or cylindrical shape. A diameter of the cylindrical protrusion portion 134 is much smaller than the diameter of the releasing portion 132. The diameter of the protrusion portion 134 may not be uniform. In one embodiment, the diameter of the protrusion portion 134 is gradually reduced along the D1 direction. In one embodiment, the protrusion portion 134 has one or more concaves in the outer surface, to slidably fix the engaging member 150 onto the protrusion portion 134.

Figure 3A:
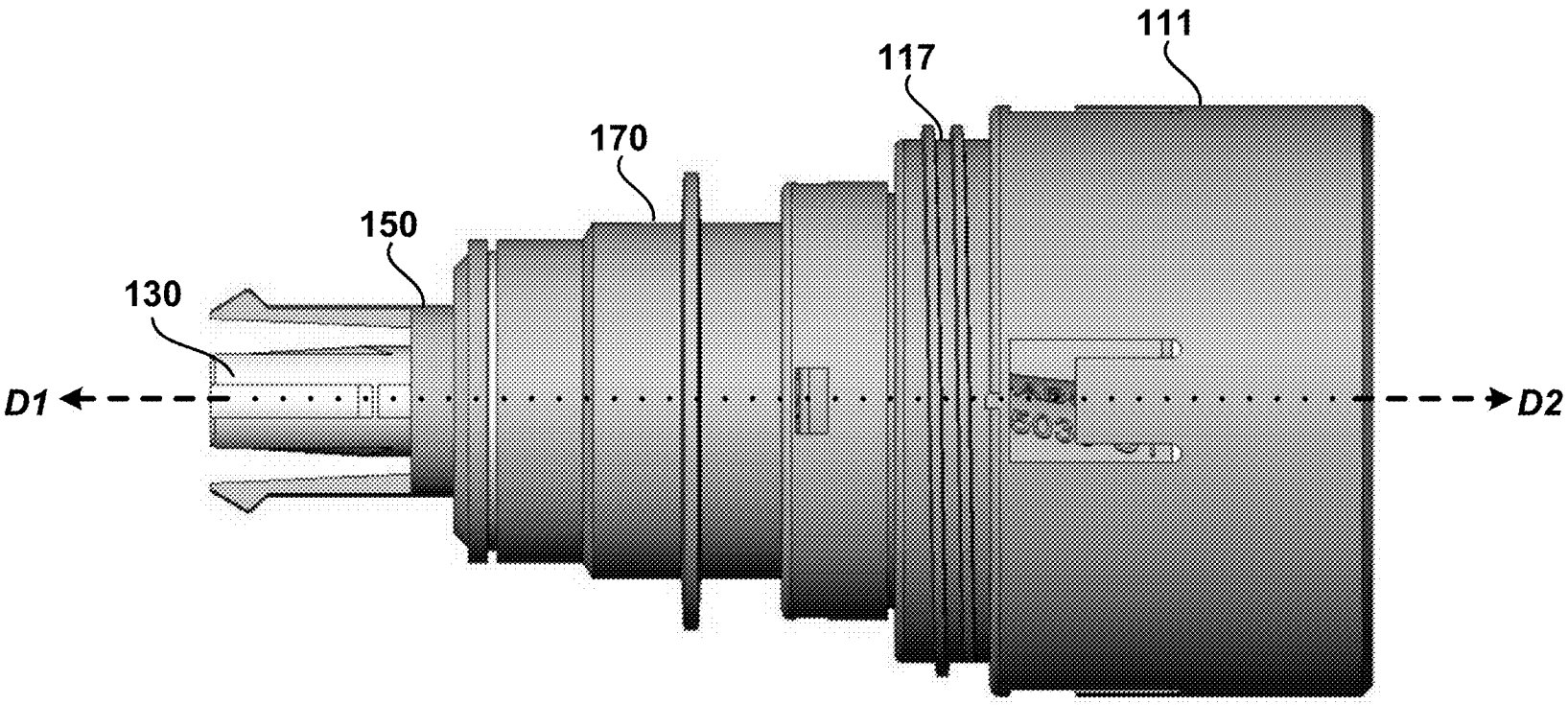
FIGS. 3A-3B schematically show views of a part of the toner supply container according to one embodiment of the invention from different angles, where the toner supply container is in a close state.
Figure 3B:
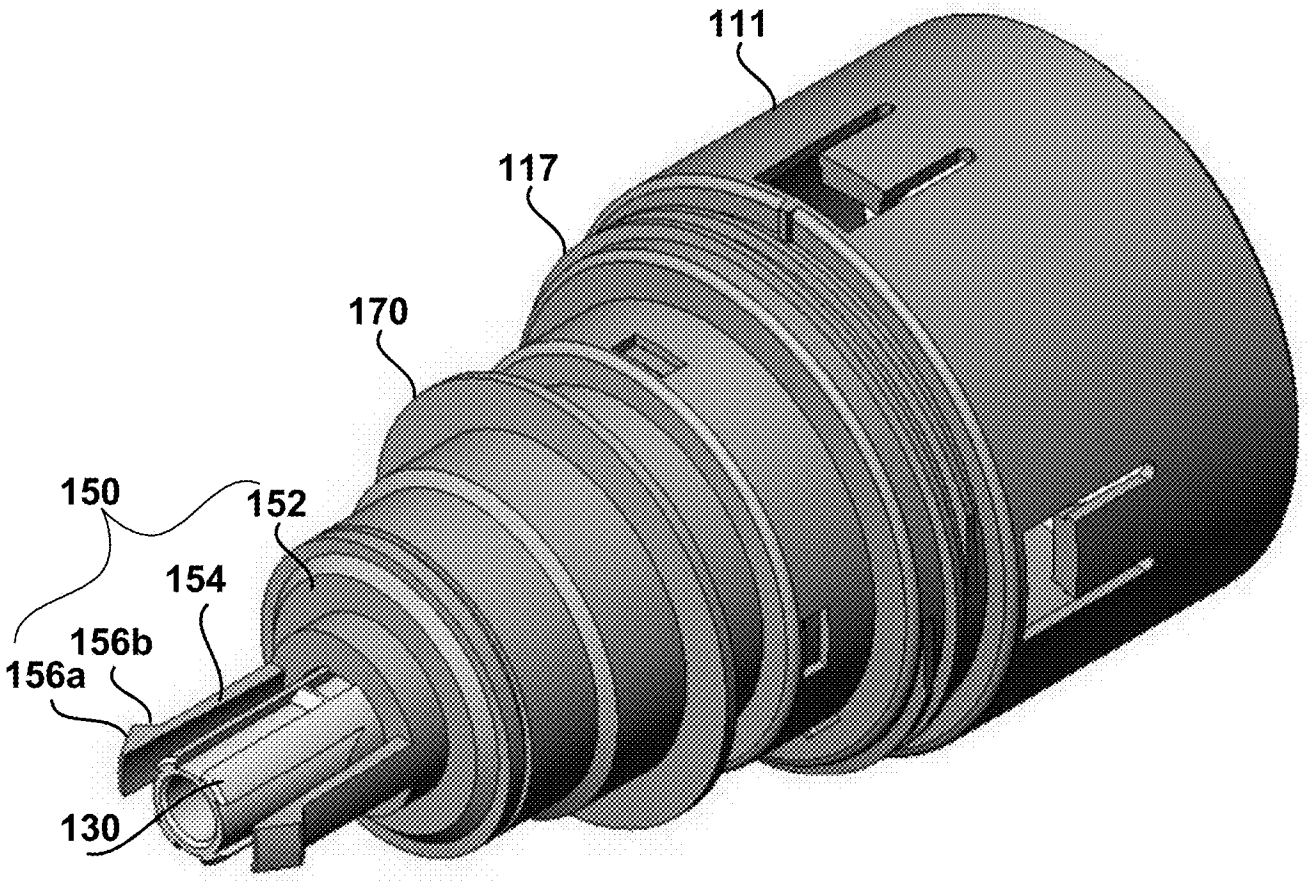

The toner supply container 100 further includes the engaging member 150 slidably attached to the releasing member 130. As shown in FIG. 3B, the engaging member 150 has a base portion 152 and an engaging portion extending from the base portion 152. The base portion 152 has a ring shape, the plane of the base portion 152 is in parallel to the outer end surface of the releasing portion 132. A diameter of the base portion 152 is greater than the diameter of the releasing portion 132, and substantially the same as the diameter at the outer end of the sealing member 170. During the pressing of the releasing member 130, the base portion 152 moves toward the outer end of the sealing member 170, and is stoppable by the outer end of the sealing member 170. The base portion 152 may include several ring shaped structures with different outer diameters and the same inner diameters. The engaging portion has two engaging sheets 154 extending from the base portion 152 and two engaging portions 156 projected from the free ends of the two engaging sheets radially outward respectively. The two engaging sheets 154 may be evenly distributed. In other words, the two engaging sheets 154 face to each other in relative to the axis of the toner supply container 100. Each of the two engaging portions 156 has a drive receive surface 156*a* for receiving the rotational driving force from the apparatus, and a locking surface 156*b* for snap-fit type locking.

The base portion 152 may have a ring shape, such that the protrusion portion 134 passes through the inner through hole of the ring shaped base portion 152. Outer surface of the protrusion portion 134 is provided with receiving slot, inner circumference of the through hole of the base portion 152 is provided with a protrusion, and the protrusion is received in the receiving slot to fix the engaging member 150 to the releasing member 130. The length of the receiving slot is greater than the length of the protrusion along the axis, such that the engaging member 150 is slightly slidable relative to the releasing member 130.

Figure 7A:
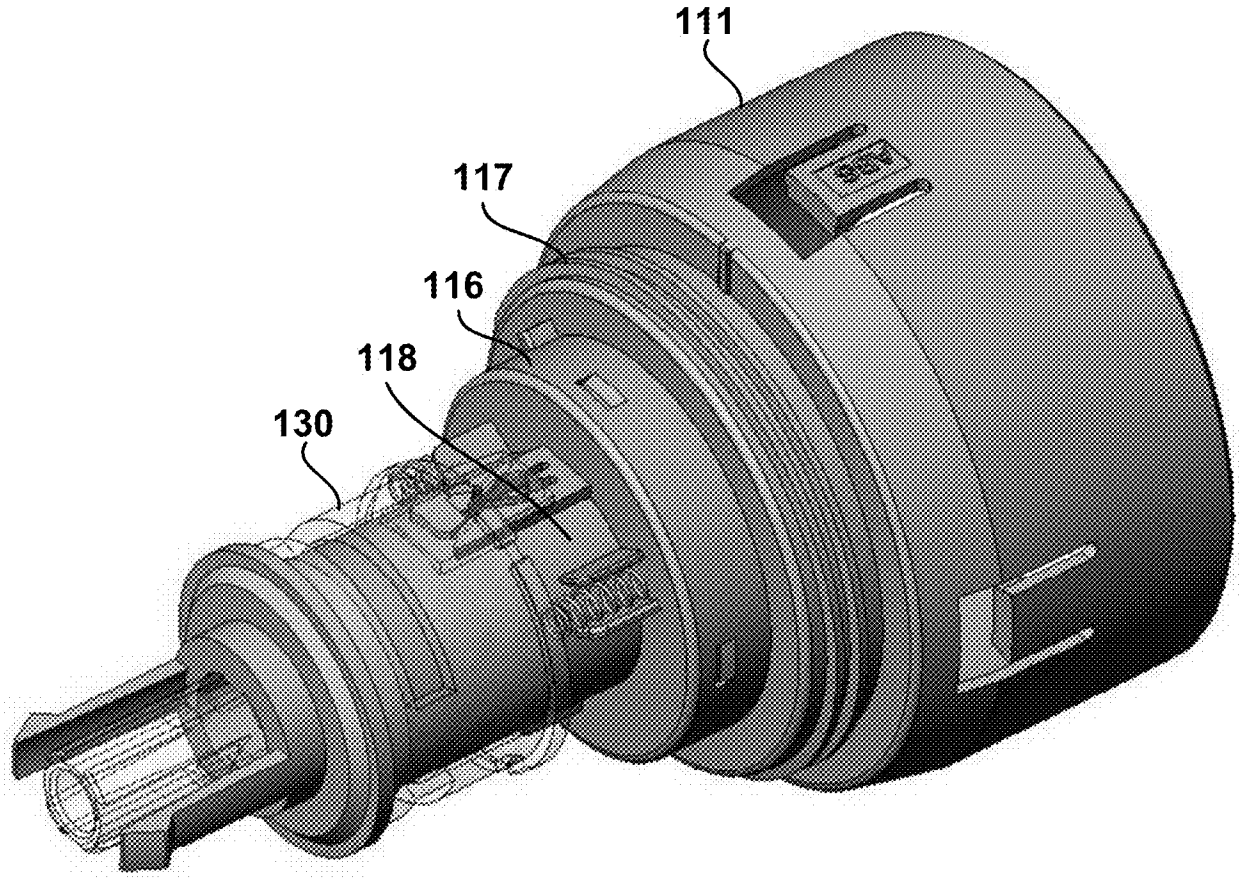
FIGS. 7A-7B schematically show a three-dimensional view of a part of the toner supply container in an initial (close) state according to one embodiment of the present invention, where a sealing member is shown as transparent.
Figure 7B:
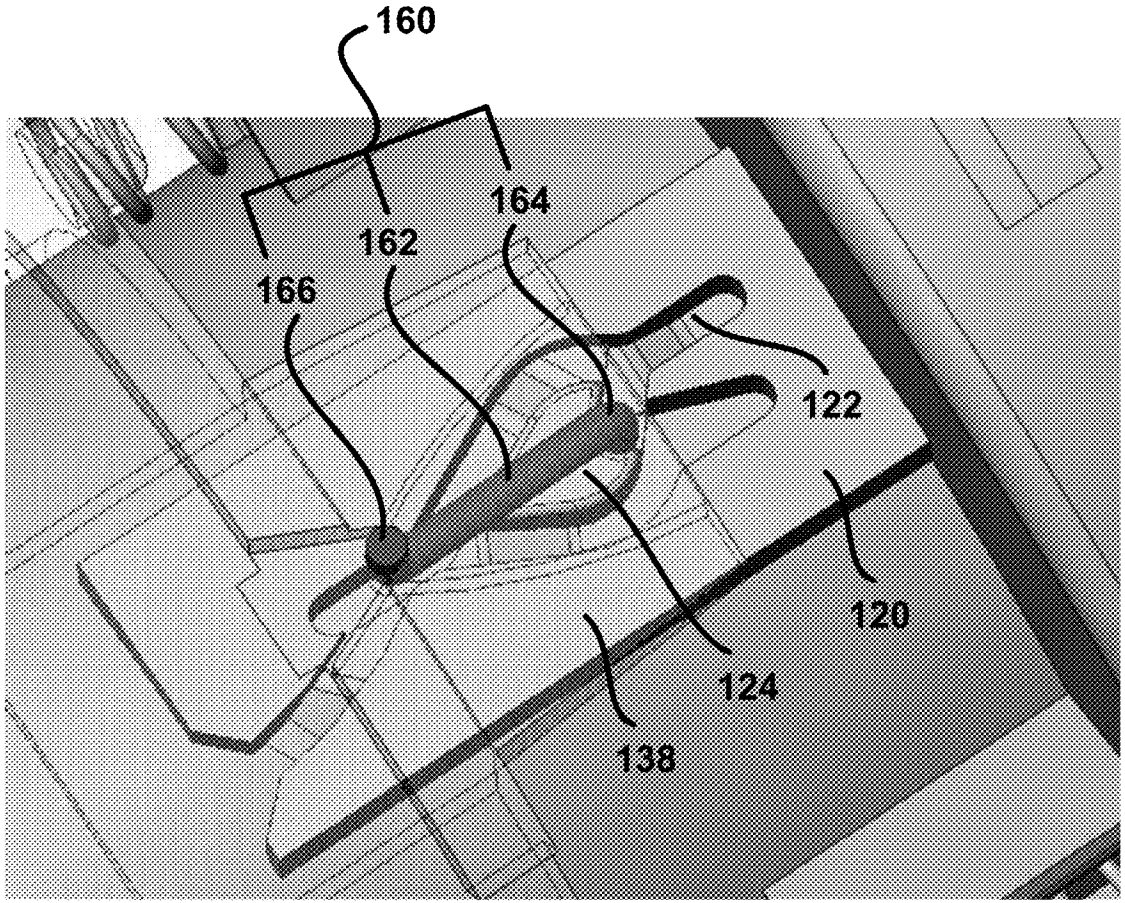

As shown in FIG. 7B, in certain embodiments, the toner supply container 100 further includes a hook member 160. The hook member 160 includes a straight hook body 162, a first hook 164 extending and bending downward from one end of the hook body 162, and a second hook 166 extending and bending upward from the other end of the hook body 162. The first hook 164 is movable in the groove 122 of the first plate 120, and the second hook 166 is fixed to the through hole of the second plate 138. In certain embodiments, the second hook 166 may have a structure other than a hook, as long as it can be fixed to the second plate 138. The second plate 138 correspondingly may not have the through hole, but have type of structures that cooperates with the fixing structure 166. In one embodiment, the fixing structure 166 may be a screw that can be screwed onto the second plate 138.

Referring back to FIG. 2A, the toner supply container 100 further includes the sealing member 170 sleeved on the first portion 116, the second portion 118, and part of the releasing member 130. Inner end surface of the sealing member 170 is close to and may be in contact with the end surface of the first capping portion 117, and outer end surface of the sealing member 170 flushes with the outer end surface of the second portion 118. As described above, the releasing portion 132 is located outside the second portion 118 and inside the sealing member 170, and is slidable between the second portion 118 and the sealing member 170. By the sliding of the releasing portion 132 between the space between the second portion 118 and the sealing member 170, the opening 135 can be exposed or concealed.

Figure 2B:
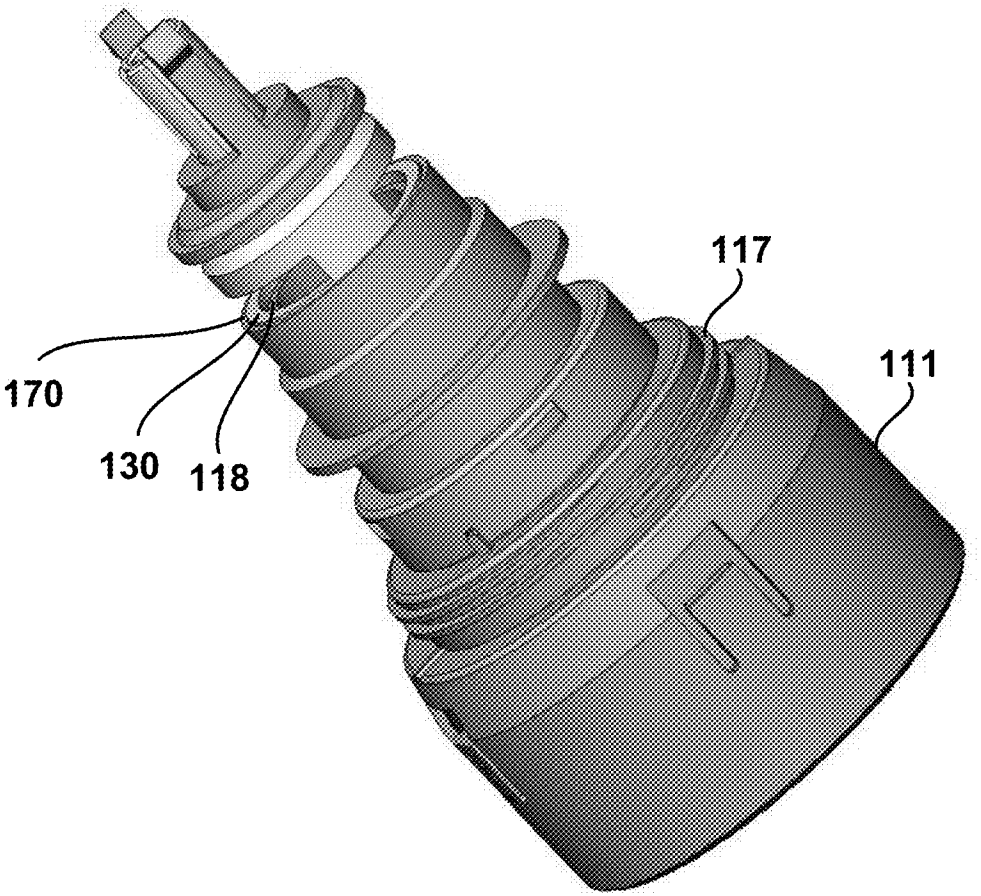
Figure 2C:
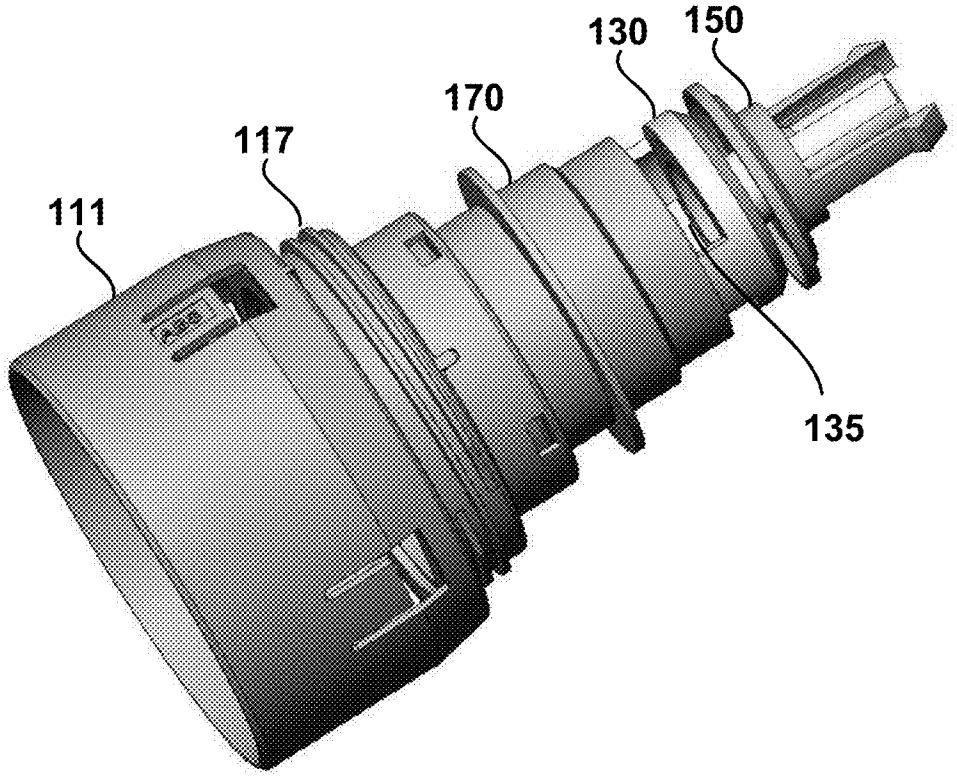

FIGS. 2A-2C schematically show different views of a part of the toner supply container 100 according to one embodiment of the invention, where the toner supply container 100 is in the open state for releasing toner. FIGS. 3A-3B schematically show different views of a part of the toner supply container 100 according to one embodiment of the invention, where the toner supply container 100 is in the close state. The toner supply container 100 is in the close state before being installed. After being installed, the toner supply container 100 is switched from the close state to the open state such that toner can be released or removed. When the toner is used up, the toner supply container 100 can be switched from the open state to the close state such that the toner supply container 100 can be removed from the apparatus for exchanging a new toner supply container.

When the toner supply container 100 is in the open state, as shown in FIGS. 2A-2C, the releasing member 130 is pushed outward by the elastic member 128 toward the D1 direction, such that the at least one opening 135 is exposed from the sealing member 170.

When the toner supply container 100 is in the close state, as shown in FIGS. 3A-3B, the releasing member 130 is pushed inward by a pressing force toward the D2 direction, such that the opening 135 is sealed between the second portion 118 and the sealing member 170. The pressing force may be a driving force from the apparatus.

In another aspect, the present invention is directed to a process of installation and releasing of the toner supply container described above to an apparatus. In certain embodiments, the operations of the toner supply container 100 are described in detail as follows.

Figure 5:
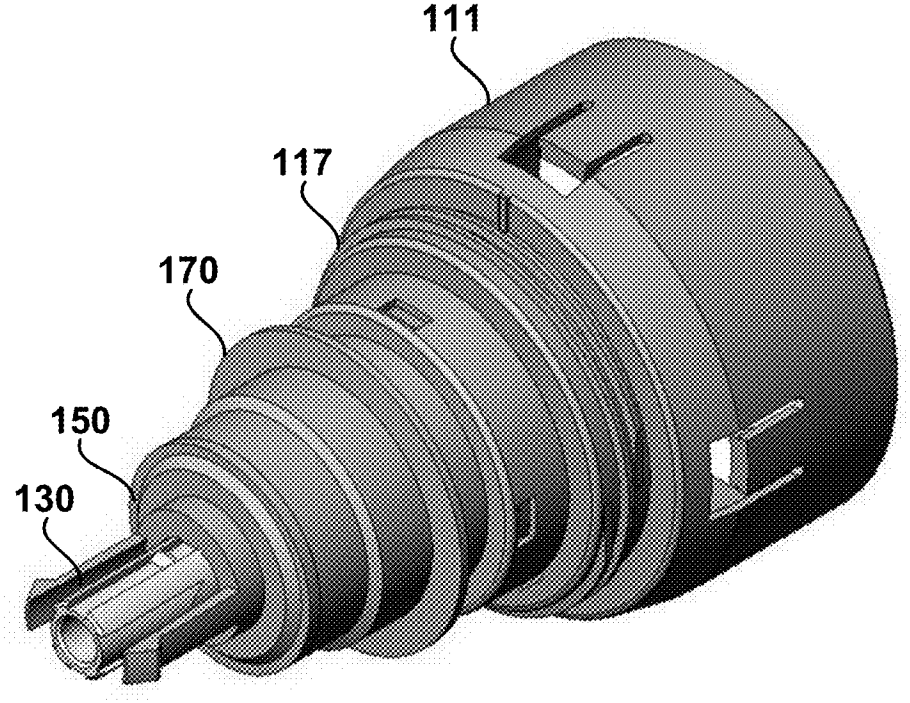
FIG. 5 schematically shows a three-dimensional view of a critical part of the toner supply container according to one embodiment of the present invention.

The description of the operations is focused on the part of the toner supply container 100 shown in FIG. 5. In order to clear show the operations, the sealing member 170 is shown as transparent in FIG. 6A, and the sealing member 170 is removed in FIG. 6B, such that the structures inside the sealing member 170 can be seen easily.

FIG. 7A shows a part of a brand new toner supply container 100, where the first cap 190 is removed, and the toner supply container 100 is placed into the apparatus. The releasing member 130 in FIG. 7A is shown as transparent to more clearly show the structure under it. This is the initial state or close state of the toner supply container 100. At this state, the releasing member 130 is in a retracted position toward the first portion 116, and the at least one window 135 is above the second portion 118. Thus, the opening 135 is closed by the second portion 118 from below the opening 135, and the opening 135 thus is not in fluid communication with the inner space of the toner supply container 100. As shown in FIG. 7B, the retracted position of the releasing member 130 is maintained through the hook member 160, where the first hook 164 is located at the notch of the island 124 and fixed therein. The one or more elastic members 126 are in a pressed condition.

Figure 8A:
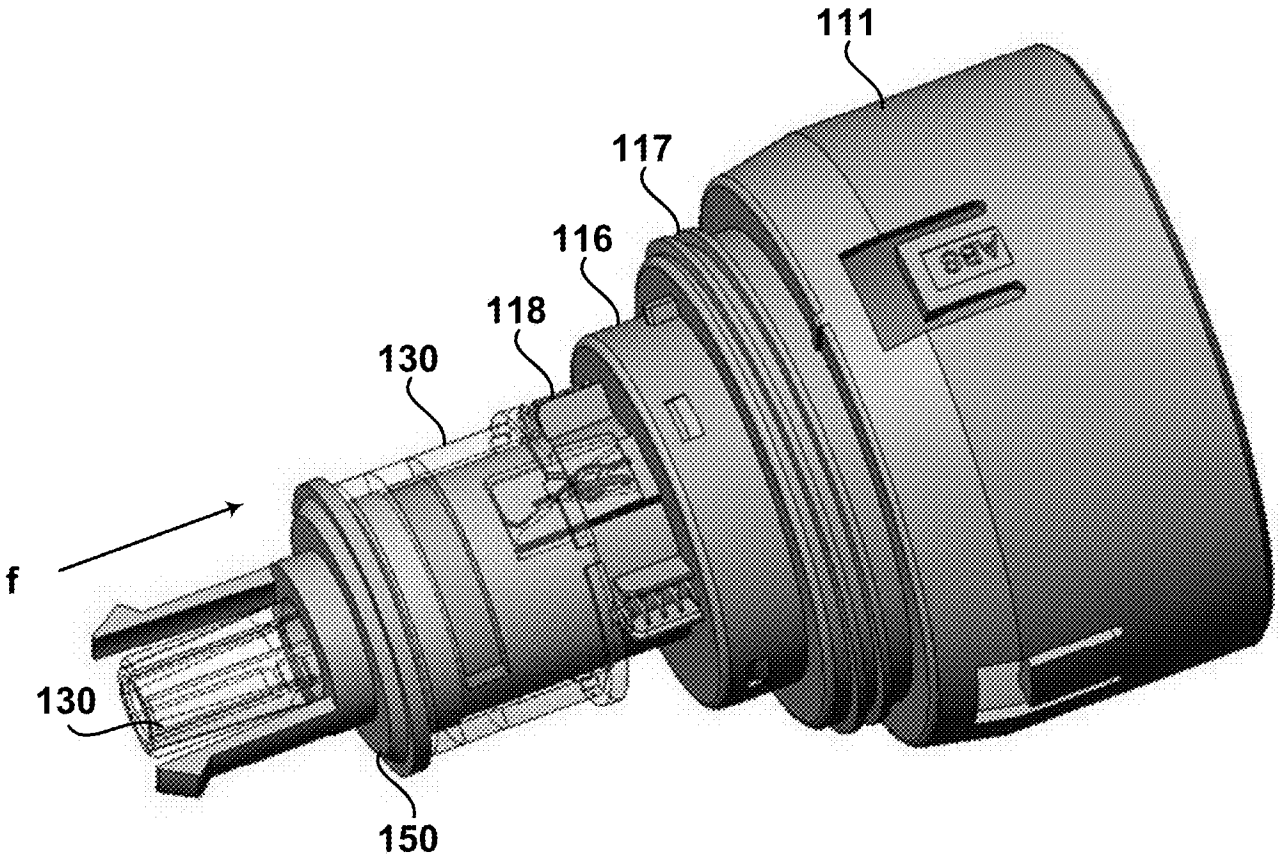
FIGS. 8A-8B schematically show a three-dimensional view of a part of the toner supply container in a transitional state from the initial state to a work (open) state according to one embodiment of the present invention, where the sealing member is shown as transparent.
Figure 8B:
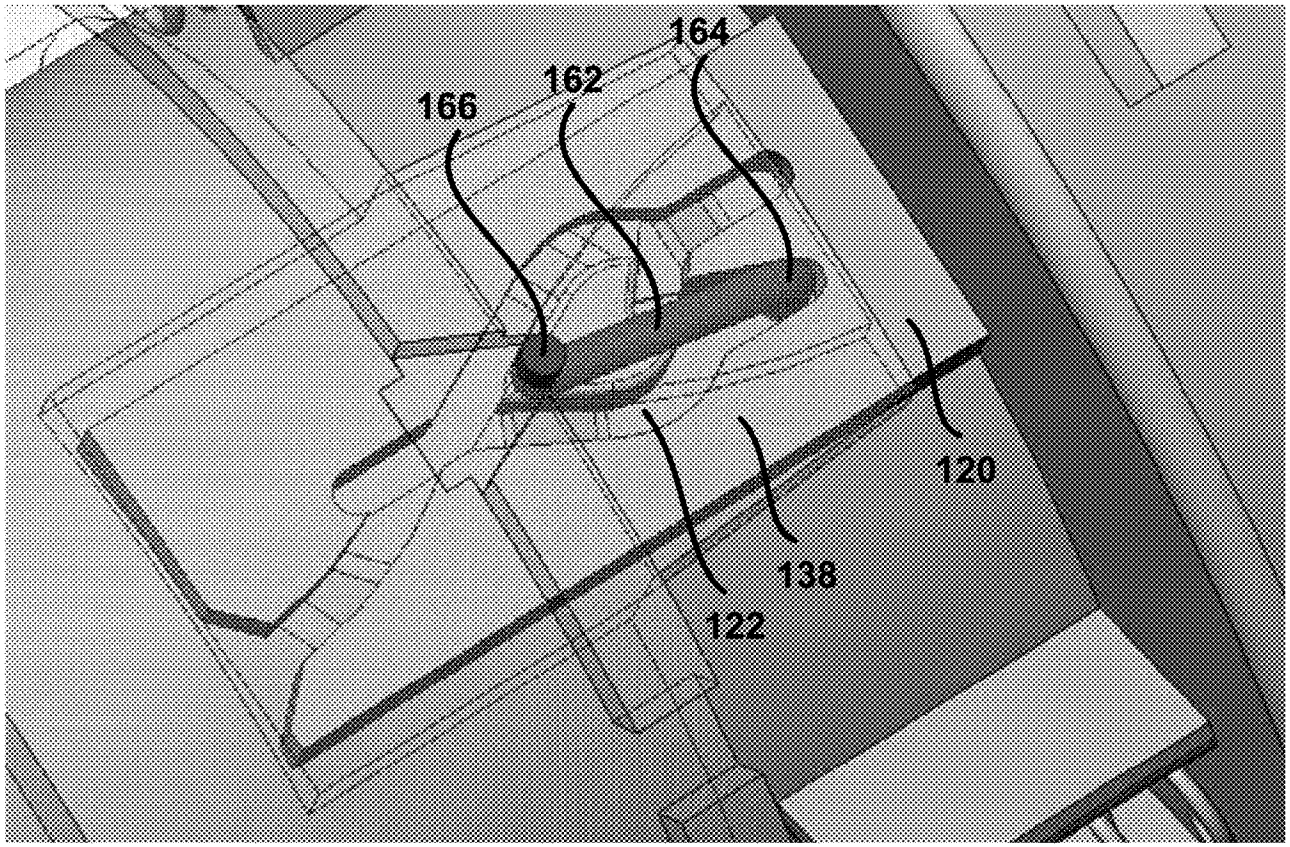

FIGS. 8A-8B show a transition state from the initial (close) state to the work state. When a hopper (not shown) of the apparatus is protruded along the arrow direction to press the engaging member 150 using a force f, the engaging member 150 moves along the D2 direction toward the first portion 116, and the movement of the engaging member 150 subsequently pushes the releasing member 130 to move along the D2 direction toward the first portion 116 as well. The movement of the releasing member 130, specifically the second plate 138, drives the second hook 166. Then the first hook 164, by the driven force of the second hook 166, slides into the third groove portion 122*c* from the notch, passes the third tail section, and enters through the fourth head section to the fourth groove portion 122*d*, and further moves toward the top end of the third free section. At the same time, the elastic member 128 is pressed at this transition state.

Figure 9A:
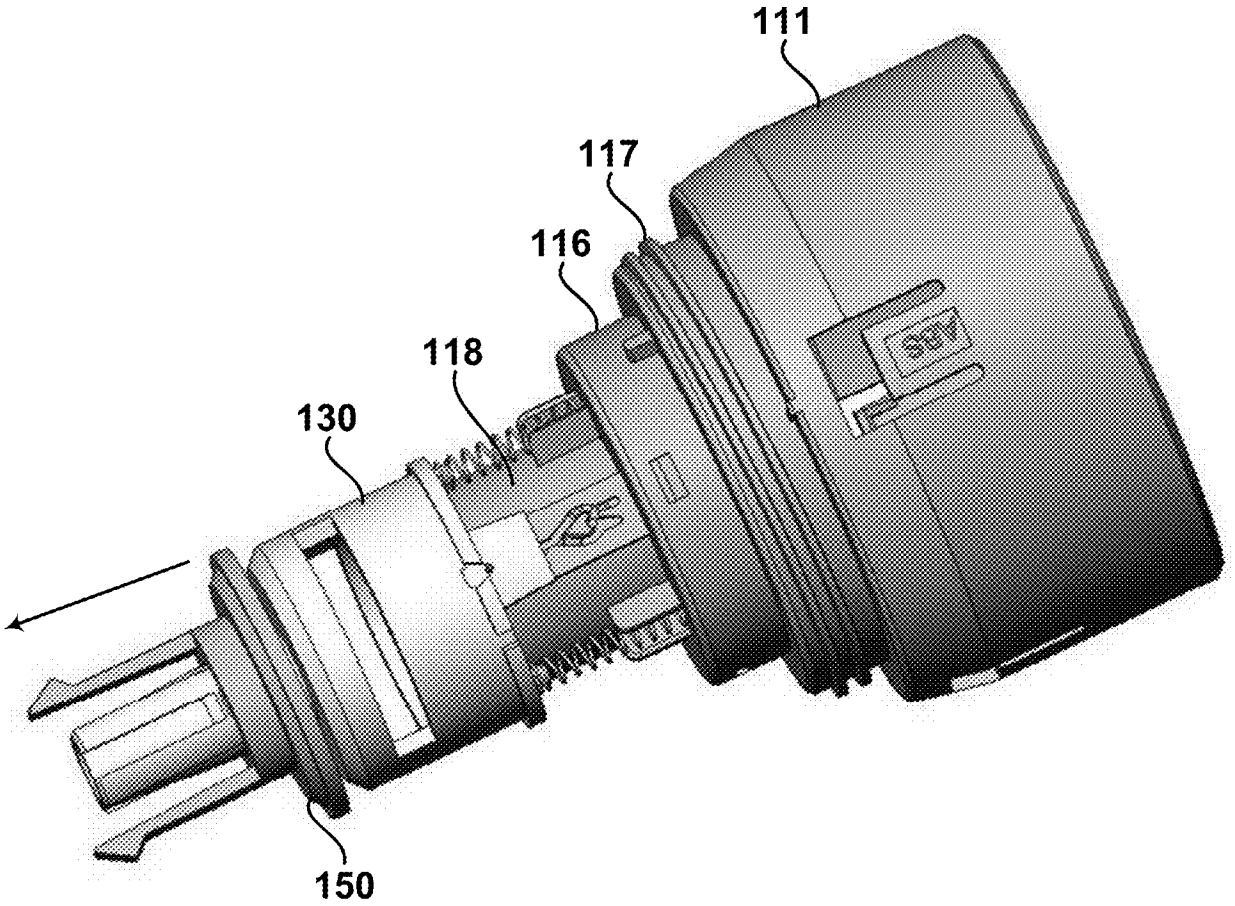
FIGS. 9A-9B schematically show a three-dimensional view of a part of the toner supply container in the work state according to one embodiment of the present invention, where the sealing member is shown as transparent.
Figure 9B:
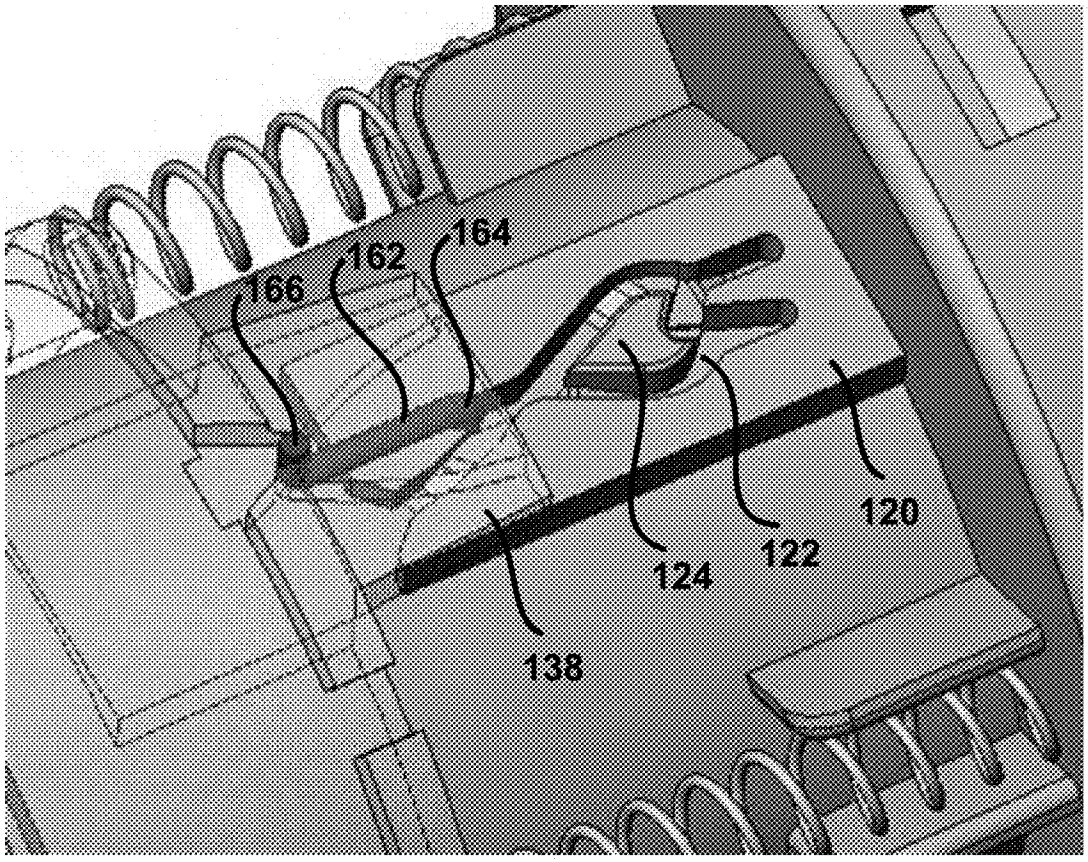

FIGS. 9A-9B show the open or work state of the toner supply container 100 achieved following the above described transition process. The pressing force f from the hopper shown in FIG. 8A is removed. With the releasing of the pressing force f from the hopper, the elastic member 128 pushes back the releasing member 130 outward in the D1 direction, away from the first portion 116. During this process, the first hook 164 slides in the fourth groove portion 122*d* from the top end of the third free section downward, passes the fourth head section and the fourth tail section, then enters from the first head section to the first groove portion 122*a*, and further moves toward the bottom end of the first free section that is most distant from the first portion 116. At this time, the elastic member 126 is in a most extended state, the releasing member 130 is pushed most outwards in the D1 direction to expose the at least one opening 135 from the second portion 118 and the sealing member 170. The opening 135 is in fluid communication with the inner space of the toner supply container. The toner supply container 100 is at the open or work state, and the toner is provided from the opening 135 to the apparatus.

Figure 10A:
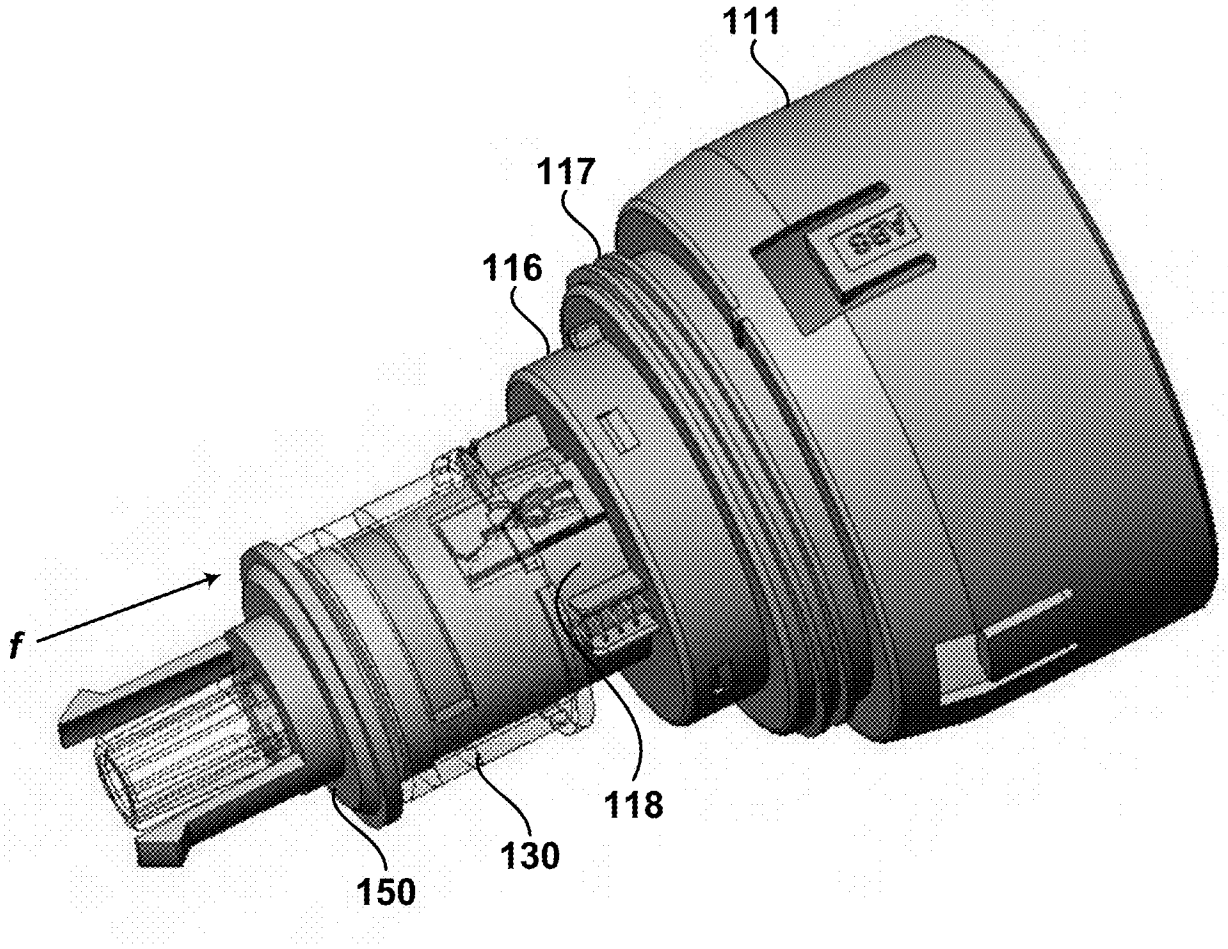
FIGS. 10A-10B schematically show a three-dimensional view of a part of the toner supply container in a transitional state from the work (open) state to a close state according to one embodiment of the present invention, where the sealing member is shown as transparent.
Figure 10B:
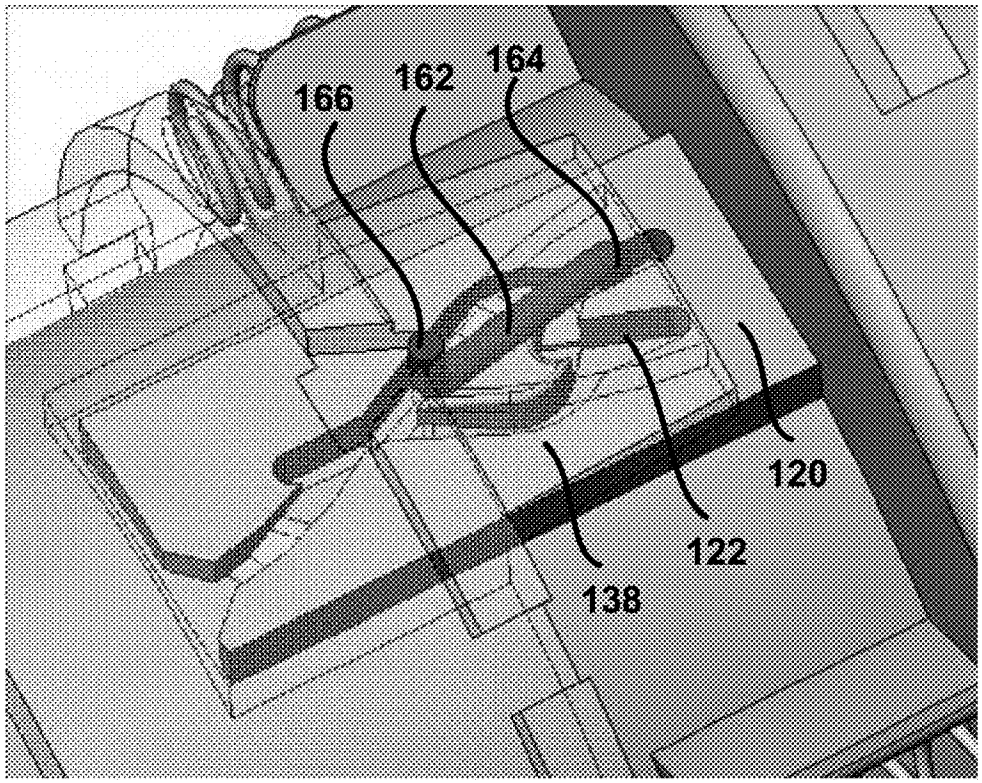

After the toner is used up, exchanging of the toner supply container 100 by a new toner supply container is required. In order to achieve this purpose, the toner supply container 100 need to be released from the apparatus and removed from the apparatus. FIGS. 10A-10B show a transition state from the work state to the close state. When the hopper (not shown) of the apparatus is protruded along the D2 direction to press the engaging member 150, the engaging member 150 moves along the D1 direction toward the first portion 116, and the movement of the engaging member 150 subsequently pushes the releasing member 130 to move along the D1 direction as well toward the first portion 116. The movement of the releasing member 130, specifically the second plate 138, drives the second hook 166. Then the first hook 164, moved by the driven force of the second hook 166, slides into the first groove portion 122*a* from the first free section, passes the first head section, and enters through the first tail section to the second groove portion 122*b*, and further moves toward the top end of the second free section that is close to the first portion 116. At this transition state, the elastic member 128 is pressed. Depending on the pressing force, the movement of the first hook 164 in the second groove portion 122*b* may be varies. However, the pressing force should be at least sufficient to move the first hook 164 passing through the first tail section of the first groove portion 122*a* to the second head section of the second groove portion 122*b*.

Figure 11B:
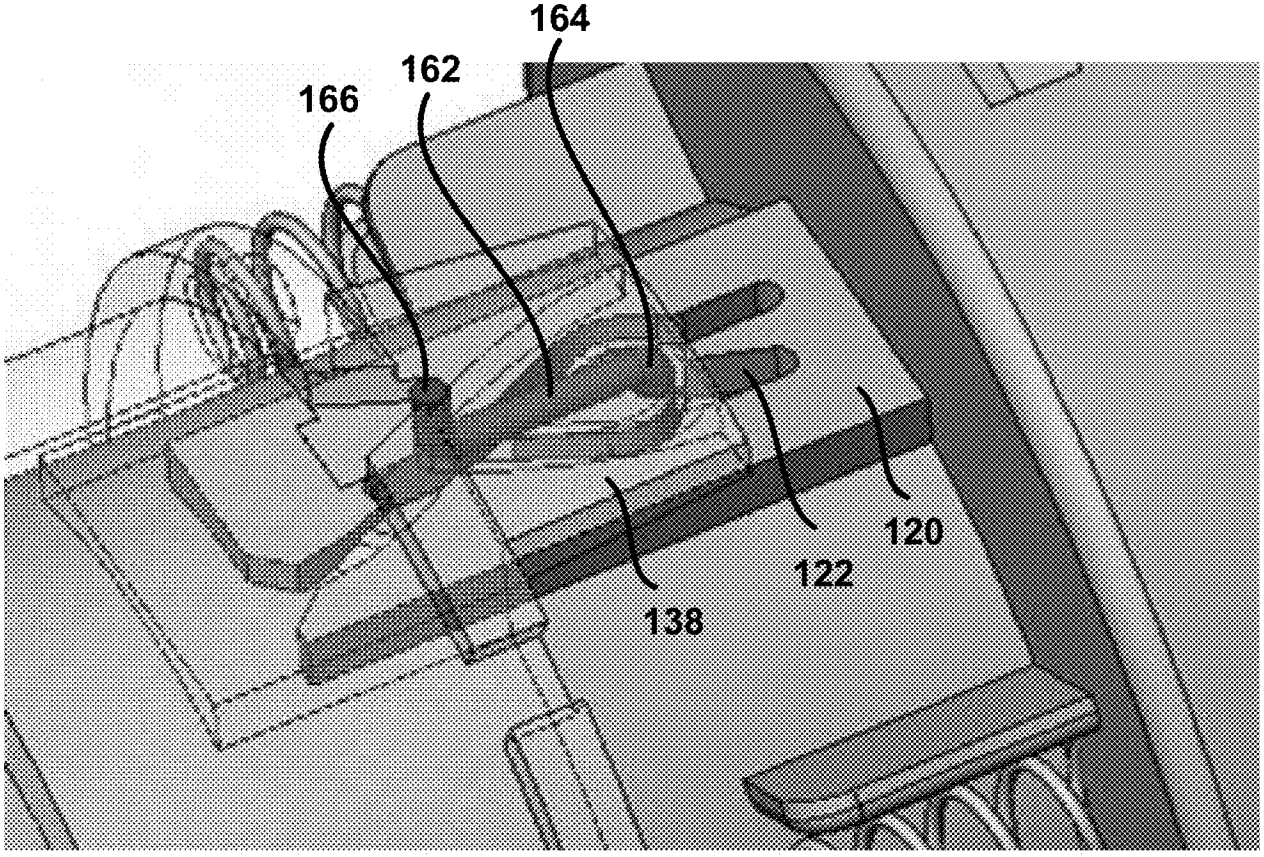

FIGS. 11A-11B show the close state of the toner supply container 100 achieved after the above described transition process. After releasing of the pressing force by the hopper of the apparatus, the elastic member 128 pushes the urging portion 136 and thus moves the releasing member 130 back toward the D1 direction, which accordingly moves the hook 160 back toward the D1 direction. The pressing force from the hopper shown in FIG. 10A is removed. With the releasing of the pressing force f from the hopper, the elastic member 128 pushes back the releasing member 130 outward along the D1 direction. During this process, the first hook 164 slides into the second groove portion 122*b* from the top end of the second free section downward, passes the second head section and the second tail section, then enters from the second tail section to the third groove portion 122*c*, and further moves toward the notch of the island 124. At this time, the toner supply container 100 is at the close state, and is ready to be removed from the apparatus.

After removing the used toner supply container 100, a new supply toner container can be installed and turned to work state according to the process shown in FIGS. 7A-9B as described above.

FIGS. 12-39B schematically shows structure of a toner supply container according to another embodiment of the invention.

Figure 12:
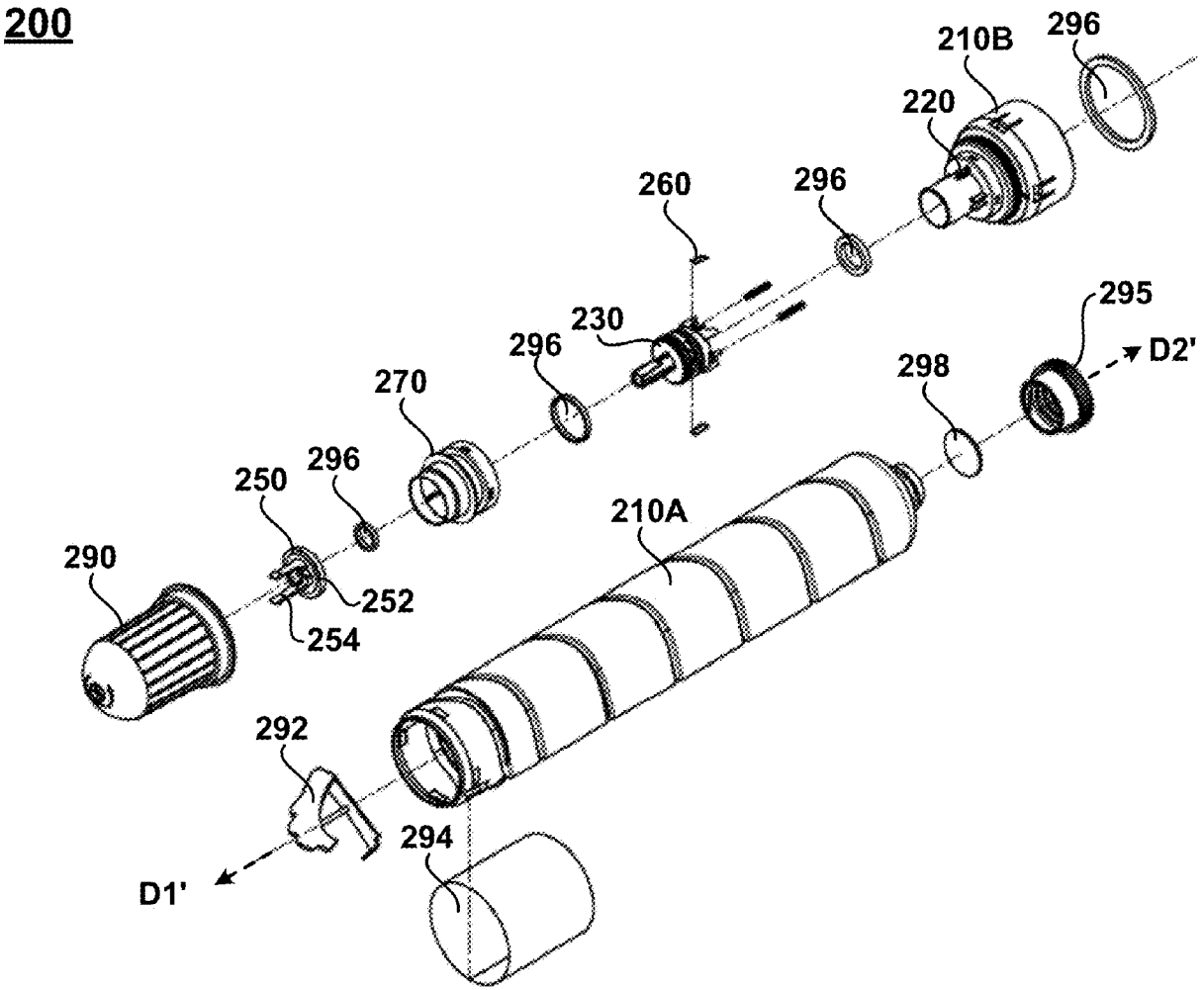
FIG. 12 schematically shows a three-dimensional view of a toner supply container according to one embodiment of the invention.

As shown in FIG. 12, a toner supply container 200 includes a container body 210, a releasing member 230, an engaging member 250, a sealing member 270, a first cap 290 and a second cap 295. The container body 210 includes a middle member 210A and a front member 210B sleevable on the middle member 210A. The toner supply container 200 further includes a pluck 292 disposed inside the middle member 210A, a warning label 294 wrapping the outer surface of the middle member 210A at the front end, and multiple sealing rings 296 or sealing plate 298. The pluck 292 is attached on circumference of opening of the container body 210 and extends to the cap, and is configured to convey toner to the toner outlet. The warning label 294 may have warning message printed in its outer surface. The sealing rings 296 or the sealing plate 298 are used to seal the connections between different components of the toner supply container 200.

The toner supply container 200 has an axis along the longitudinal direction, and a radial direction located at the circular sectional plane of the cylinder of the toner supply container 200. As shown in FIG. 12, the direction from the second cap 295 to the first cap 290 along the longitudinal axis of the toner supply container 200 is named D1', and the direction from the first cap 290 to the second cap 295 along the longitudinal axis of the toner supply container 200 is named D2'. The D1' direction is also named as a front direction; and the D2' direction is also named as a rear direction. At the radial direction of the toner supply container 200, the direction from a position toward the axis along the radial direction is named inside direction, for example, direction D3 in FIG. 14B. Accordingly, the direction from the axis to another position along the radial direction is named outside direction, for example, direction D4 in FIG. 14C.

Figure 13C:
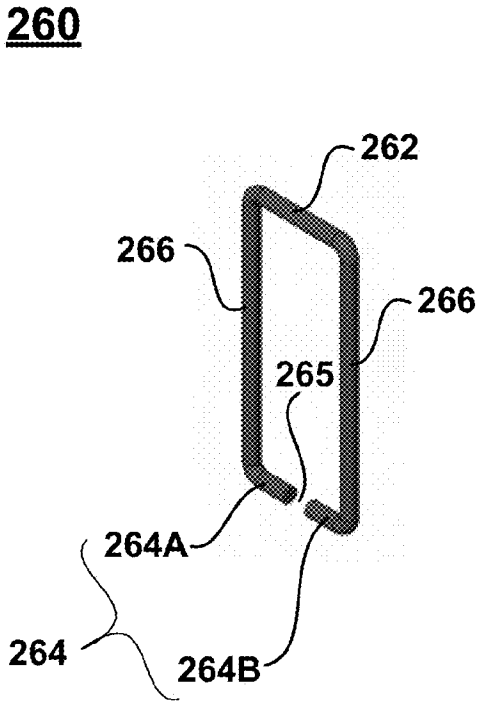
FIG. 13C is a schematic three-dimensional view of a hook member according to one embodiment of the present invention.
Figure 13B:
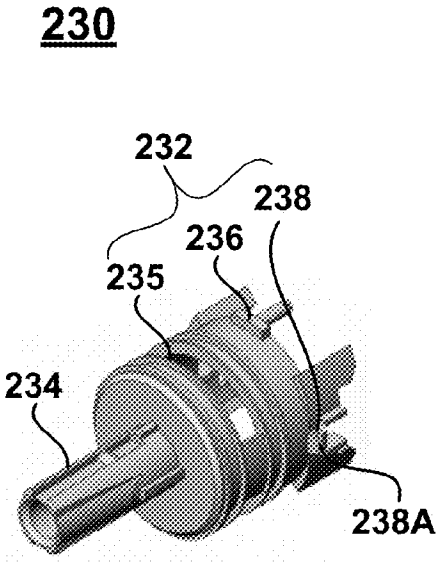
FIG. 13B is a schematic three-dimensional view of a releasing member according to one embodiment of the present invention.
Figure 13A:
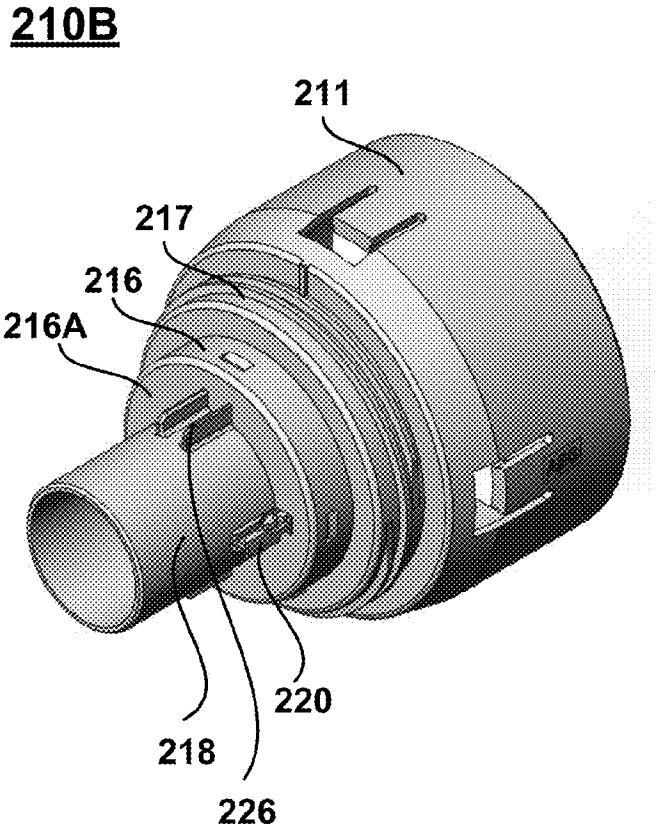
FIG. 13A is a schematic three-dimensional view of a front member according to one embodiment of the present invention.

FIG. 13A is a schematic three-dimensional view of the front member 210B. The front member 210B has a sleeve portion 211 sleevable on the front end of the middle member 210A, and a first capping portion 217 extending forward (along the D1 direction) from the front member 210B.

The first capping portion 217 is in a cylindrical shape. The diameter of the first capping portion 217 is smaller than a diameter of the sleeve portion 211. In certain embodiments, an outer surface of the first capping portion 217 is threaded, and an inner surface of the first cap 290 is threaded, such that the first cap 290 is fixable to the first capping portion 217 by screwing. The diameter of the opening of the first cap 290 is substantially the same as the diameter of the sleeve portion 211 of the front member 210B, such that when the first cap 290 is screwed onto the first capping portion 217, an end surface at the opening of the first cap 290 urges the front side surface of the sleeve portion 211 of the front member 210B.

The first capping portion 217 extends in the D1' direction to form a first portion 216. The first portion 216 may have a cylindrical shape, and the diameter of the first portion 216 is smaller than the diameter of the first capping portion 217. The first portion 216 has a front surface 216A.

The first portion 216 extends in the D1 direction to form a second portion 218. The second portion 218 may have a cylindrical shape, and the diameter of the second portion 218 is smaller than the diameter of the first portion 216.

At least one plate 220 is disposed on the outer surface of the second portion 218. The plate 220 has a dimension of L×W×H, where L is the length, W is the width, H is the height of the plate 220, and L>W>H. The plate 220 is perpendicular to the outer surface of the second portion 218. The L side lines of the plate 220 are parallel to the axis of the toner supply container 200, the W side lines of the plate 220 is in the radial direction of the toner supply container 200. In other words, the two L×W sides of the plate 220 are substantially perpendicular to the outer surface of the second portion 218, and aligned with the D1'-D2' direction, and the two L×H sides of the plate 220 are substantially parallel to the outer surface of the second portion 218. In certain embodiments, the surfaces of the plate 220 are flat surfaces. In other embodiments, at least one of the surfaces, such as the L×H side surfaces of the plate 220, has a shape of arc that is consistent with the shape of the cylindrical outer surface of the second portion 218. In certain embodiments, the number of the plate 220 is two, and the two plates 220 are symmetrically disposed on the outer surface of the second portion 218. In certain embodiments, the toner supply container 200 has more than two plates 220. One of the L×W sides of the plate 220 is termed as the left side 220A (or the first side 220A, or the front side 220A), and the other one of the L×W sides of the plate 220 is termed as the right side 220B (or the second side 220B, or the back side 220B). Referring to FIG. 14C, the arrow D5 points to the left side 220A, and the arrow D6 points to the right side 220B of the plate 220. FIGS. 15A and 15B label the left side 220A and the right side 220B, respectively. The plate 220 has a first groove 222 on the left side 220A, and a second groove 224 on the right side 220B. The first pin 264A and the second pin 264B are configured to be inserted respectively into the first grooves 222 and the second groove 224. The 220 may be integrally formed with the second portion 218, or may be separately formed and then disposed on or attached to the second portion 218.

One or more pairs of retaining plates 226 may be disposed on the outer surface of the second portion 218. Each pair of retaining plates may be used to retain an elastic member 228 in place. In certain embodiments, the structure of the retaining plates 226 is the same as the retaining plates 126 described above. In certain embodiments, the number of the retaining plates 226 pairs is two or more, and the two or more pairs of the retaining plates 226 are distributed evenly around the outer surface of the second portion 218. The retaining plate 226 may be integrally formed with the second portion 218, or may be separately formed and then disposed on or attached to the second portion 218.

In certain embodiments, the retaining structure for retaining the elastic member 228 may not be the retaining plates 226 as described above. In certain embodiments, the retaining structure may be a protrusion or a rib projected from the outer surface of the second portion 218. In one embodiment, the retaining structure may be a recess formed on the outer surface of the second portion 218. The retaining structure for retaining the elastic member 228 is not limited to the retaining plates 226, the protrusion, the rib, or the recess, as long as the retaining structure is configured to hold the elastic member 228 in place.

FIG. 13B is a schematic three-dimensional view of the releasing member 230. The releasing member 230 includes a releasing portion 232 sleeved on the second portion 218 and a protrusion portion 234 extending from the releasing portion 232 in the D1 direction. The releasing portion 232 has at least one opening 235, an urging section 236, and a fixing member 238.

The releasing portion 232 may have a cylindrical shape, and includes an inner surface facing the outer surface of the second portion 218, and an outer surface facing outwards towards the inner surface of the sealing member 270. A diameter of the releasing portion 232 is slightly greater than the diameter of the second portion 218, slightly smaller than corresponding part of the sealing member 270, and smaller than the diameter of the first portion 216. The releasing portion 232 is sleeved on the second portion 218, and is slidable along the longitudinal axial of the toner supply container 200. The releasing portion 232 is not completely overlap with the second portion 218. In other words, the length of the releasing portion 232 is shorter than the length of the second portion 218 along the longitudinal direction, there is a clearance or distance between the inner side of the toner releasing portion 232 and the front end surface of the first portion 216, such that a part of the outer surface of the second portion 218 is exposable from the clearance.

The at least one opening 235 is formed on and through the releasing portion 232, and configured to release toner from the toner supply container 200 to a receiving portion of the apparatus (not shown).

The opening 235 is slidable together with the releasing portion 232 between the second portion 218 and the sealing member 270. The opening 235 is in fluid communication with the inner space of the container body 210 under work state. At work or open state, the opening 235 is moved out of the space between the second portion 218 and the sealing member 270, and the toner is able to be dispensed from the inner space of the container body 210, through the opening 235, and provided to the apparatus. At a close state, the opening 235 is located completely between the second portion 218 and the sealing member 270, is blocked by the second portion 218 and the sealing member 270, and is not in communication with the inner space of the container body 210 anymore.

The urging portion 236 is located at the rear end of the releasing portion 232 that is close to the first portion 216. The urging portion 236 may be a block shaped structure protruding from the outer surface of the releasing portion 232 at the rear end. In one embodiment, one end of the elastic member 228 urges against the end surface of the first portion 216, and the other end of the elastic member 228 urges against the urging portion 236 of the releasing portion 232.

The fixing member 238 protrudes outward/upward from the outer surface of the releasing portion 232 at the rear end. The fixing member 238 has a fixing groove 238A concavely formed from the upper surface of the fixing member 238, to receive one side of the hook member 260.

The protrusion portion 234 extends from the releasing portion 232 in the D1' direction. The protrusion portion 234 is configured to receive a driving force, such as a pressing force from apparatus via the engaging member 250, so as to switch the releasing portion 232 between the open state and the close state.

As shown in FIG. 13C, the hook member 260 is in a shape of a rectangular frame. The rectangular shaped hook member 260 has a front side 262, a rear side 264, and left and right sides 266. Each of the left side or the right side 266 respectively connects the front side 262 and the rear side 264. The rear side 264 of the hook member 260 has a notch 265. The rear side 264 includes a first pin 264A and a second pin 264B separated by the notch 265. The notch 265 may be located in the center of the rear side 264, and the first pin 264A and the second pin 264B may be symmetrical and interchangeable. In other embodiments, the first and second pins 264A and 264B may be asymmetrical and have different lengths. In certain embodiments, the hook member 260 is integrally formed. In certain embodiments, the hook member 260 is made of an elastic material. In one embodiment, the hook member is made of a metal material.

As can be seen from FIGS. 12-13C, the structure of the toner supply container 200 is similar to the structure of the toner supply container 100. However, the toner supply container 200 has a different structure and mechanism for press-releasing. Specifically, instead of having the first plate 120 parallel to the surface of the second portion 118, the groove 122 disposed on the upper side surface of the first plate 120, the second plate 138, and the hook member 160 movably fixed to the groove 122 and the second plate 138, the toner supply container 200 has the plate 220 perpendicular to the surface of the second portion 218, the first groove 222 and the second groove 224 disposed at two opposite side surfaces of the plate 220, the fixing member 238 having the fixing groove 238A, and the hook member 260 having the first pin 264A and the second pin 264B respectively slidably received in the first groove 222 and the second groove 224.

Figure 14B:
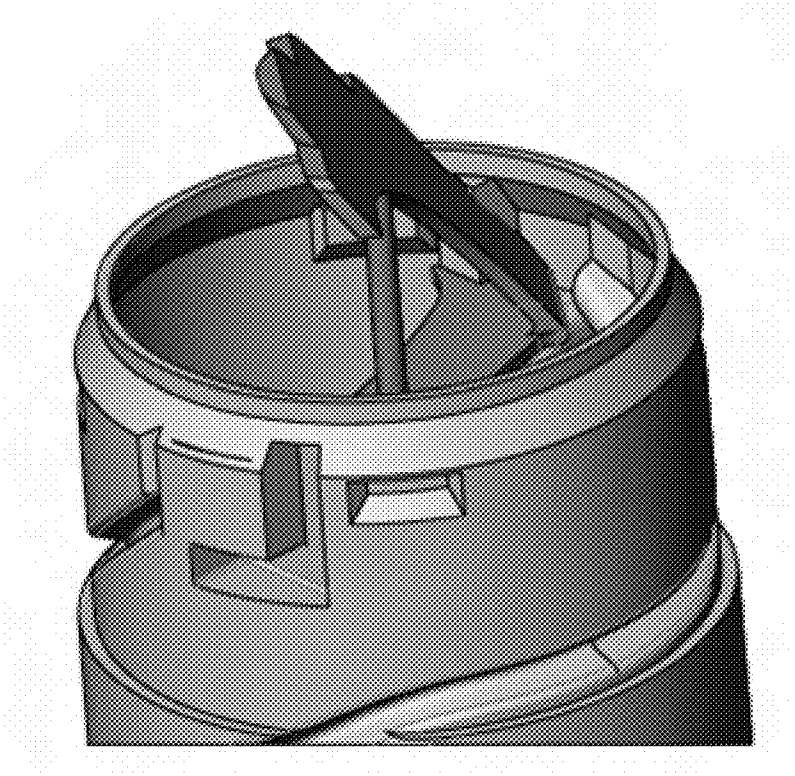
FIGS. 14A-14E schematically show assembly of a pluck according to one embodiment of the present invention.
Figure 14A:
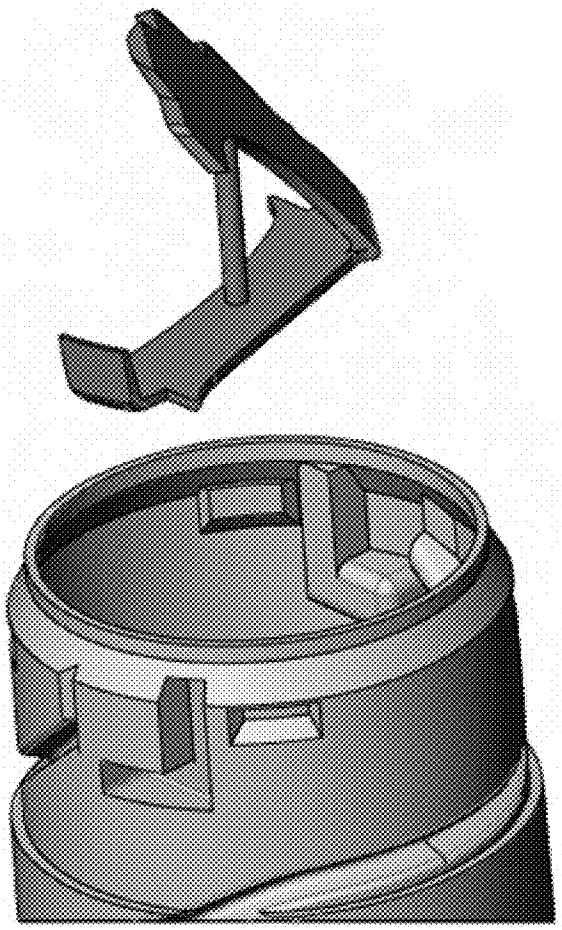
Figure 14C:
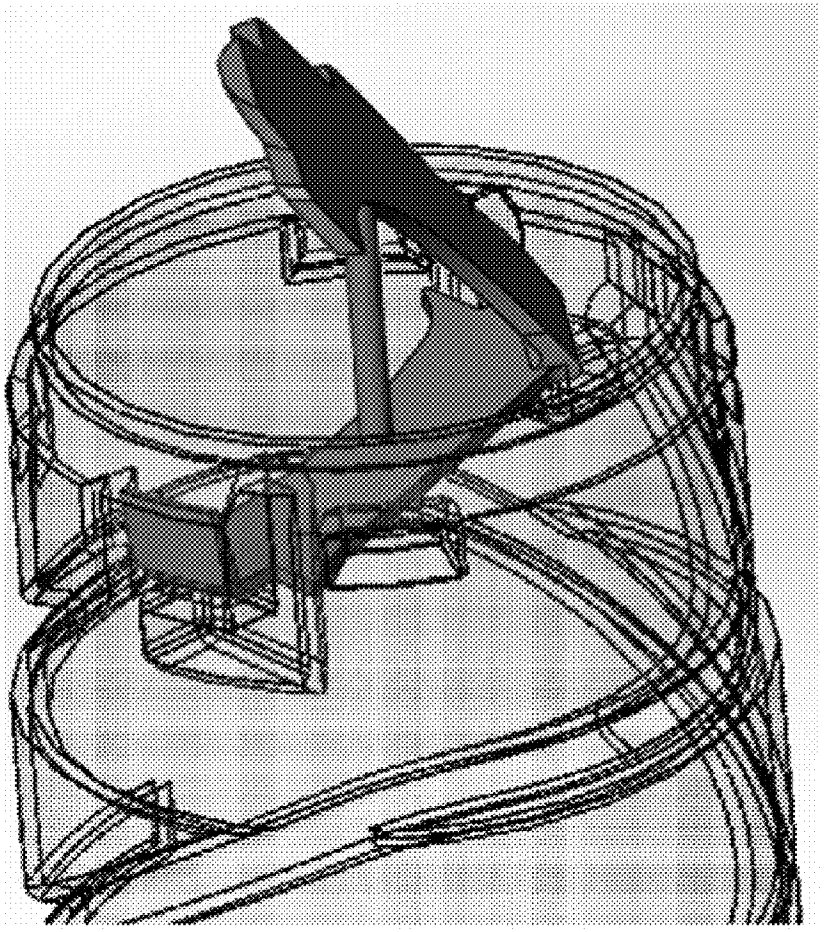
Figure 14E:
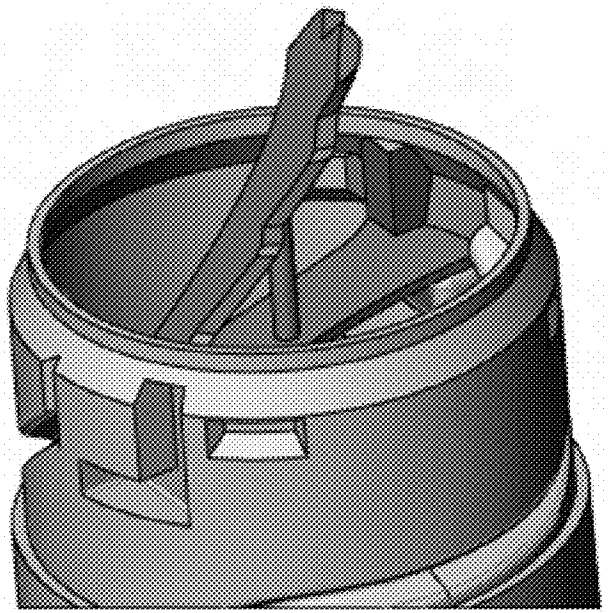
Figure 14D:
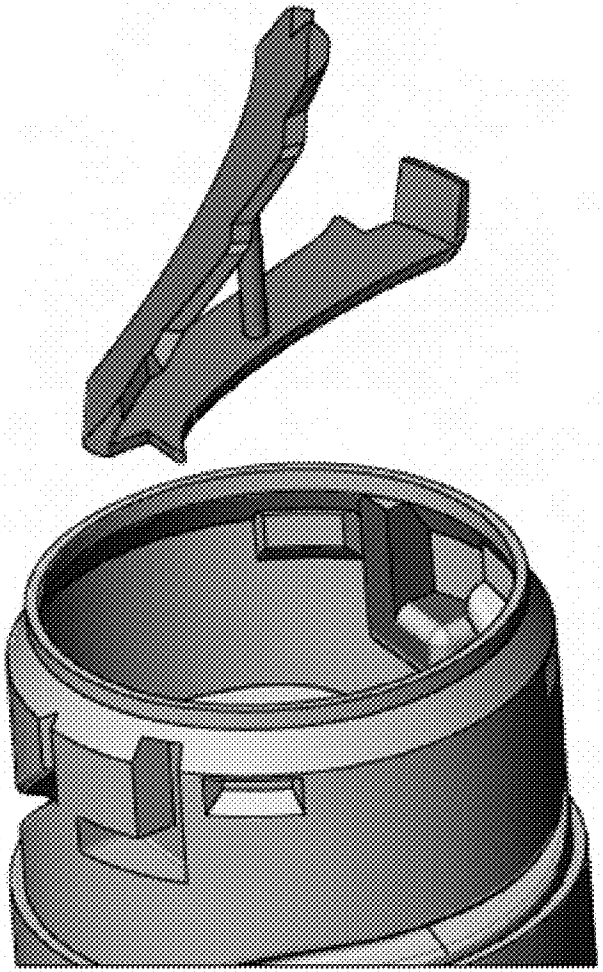
Figure 15A:
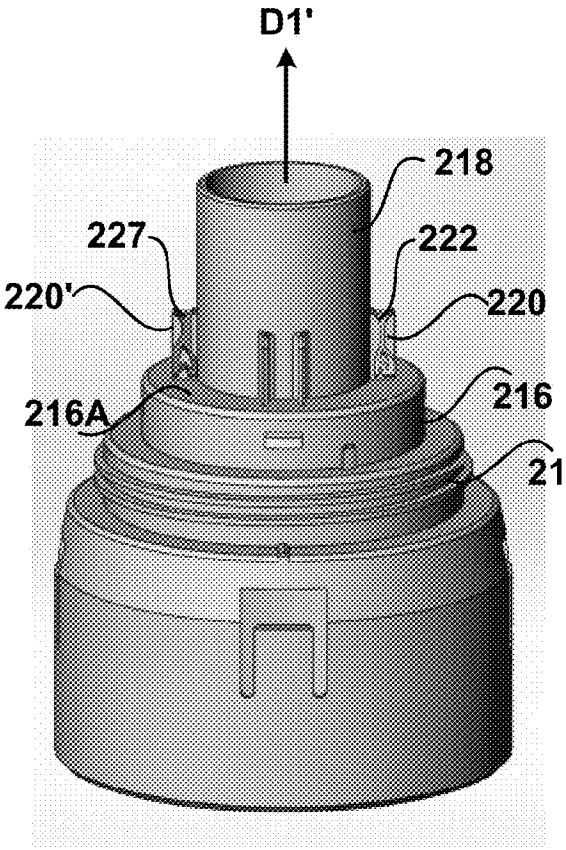
FIGS. 15A-15C are schematically views of grooves on a plate according to one embodiment of the present invention.
Figure 15B:
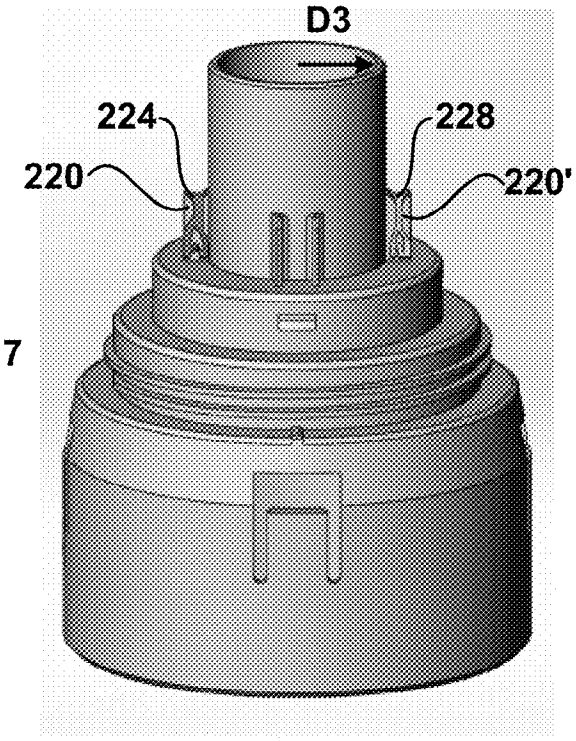

FIGS. 14A-14E shows the assembly of the pluck 292. As shown in FIGS. 14A and 14B, the pluck 292 is aligned with a seat disposed on the inner side of the container body 210, and a middle part of the pluck 292 is fixed to the seat. As shown in FIG. 14C, after the assembly, the middle part of the pluck 292 is fixed to the seat, while one end of the pluck 292 is received and fixed to a hole disposed on the inner side of the container body 210. The seat and the hole may have different structures, or have the same structure. Further, as shown in FIGS. 14D and 14E, the pluck 292 may be rotated 180° before assembly, such that the one end of the pluck 292 is disposed in the seat. The pluck 292 is rotatable together with the container body 210, so as to help moving the toner toward the toner outlet.

Figure 15C:
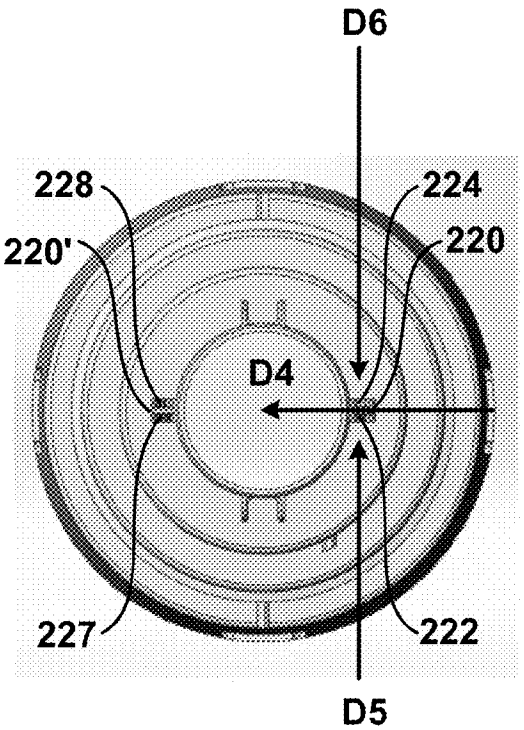

FIGS. 15A-15C schematically show the grooves on the plate 220. In this embodiment, there are two plates 220 and 220' disposed symmetrically relative to the axis of the toner supply container 220. The plate 220 is disposed on the outer surface of the second portion 218 and perpendicular to the outer surface of the second portion 218. One side of the plate 220 (W×H) is disposed on the front surface 216A of the first portion 216, such that the plate 220 is also perpendicular to the front surface 216A. The plate 220 has two opposite L×W side surfaces, the first side 220A and the opposite second side 220B. The first side 220A of the plate 220 is concavely formed with the first groove 222, and the second side 220B of the plate 220 is concavely formed with the second groove 224. The structure of the plate 220' is similar to the structure of the plate 220. The plate 220' has a third groove 227 and a fourth groove 228. In certain embodiments, the plate 220' has the same structure as the plate 220, the fourth groove 228 has the same structure as the first groove 222, and the third groove 227 has the same structure as the second groove 224. The plates 220 and 220' may be integrally formed with the second portion 218, or may be separately formed and then disposed on or attached to the second portion 218.

Figure 16A:
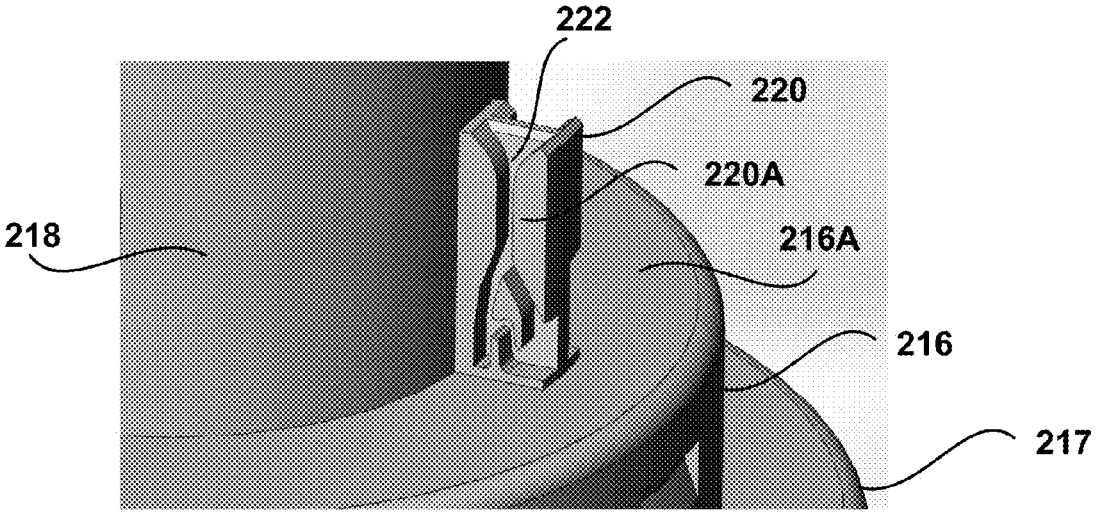
FIG. 16A is a schematically three-dimensional view of a first groove according to one embodiment of the present invention.
Figure 16B:
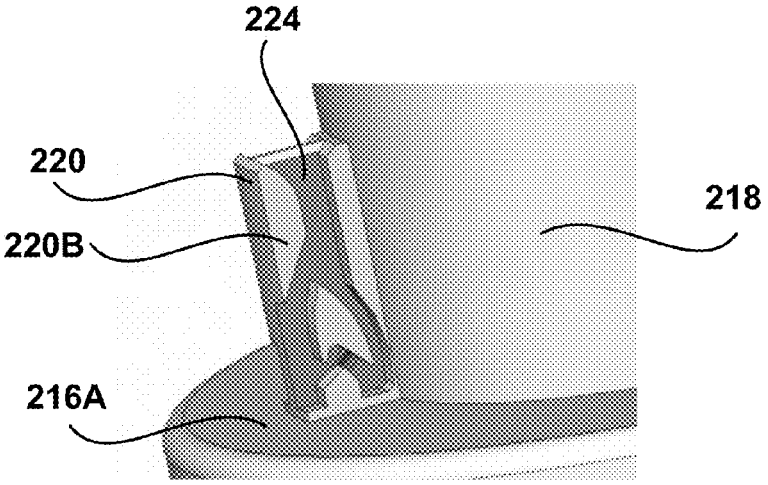
FIG. 16B a schematically three-dimensional view of a second groove according to one embodiment of the present invention.

FIGS. 16A and 16B are enlarged views of the first groove 222 and the second groove 224.

Figure 17A:
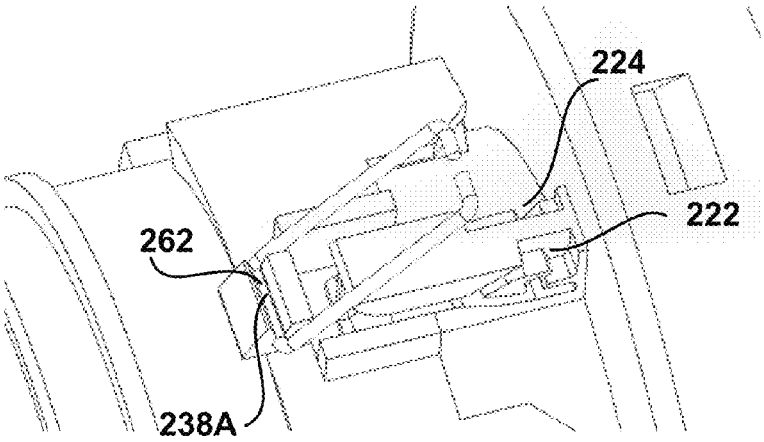
FIGS. 17A-17C are schematically three-dimensional views of mounting a hook member to the grooves according to one embodiment of the present invention.

FIG. 17A schematically shows the assembly of the hook member 260 to the fixing member 238. Specifically, the front side 262 of the hook member is inserted into the fixing groove 238A of the fixing member 238. In certain embodiments, the shortest opening width of the fixing groove 238A is smaller than a diameter of the front side 262, such that the front side 262 may only be pressed into the fixing groove 238A by an external force, for example, pressed by a human finger. Thus, once the front side 262 is inserted into the fixing groove 238A, the opening of the fixing groove 238A may prevent releasing of the front side 262 from the fixing groove 238A. In certain embodiments, the fixing groove 238A may limit the move of the front side 262 by other suitable means.

Figure 17B:
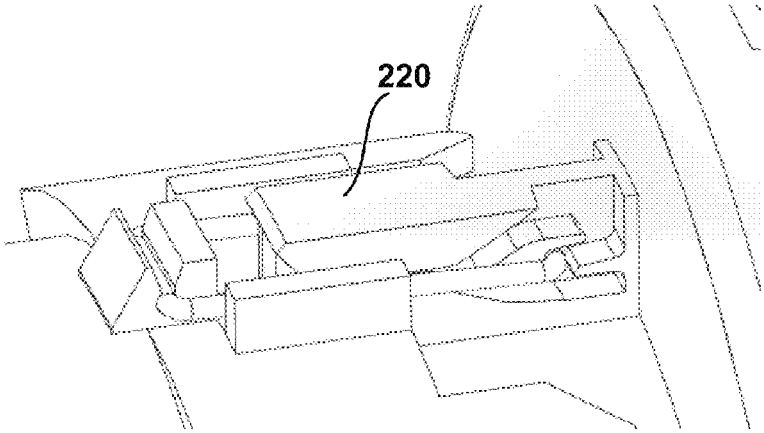
Figure 17C:
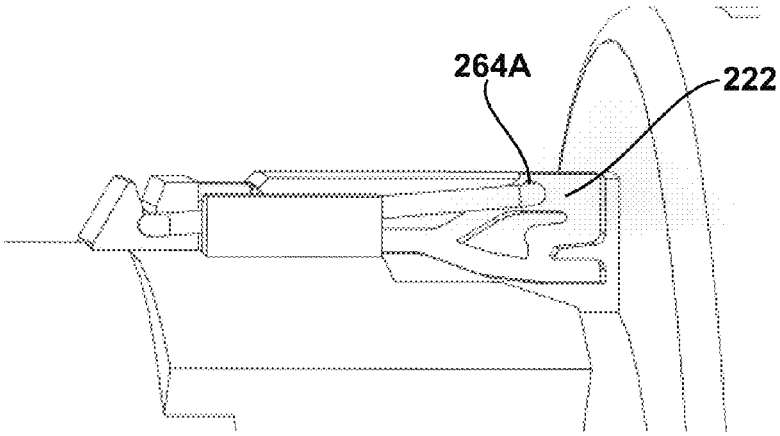

As shown in FIG. 17B, after the front side 262 is inserted into the fixing groove 238A, the rear side 264 may be pressed to enter the first groove 222 and the second groove 224. FIG. 17B is an initial status of the toner supply container 200. Referring to FIG. 17C, once the hook member 260 is pushed toward the D2' direction, the first pin 264A may only move in the first groove 222 outward/upward away from the second portion 218.

Figure 18B:
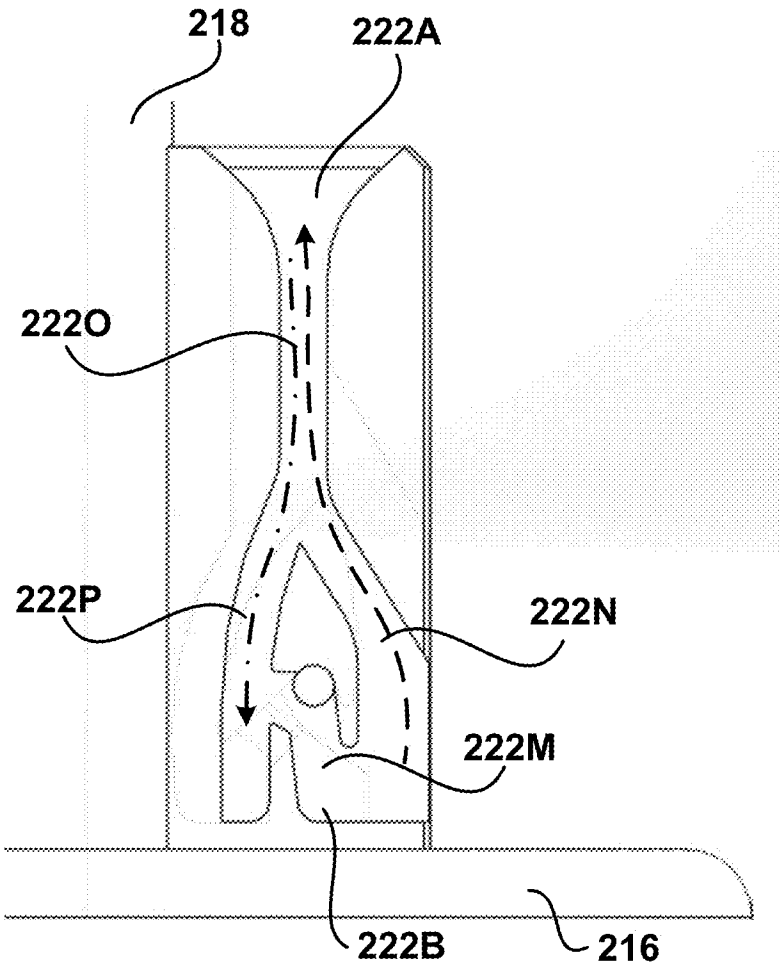
FIGS. 18A-18B are schematically front views of a first groove according to one embodiment of the present invention.
Figure 18A:
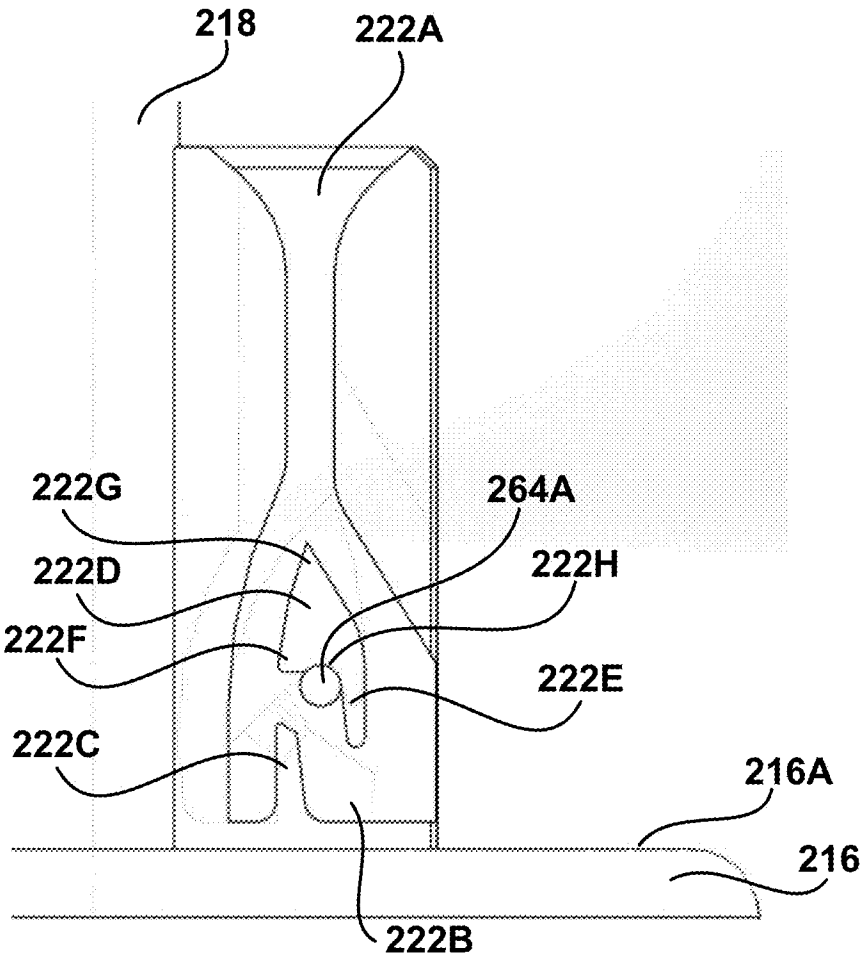

FIG. 18A and FIG. 18B are schematic views of the first side 220A of the first plate 220. As shown in FIG. 17A, the first groove 222 is concavely formed on the first side 220A. The first groove has a front end 222A and a rear end 222B. A first protrusion 222C protrudes from the rear end 222B toward the front direction (D1' direction). A first island 222D is located within the first groove 222. The first island 222D has a second large protrusion 222E protruding toward the rear direction, a second small protrusion 222F protruding substantially toward the rear/inward direction, and a second front protrusion 222G protruding toward the front direction (D1' direction). A first notch 222H is formed between the second large protrusion 222E and the second small protrusion 222F. The first notch 222H is located at the rear side of the first island 222D. As shown in FIG. 17A, the inner side of the first protrusion 222C is substantially aligned with the lower end of the inner side of the island 222D, that is, the inner side of the second small protrusion 222F. The first protrusion 222C and the second small protrusion 222F are close to the second portion 218, the second large protrusion 222E is away from the second portion 218, and the first notch 222H is located between the second large protrusion 222E and the first protrusion 222C/second small protrusion 222F.

The first island 222D and the first protrusion 222C separates the first groove 222 into four sections: a first section 222M located at the rear side of the first island 222D that is close to the first portion 216, a second section 222N located at one side of the first island 222D that is away from the second portion 218, a third section 222O located in the front of the first island 222D, and a fourth section 222P located at the other side of the first island 222D that is close to the second portion 218. The first section 222M connects the second section 222N and the fourth section 222P from the rear side of the first groove 222, and the third section 222O connects the second section 222N and the fourth section 222P from the front side of the first groove 222. After assembly, the first pin 264A of the hook member 260 is inserted into the first groove 222, for example, at the location of the first notch 222H. By the cooperation of the movement of the first pin 264A in the first groove 222 and the movement of the second pin 264B in the second groove 224, the first pin 264A is configured to slide from the first section 222M through the second section 222N to the third section 222O, or from the third section 222O through the third section 222P to the first section 222M. In other words, as shown in the dotted arrow line in FIG. 17B, the first pin 264A is configured to slide in the first groove 222 in one direction, for example, counterclockwise.

Figure 18D:
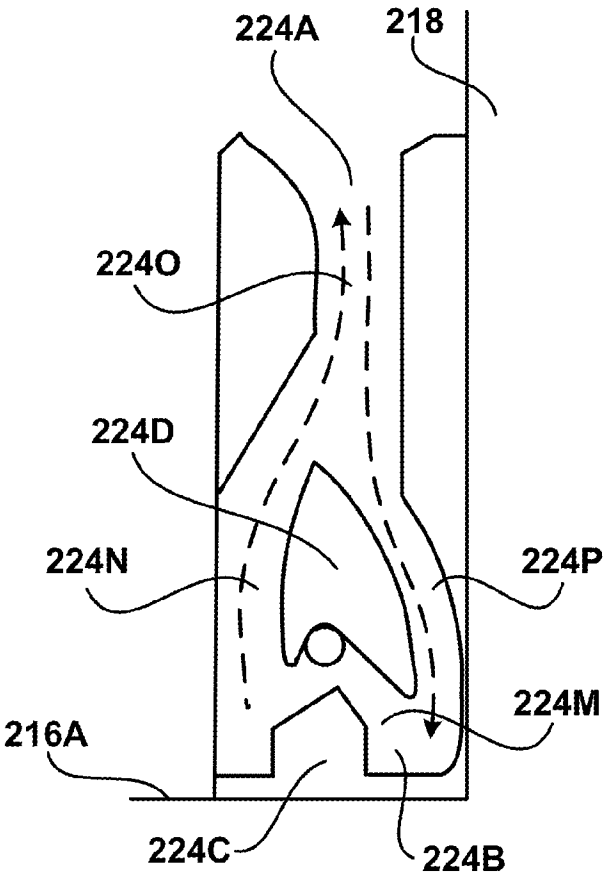
FIGS. 18C-18D are schematically front views of a second groove according to one embodiment of the present invention.
Figure 18C:
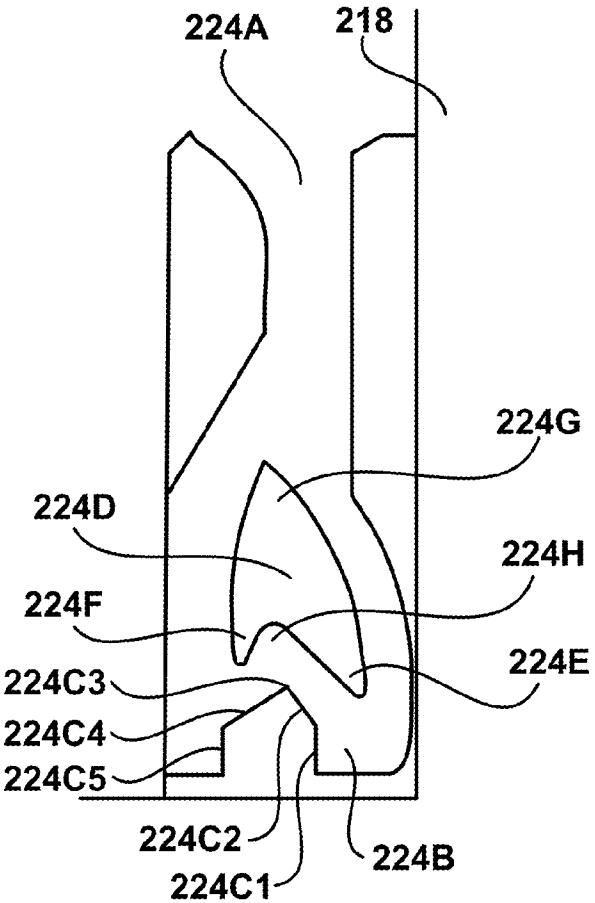

FIG. 18C and FIG. 18D are schematic views of the second side 220B of the plate 220. As shown in FIG. 17C, the second groove 224 is concavely formed on the second side 220B. The second groove 224 has a front end 224A and a rear end 224B. A third protrusion 224C protrudes from the rear end 224B toward the front direction (D1' direction). The third protrusion 224C has an inner straight side 224C1 extending from the rear end 224B forward along the D1' direction, a peak 224C3 at the front-most end, an inner slope 224C2 connecting the inner straight side 224C1 and the peak 224C3, an outer straight side 224C5 extending from the rear end 224B forward along the D1' direction, and an outer slope 224C4 connecting the peak 224C3 and the outer straight side 224C5. The straight side 224C1 is close to the second portion 218, and the outer straight side 224C5 is away from the second portion 218.

A second island 224D is located within the second groove 224. The second island 224D has a fourth large protrusion 224E protruding toward the rear direction, a fourth small protrusion 224F protruding substantially toward the rear/outward direction, and a fourth front protrusion 224G protruding toward the front direction (D1' direction). A second notch 224H is formed between the fourth large protrusion 224E and the fourth small protrusion 224F, and the second notch 224H is located right behind the first notch 222H. The second notch 224H is located at the rear side of the second island 224D. As shown in FIG. 17C, the outer straight side 224C5 of the third protrusion 224C is substantially aligned with the lower end of the outer side of the island 224D, that is, the outer side of the fourth small protrusion 224F. The fourth large protrusion 224E is close to the second portion 218, the fourth small protrusion 224F is away from the second portion 218, and the second notch 224H is located between the fourth large protrusion 224E and the fourth small protrusion 224F. The peak 224C3 may or may not align with the second notch 224H in the D1'/D2' direction. In this embodiment, the peak 224C3 is slightly closer to the second portion 218 than the second notch 224H is. Thus, when the second pin 264B moves from the second notch 224H downward along the D2' direction, the second pin 264B will touch the outer slope 224C4, and move downward and outward along the outer slope 224C4.

The second island 224D and the third protrusion 224C separates the second groove 224 into four sections: a fifth section 224M located at the rear side of the second island 224D that is close to the first portion 216, a sixth section 224N located at one side of the second island 224D that is away from the second portion 218, a seventh section 224O located in the front of the second island 224D, and an eighth section 224P located at the other side of the second island 224D that is close to the second portion 218. The fifth section 222M connects the sixth section 224N and the eighth section 224P from the rear side of the second groove 224, and the seventh section 224O connects the sixth section 224N and the eighth section 224P from the front side of the second groove 224. The width of the seventh section 224O is greater than the width of the third section 222O. After assembly, the second pin 264B of the hook member 260 is inserted into the second groove 224, for example, at the location of the second notch 224H. By the cooperation of the movement of the first pin 264A in the first groove 222 and the movement of the second pin 264B in the second groove 224, the second pin 264B is configured to slide from the fifth section 224M through the sixth section 224N to the seventh section 224O, or from the seventh section 224O through the eighth section 224P to the fifth section 224M. In other words, as shown in the dotted arrow line in FIG. 17D, the second pin 264B is configured to slide in the second groove 224 in one direction, for example, clockwise.

Figure 18E:
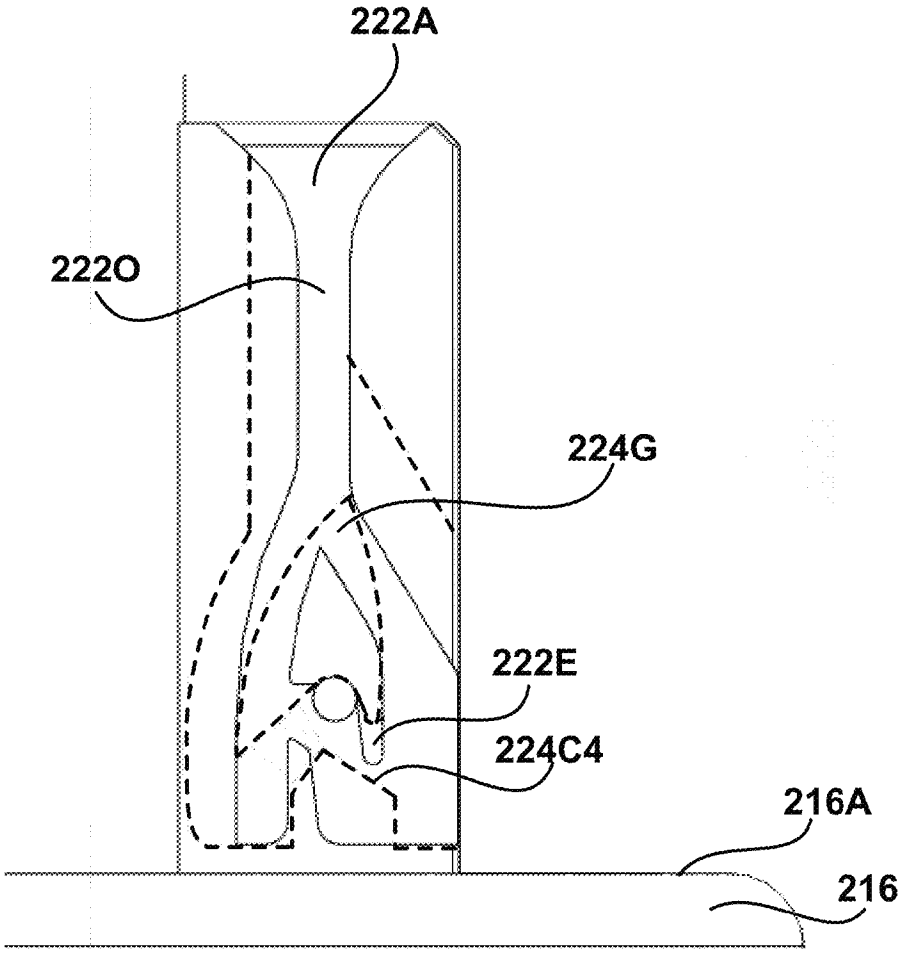
FIG. 18E is schematically front views of the first groove and the second groove of FIGS. 18A-18D.

FIG. 18E is a schematic views of the first groove 222 and the second groove 224. As shown in FIG. 18E the plate 220 has a front side 220A disposing the first groove 222, and a back surface 220B disposing the second groove 224. The second groove 224 is located behind the first groove 222, is shown by dotted lines, and cannot be seen directly from the front view of the plate 220. When the toner supply container is configured to change from the initial state to the work state, the first pin 264A moves from the first notch 222H downward along the D2' direction, and the second pin 264B moves from the second notch 224H downward along the D2' direction. Since the peak 224C3 is located slightly close to the inner side of the toner supply container 200 than the second notch 224H is, the second pin 264B will touch the outer slope 224C4 first and then move downward and outward along the outer slope 224C4. Accordingly, the first pin 264A will follow the lead of the second pin 264B downward along the inner side of the second large protrusion 222E, and show an outward force against the second large protrusion 222E. In this way, the first pin 264A and the second pin 264B can only move in one direction, i.e., the outward direction away from the second portion 218. When the toner supply container is used up and need to be changed from the work state to the close state, the first pin 264A and the second pin 264B respectively move from the first end 222A and 222B downward along the D2' direction. Due to the limitation of the width of the third section 222O of the first groove 222, the first pin 264A moves downward along the third section 222O, and the second pin 264B follows the path of the first pin 264A. Accordingly, the second pin 264B will touch the inner side of the fourth front protrusion 224G, and then move along the inner side of the second island 224 downward. The first pin 264A then follows the lead of the second pin 264B and moves inward and downward. In this way, the first pin 264A and the second pin 264B can only move in one direction, i.e., the inward direction toward the second portion 218.

Referring back to FIGS. 15A-15C, in certain embodiments, there are four grooves 222, 224, 227, and 228 disposed respectively on two plates 220 and 220'. The grooves 222 and 224 are disposed back to back on the plate 220, and the grooves 227 and 228 are disposed back to back on the plate 220'. The groove 222 has the same structure as the groove 228, and the groove 224 has the same structure as the groove 227. The two plates 220 and 220' are symmetrically disposed relative to the axis of the toner supply container 200. When the toner supply container 200 is rotated 180° relative to the axis of the toner supply container 200, the structure of the plates maintain the same. In other words, after rotating 180°, the grooves 222 and 224 respectively overlap the original position of grooves 228 and 227 before the rotation.

Figure 19B:
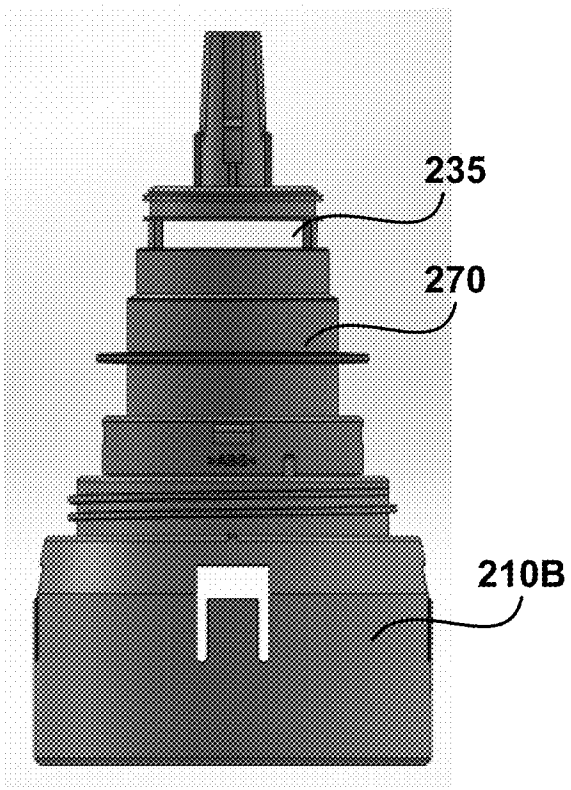
FIGS. 19A and 19B are schematically views of a front member, a releasing member, and a sealing member according to one embodiment of the present invention, where
Figure 19A:
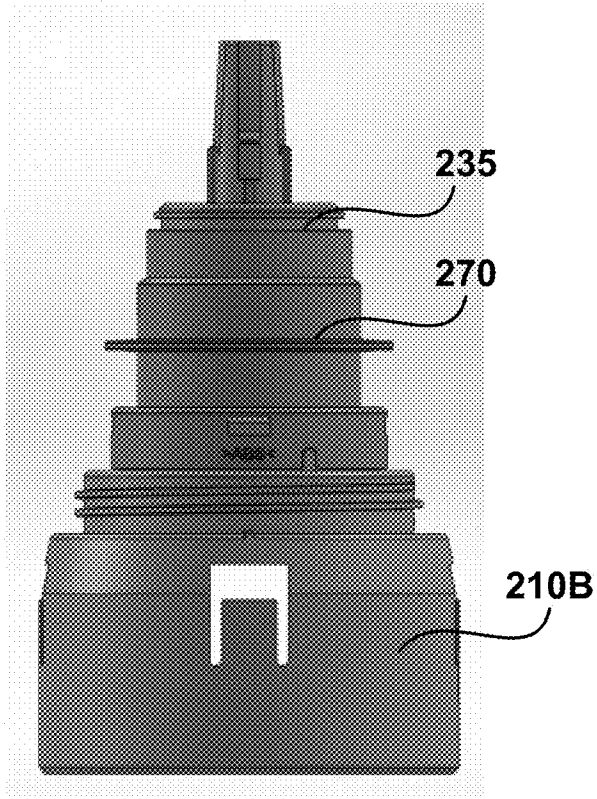

FIGS. 19A and 19B show the initial/close state and work/open state of the toner supply container 200. In the initial or close state, the opening 235 is blocked by the sealing member 270. In the work or open state, the opening 235 is exposed from the sealing member 270 for providing toner from the opening 235 to the apparatus.

FIGS. 20A-39B show different views of the first pin 264A and the second pin 264B in the first groove 222 and the second groove 224 at different status. Of them, the A figures are enlarged view of the structure showing mainly details of part of the releasing member 230, the elastic member 228, the plates 220, 220' having the grooves, and the hook members 260. External force or/and the elastic force of the elastic member 228 are indicated by solid arrow lines. The B figures are enlarged views of the plate 220, showing the movement of the first pin 264A and the second pin 264B respectively in the first groove 222 and the second groove 224. The B figures are views from the front side of the plate 220. Thus, the first pin 264A and the first groove 222 can be seen directly and are shown in solid lines, and the second pin 264B and the second groove 224 cannot be seen directly and are shown in dotted lines.

Figure 20B:
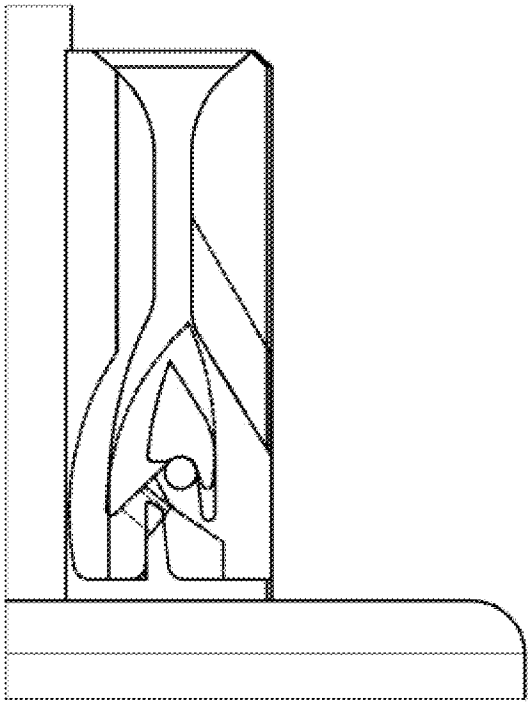
FIGS. 20A, 20B, 21A, 21B, 22A, 22B, 23A, 23B, 24A, 24B, 25A, 25B, 26A, 26B, 27A, 27B, 28A, 28B, and 29A-29D are schematically partial views of the toner supply container, where the status of the toner supply container is from the initial state to the work state, according to one embodiment of the present invention.
Figure 20A:
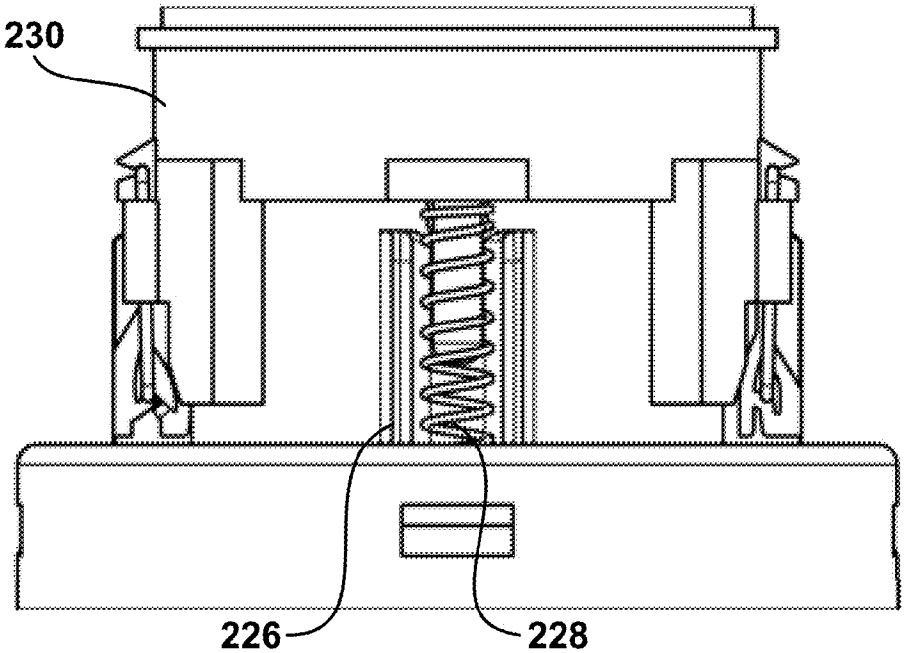

FIGS. 20A and 20B show the initial status of the first pin 264A and the second pin 264B in the first groove 222 and the second groove 224. At this stage, the elastic member 228 is in a relaxed or stretched condition. The first pin 264A is located at the first notch 222H, and the second pin 264B is located at the second notch 224H. The second pin 264B is located right behind the first pin 264A.

Figure 21B:
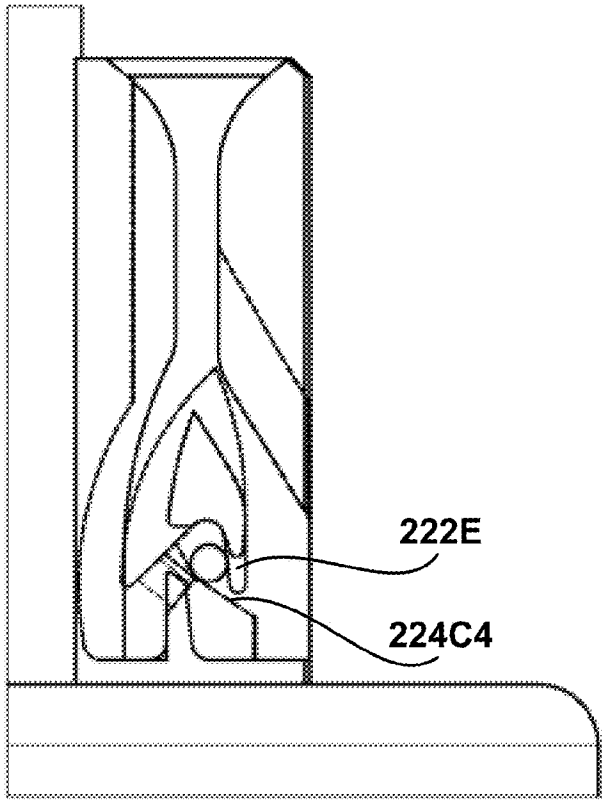
Figure 21A:
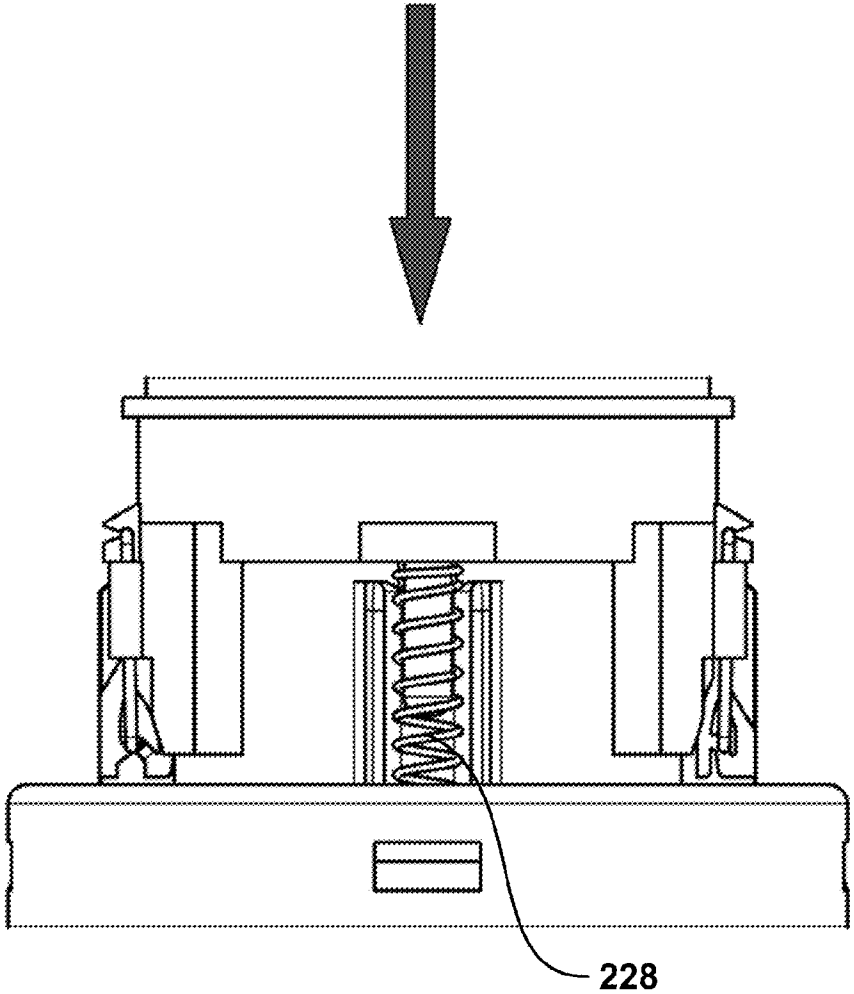

FIGS. 21A and 21B show a pressing force pushes the releasing member 230 downward toward the D2' direction. The first pin 264A and the second pin 264B subsequently are moved downward. The second pin 264B is then in contact with the outer slope 224C4 of the third protrusion 224C, and moves downward/outward along the outer slope 224C4. At the same time, the second pin 264B pushed by the releasing member 230 toward the D2' direction, and pushed by the surface of the outer slope 224C4 outward, also forms elastic force due to the slight deformation of the hook member 260. In the meanwhile, due to the different shapes of the first protrusion 222C and the third protrusion 224C, the first pin 264A is not in contact with the first protrusion 222C. Due to the limitation of the second large protrusion 222E and the linked move with the first pin 264B, the first pin 264A moves downward toward the D2' direction along the inner side of the second large protrusion 222E.

Figure 22B:
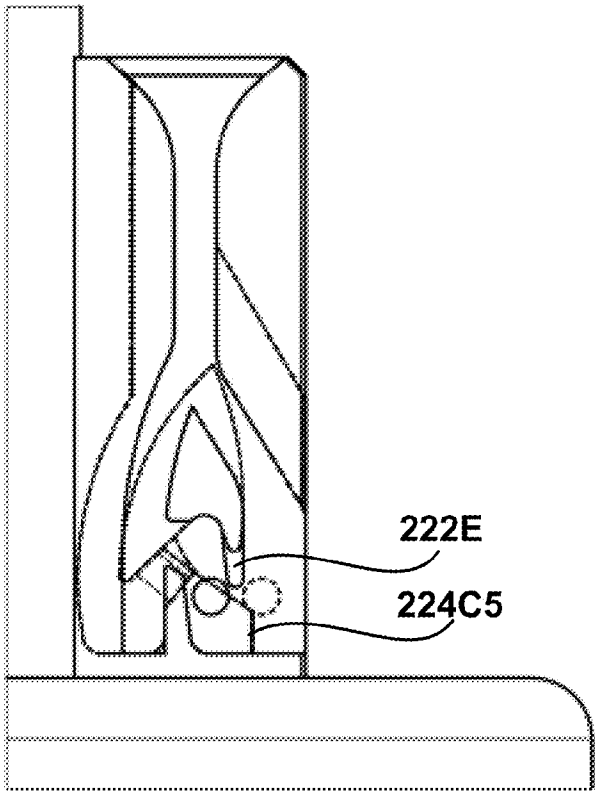
Figure 22A:
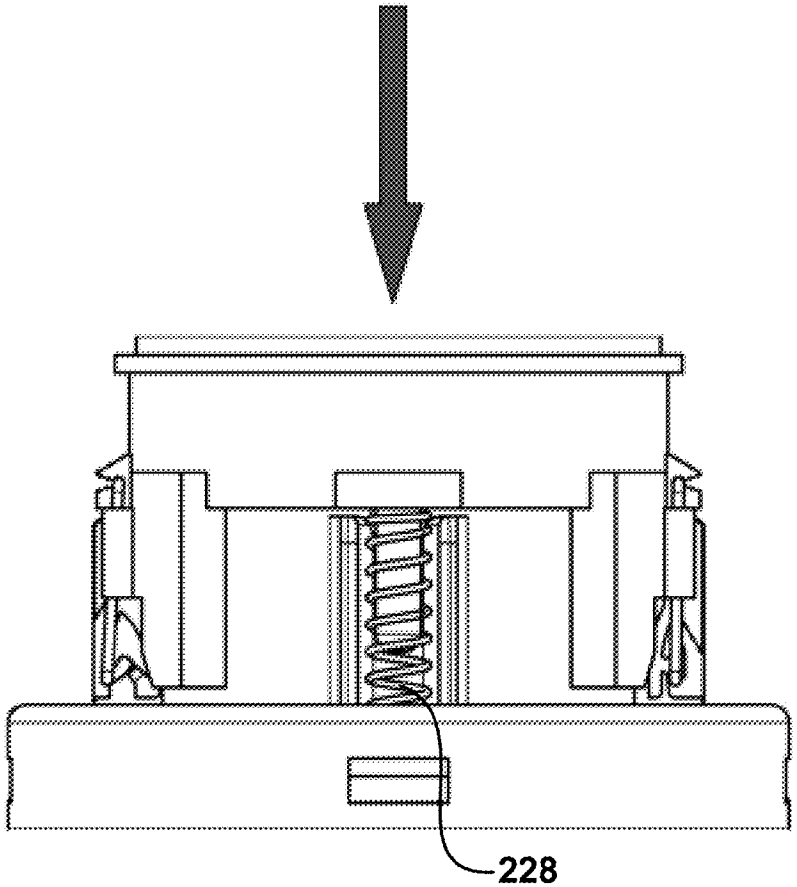

FIGS. 22A and 22B show that the releasing member 230 continues to push downward the hook member 260. As shown in FIG. 21B, the first pin 264A moves downward to the peak of the second large protrusion 222E, and the second pin 264B moves downward along the outer slope 224C4 till the end of the slope and then moves downward along the outer straight side 224C5. At this stage, the hook member 260 has elastic deformation, and the first pin 264A does not overlap with the second pin 264B when view from the front of the plate 220. The second pin 264B leads the move, and the first pin 264A follows.

Figure 23B:
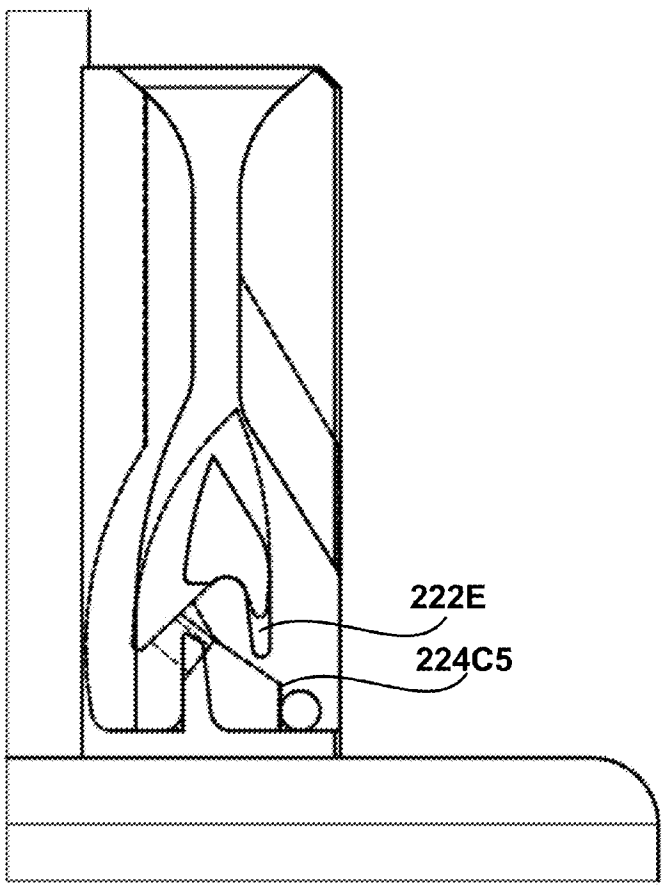
Figure 23A:
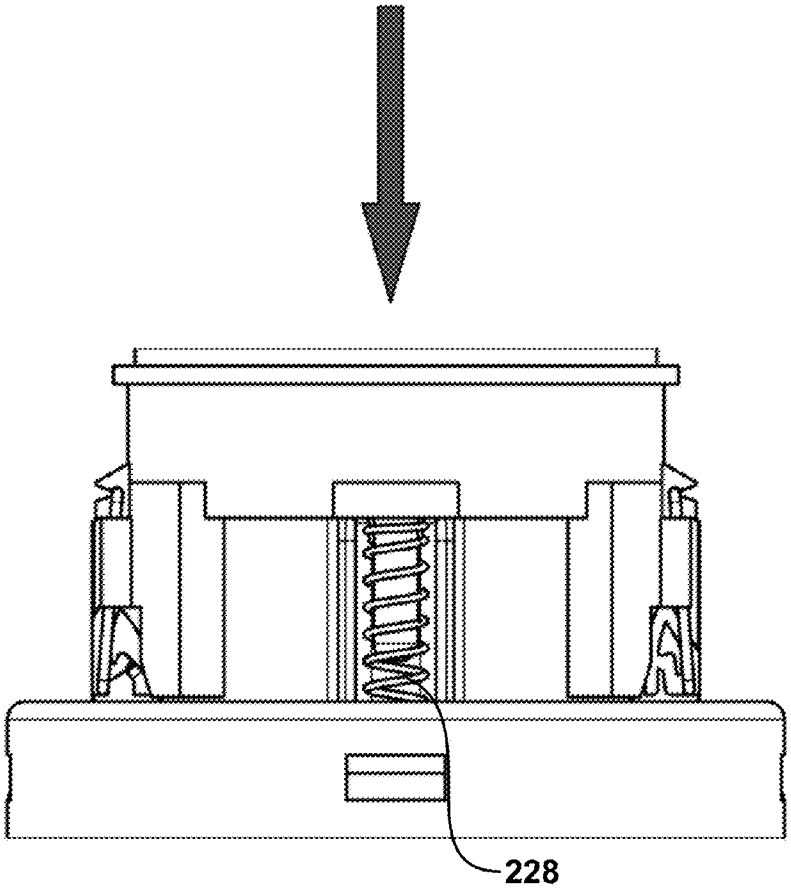

As shown in FIGS. 23A and 23B, with further push by the releasing member 230, the first pin 264A is released from the peak of the second large protrusion 222E and thus moves outward and downward due to the elastic stress of the hook member 260, and the second pin 264B moves out of the outer slope 224C4 and then moves downward along the outer straight side 224C5. Due to the release of the elastic stress of the hook member 260, the first pin 264A moves outward and downward toward the position of the second pin 264B. The first pin 264A and the second pin 264B respectively move to the second end 222B of the first groove 222 and the second end 224B of the second groove 224, and the first pin 264A overlaps with the second pin 264B. That is, in the view of FIG. 22B, the second pin 264B is located right behind the first pin 264A. The elastic member 228 is in a compressed condition by the pressing force show by the arrow line.

Figure 24B:
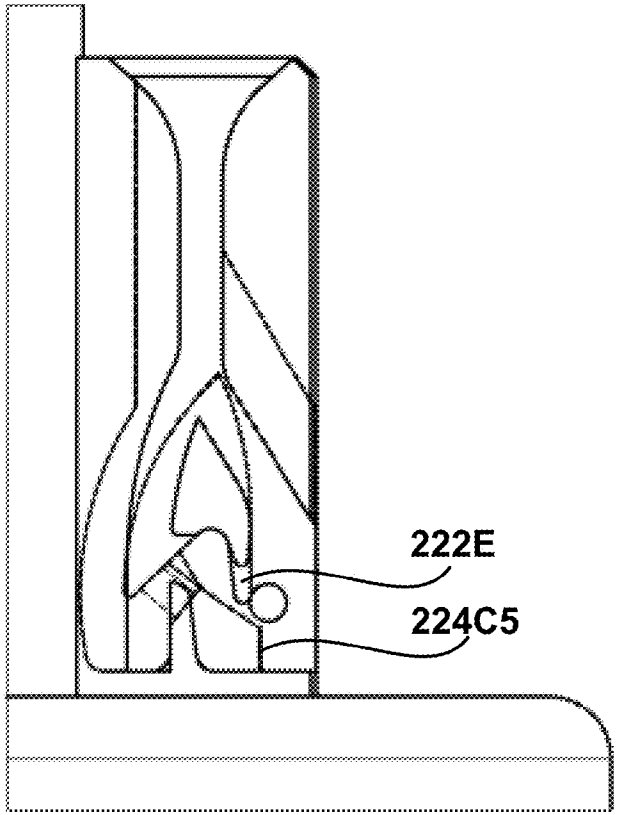
Figure 24A:
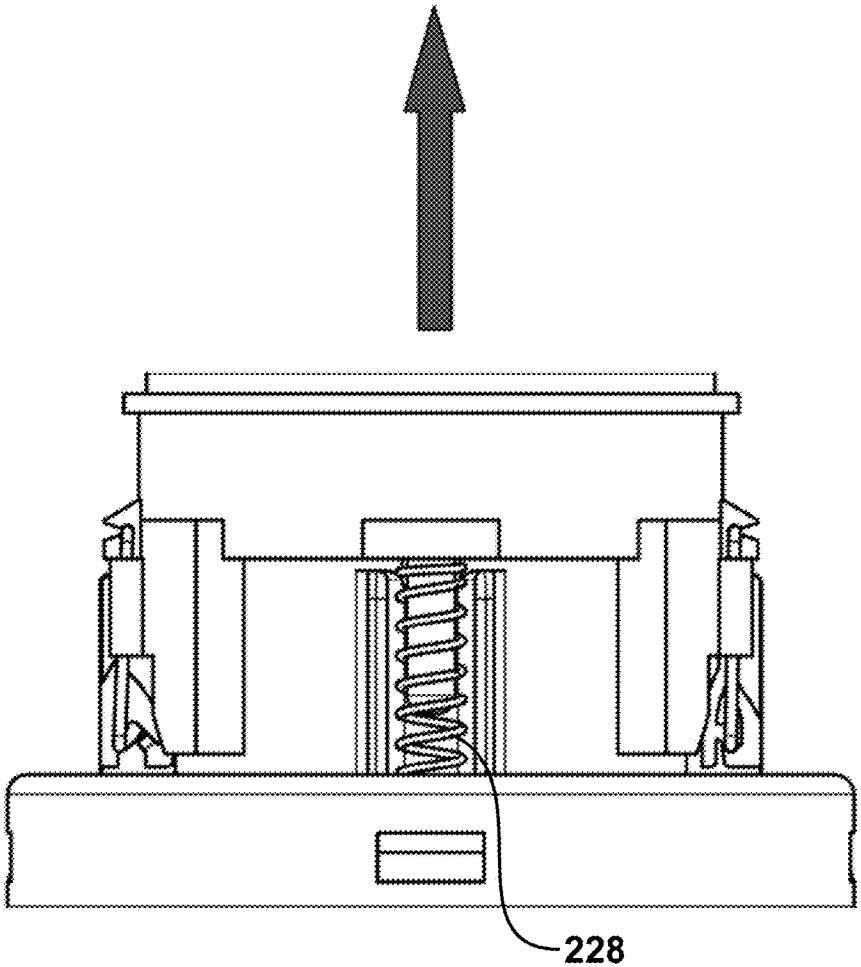
Figure 25B:
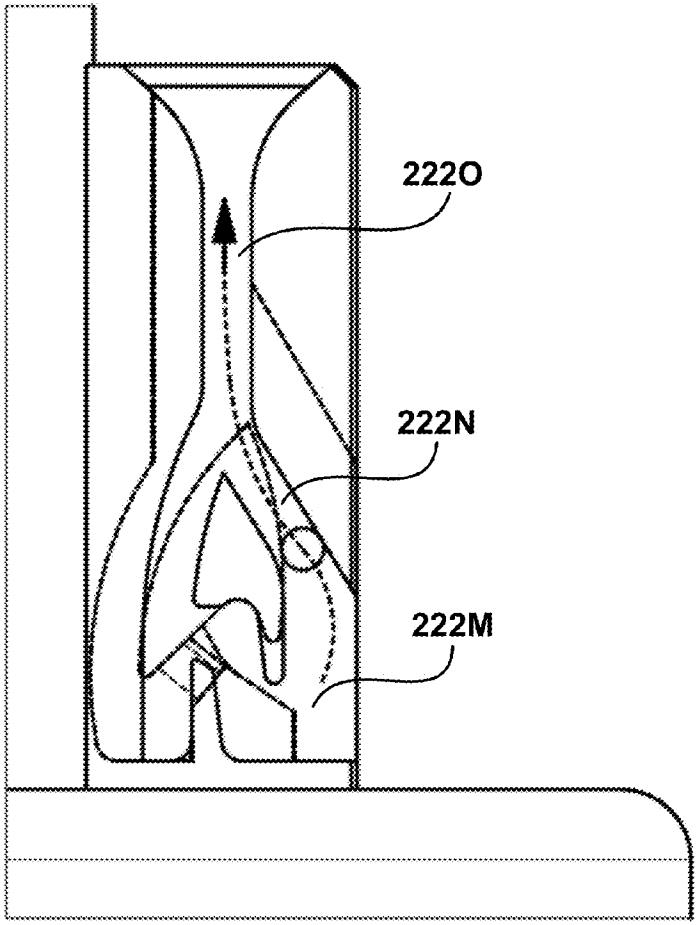
Figure 25A:
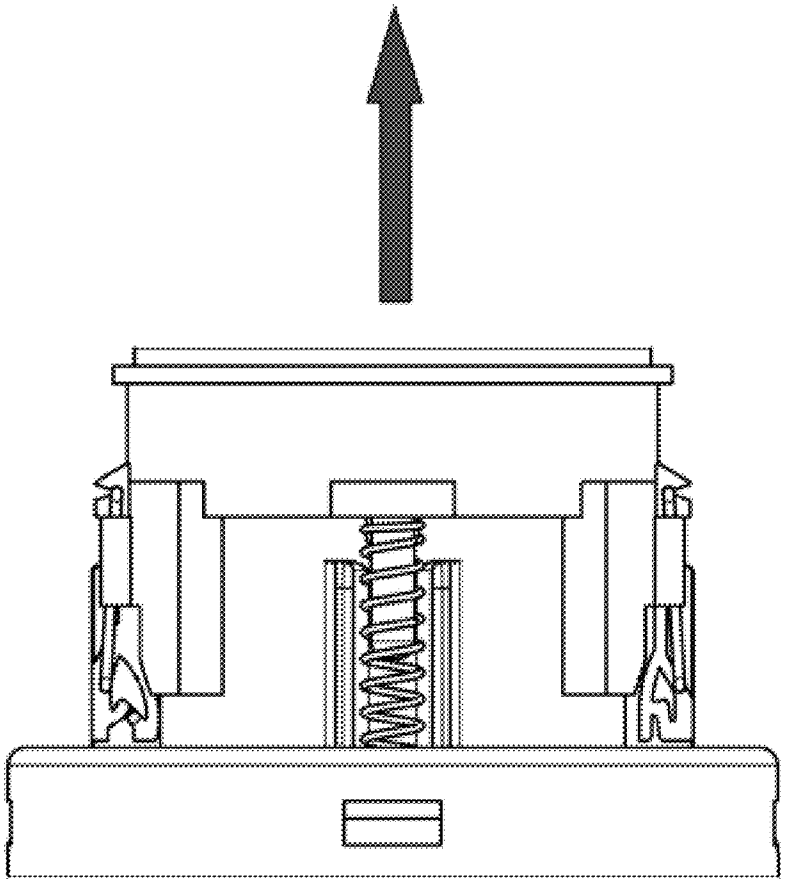
Figure 26B:
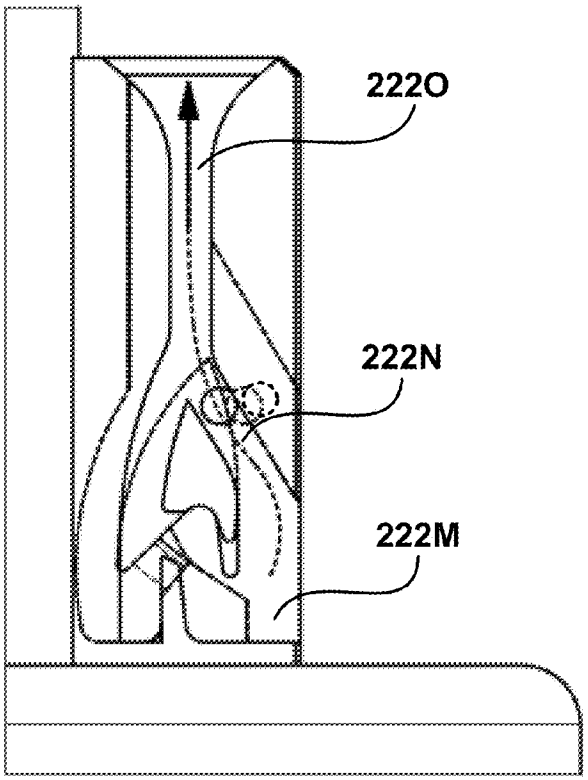
Figure 26A:
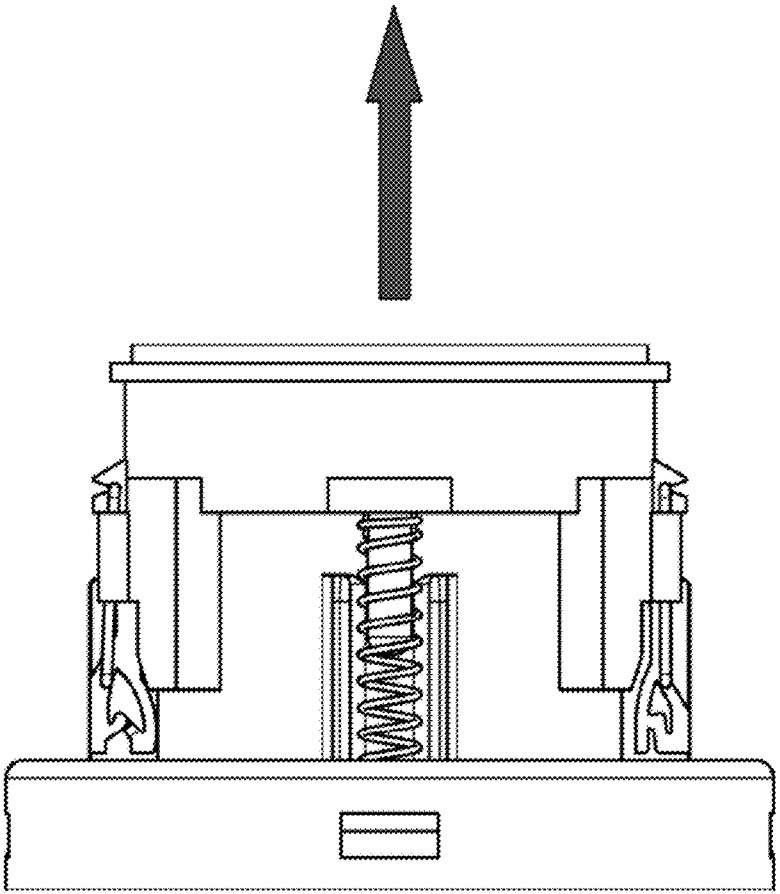
Figure 27B:
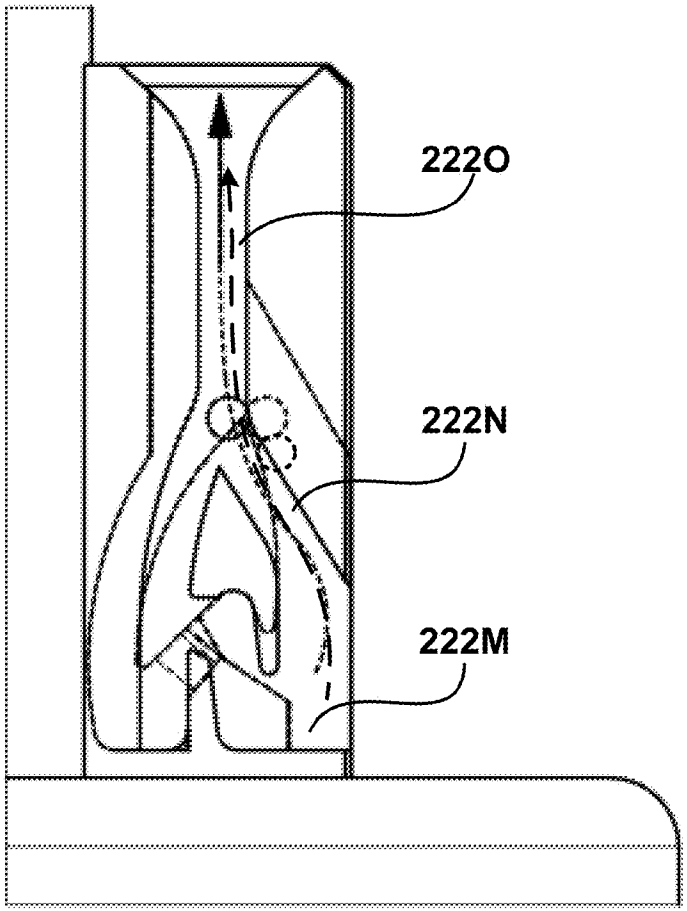
Figure 27A:
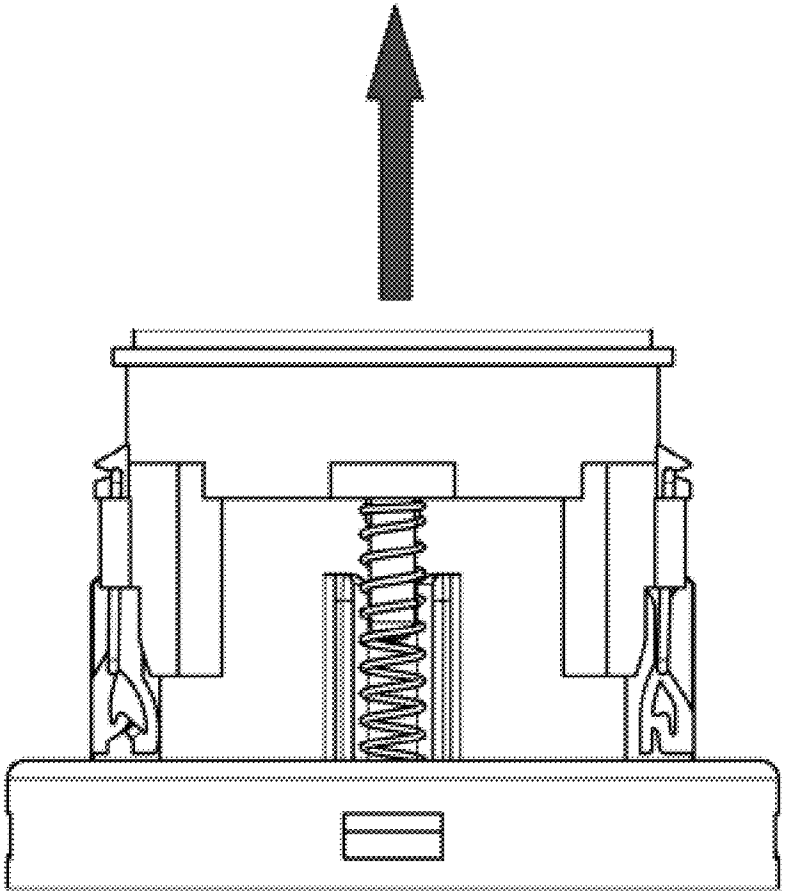
Figure 28B:
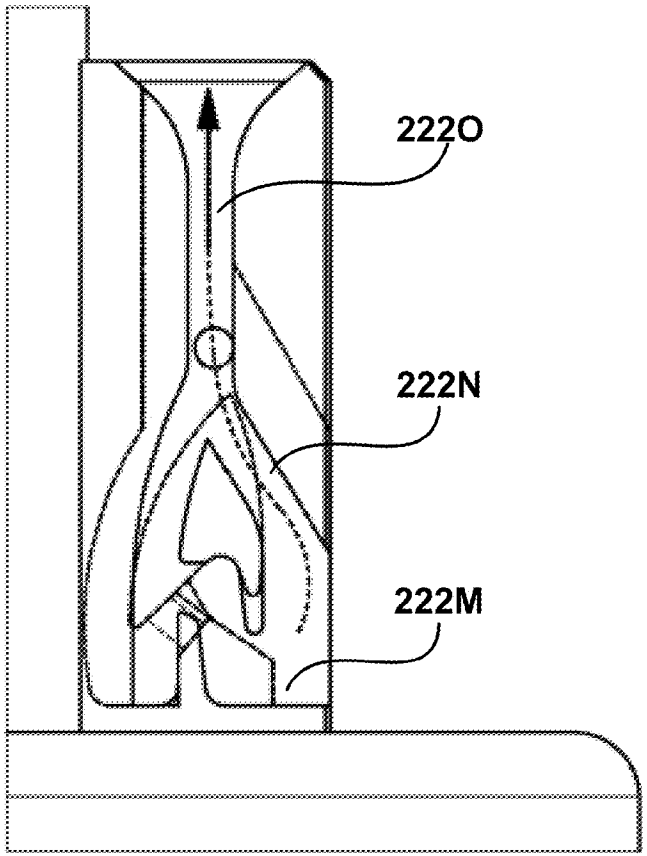
Figure 28A:
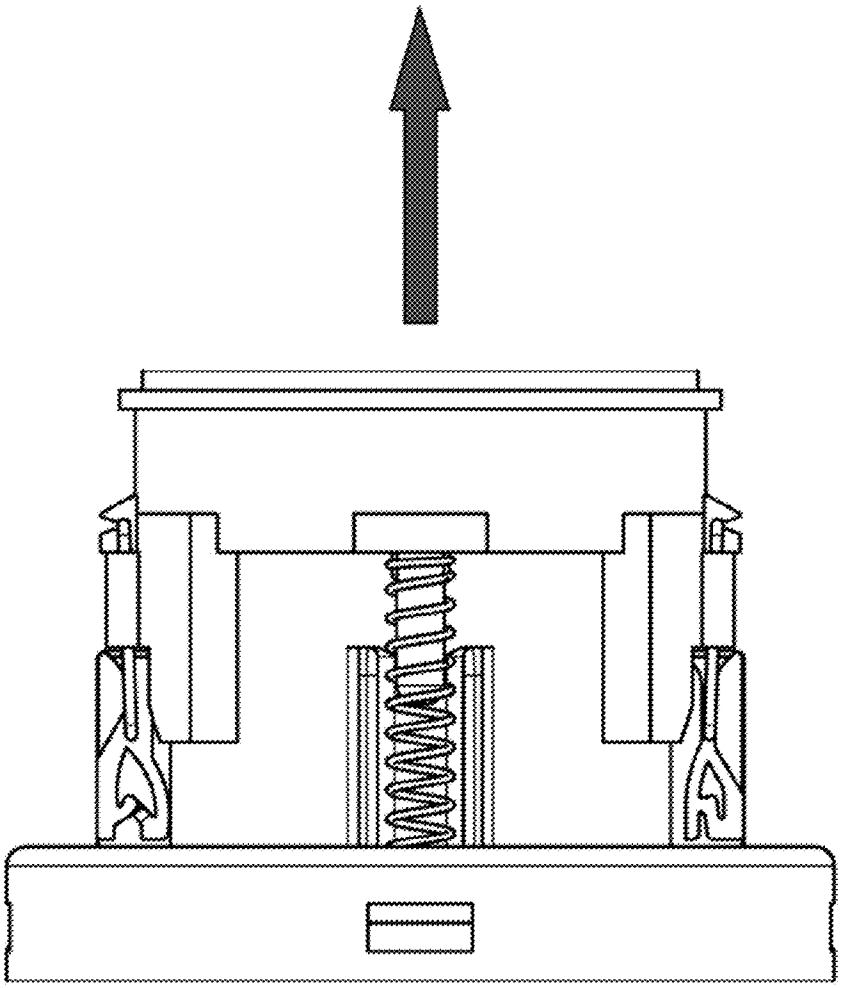

As shown in FIGS. 24A and 24B, the pressing force on the releasing member 230 is removed. At this time, the elastic force of the elastic member 228 then pushes the releasing member 230 upward along the D1' direction, which in turn moves the hook member 260 upward. At this time, the first pin 264A and the second pin 264B move with the hook member 260 upward, and the first pin 264A and the second pin 264B overlap with each other. In certain embodiments, the second pin 264B moves upward along the outer straight side 224C5 of the third protrusion 224C, and then may prone to move leftward along the outer slope 224C4 of the third protrusion 224C. However, since the first pin 264A is blocked by the second large protrusion 222E from moving leftward (i.e., prevented from moving inward toward the second portion 218), the second pin 264B then moves with the first pin 264A upward instead of leftward.

FIGS. 25A-28B shows the movement of the first pin 264A from the first section 222M through the second section 222N to the third section 222O, and the movement of the second pin 264B from the fifth section 224M through the sixth section 224N to the seventh section 224O.

Figure 29B:
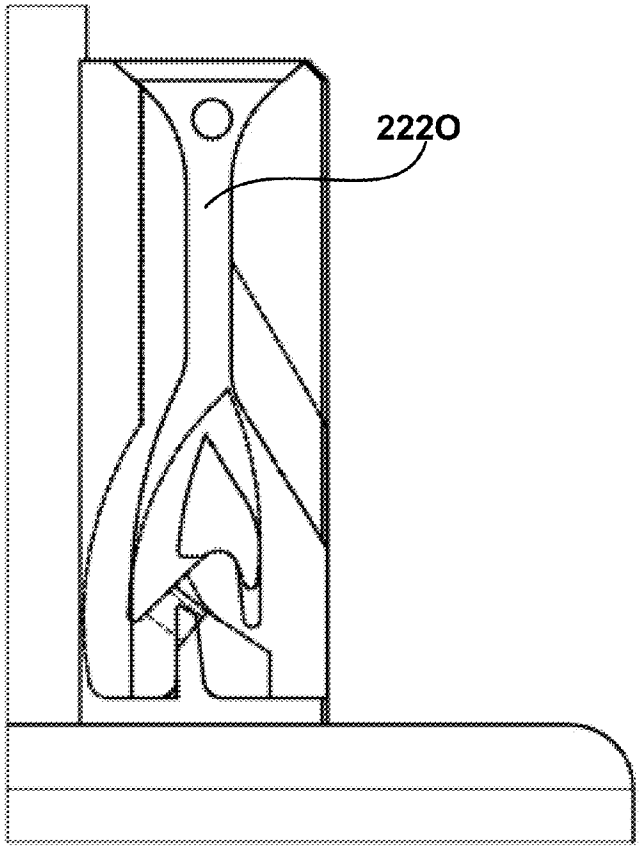
Figure 29A:
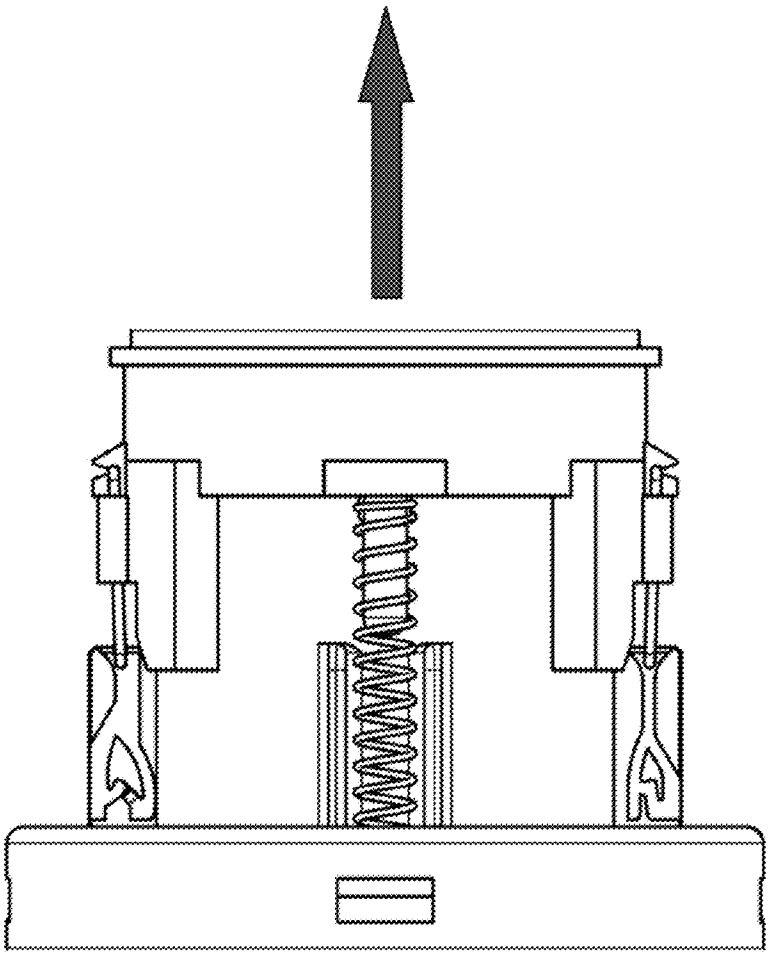
Figure 29D:
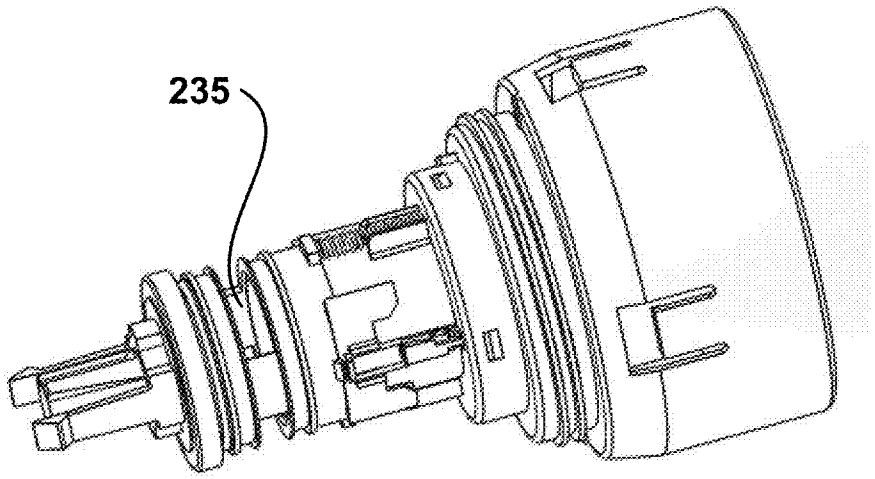
Figure 29C:
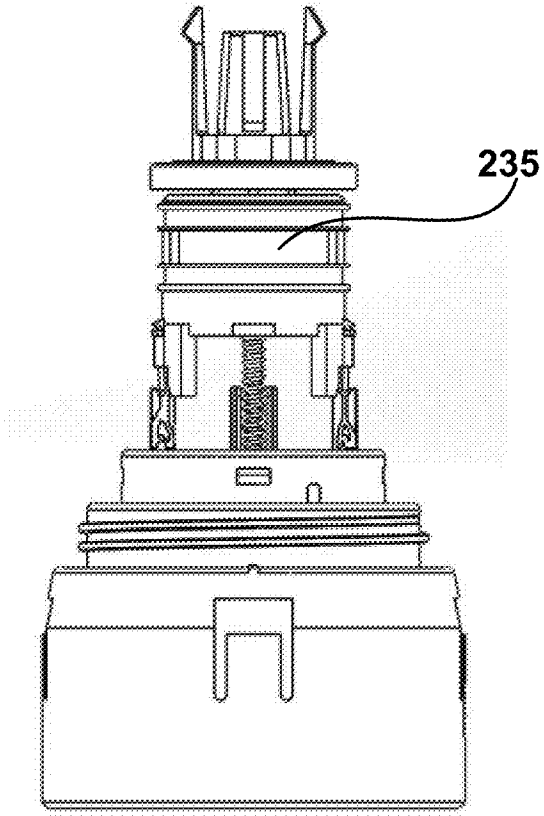

As shown in FIGS. 29A and 29B, with the elastic force of the elastic member 228 along the D1' direction, the first pin 264A slides from the first section 222M through the second section 222N, and arrive the third section 222O, and the second pin 264B slides from the fifth section 224M through the sixth section 224N, and arrive the seventh section 224O. As shown in FIGS. 29C and 29D, the elastic member 228 reach its highest point, the releasing member 230 also reaches its highest point, and thus the opening 235 is exposed from the sealing member 270. At this time, the toner supply container 200 is in the work state, or the open state for releasing toner, and toner is supplied from the exposed opening 235 to the apparatus.

After the toner of the toner supply container 200 is used up, in order to replace it with a new toner supply container, the toner supply container 200 needs to be removed from the apparatus.

Figure 30B:
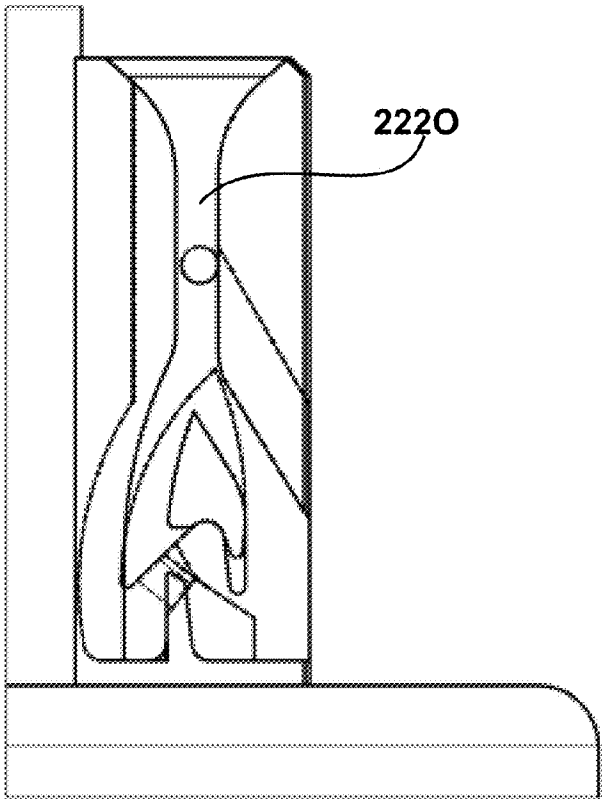
FIGS. 30A, 30B, 31A, 31B, 32A, 32B, 33A, 33B, 34A, 34B, 35A, 35B, 36A, 36B, 37A, 37B, 38A, 38B, 39A and 39B are schematic partial views of the toner supply container, where the status of the toner supply container is from the work state to the close state, according to one embodiment of the present invention.
Figure 30A:
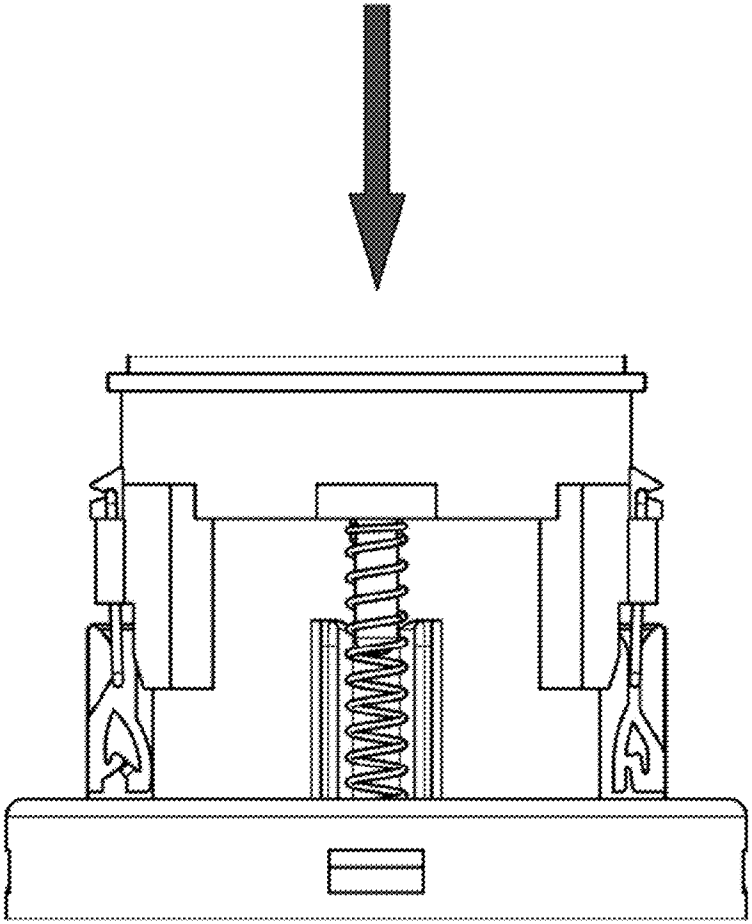

As shown in FIGS. 30A and 30B, in order to remove the toner supply container 200, the pressing force is applied again to push the engaging member 250, and in turn to push the releasing member 230 downward, along the D2' direction. The third section 222O is narrower than the seventh section 224O. The first pin 264A is confined by the narrow width of the third section 222O of the first groove 222. The move of the second pin 264B is limited by the move of the first pin 264A, and the second pin 264B follows the lead of the first pin 264A.

Figure 31B:
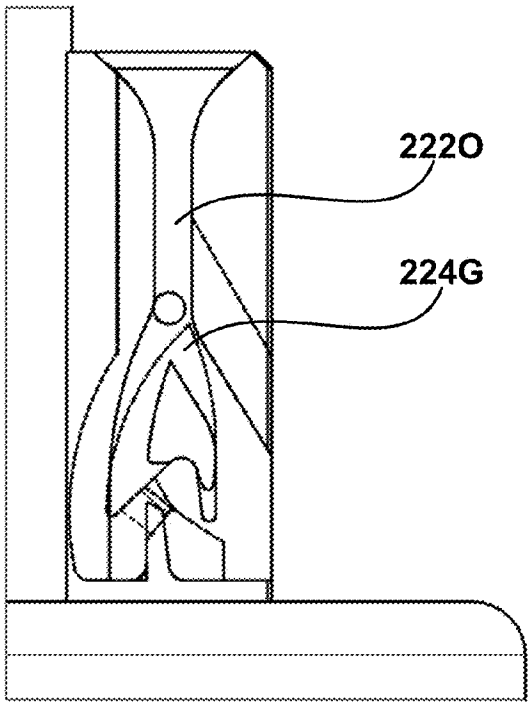
Figure 31A:
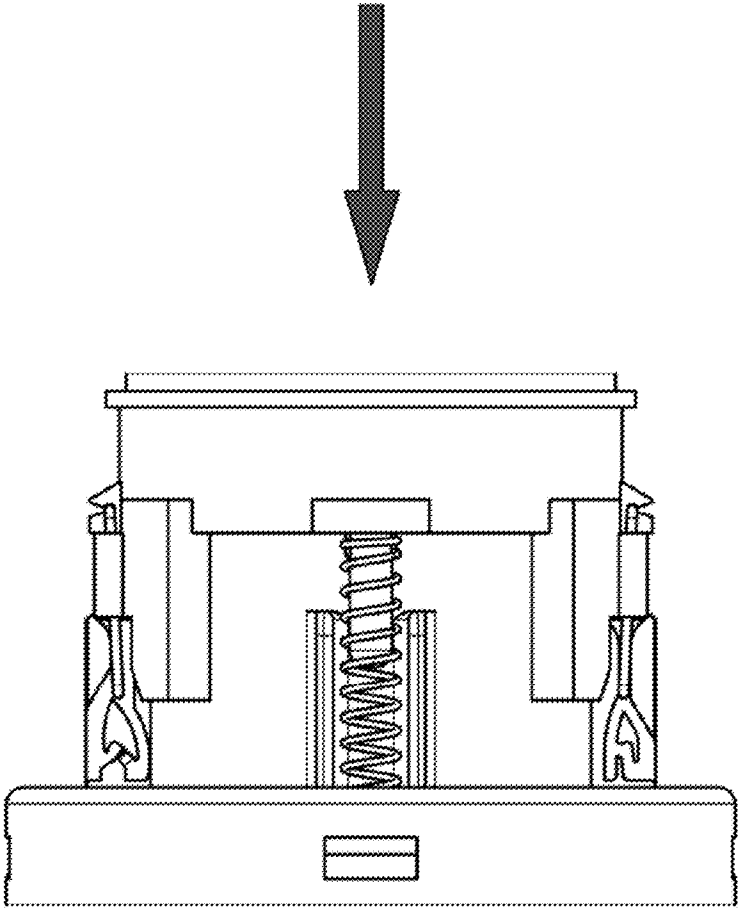

Then as shown in FIGS. 31A and 31B, the first pin 264A and the second pin 264B continues moving downward respectively. At this time, due to the position design of the third section 220 and the fourth front protrusion 224G, the second pin 264B is first in contact with the inner side of the second island 224D, while there is still a distance between the first pin 264A and the first island 222D. The second pin 264B thus can only move inward along the inner side of the second island 224D.

Figure 32B:
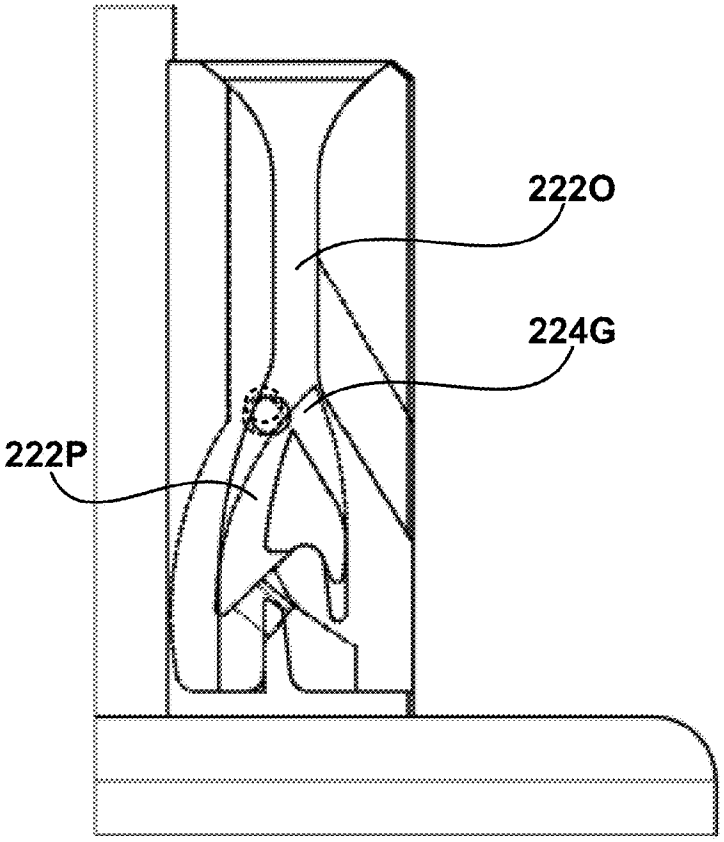
Figure 32A:
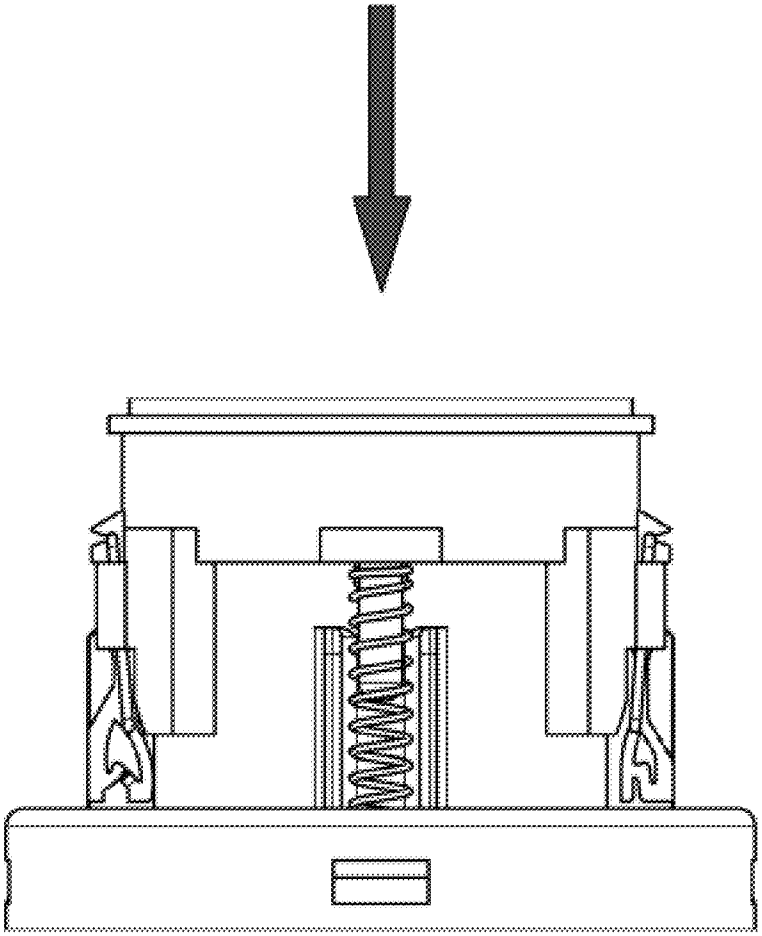

As shown in FIGS. 32A and 32B, in addition to being pushed downward, the second pin 264B is also pushed by the second island 224D inward toward the second portion 218. Thus, in addition to being pushed downward, the first pin 264A also moves inward toward the second position 218 due to its cooperation with the second pin 264B, to ensure that the first pin 264A moves toward the fourth section 222P, not toward the second section 222N. Since the second pin 264B is driven by the second island 224D, and the first pin 264A is driven inward (leftward) by the elastic force formed by the hook member 260, the first pin 264A and the second pin 264B do not overlap anymore. Instead, the second pin 264B leads the moving inward/downward, and the first pin 264A moves inward/downward following the second pin 264B, and has a small lag after the second pin 264B.

Figure 33B:
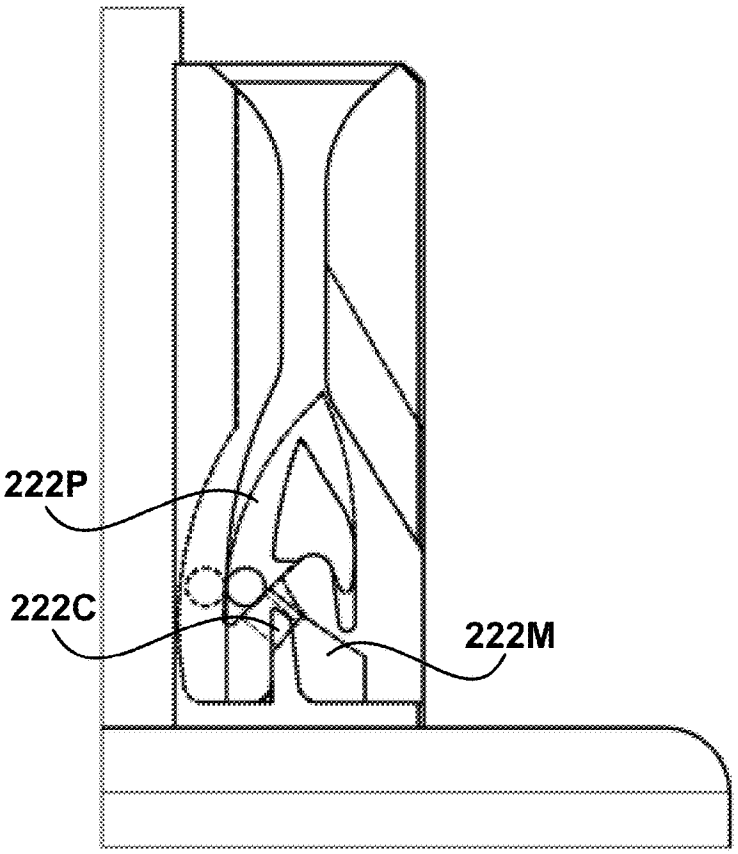
Figure 33A:
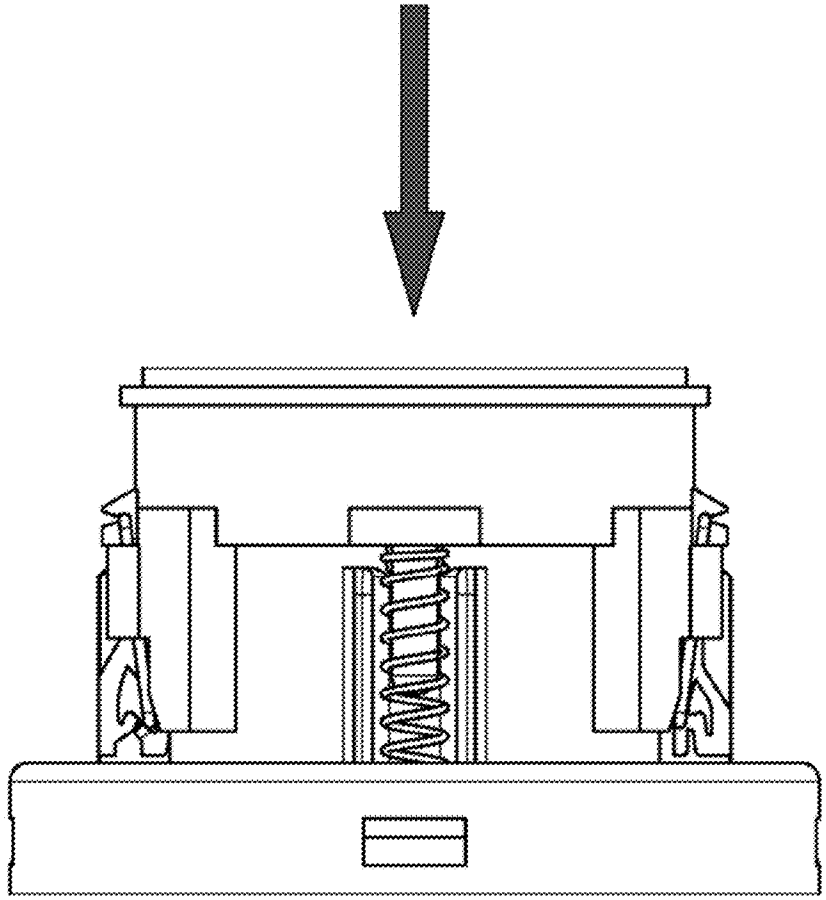

As shown in FIGS. 33A and 33B, the first pin 246A continues to move downward in the D2' direction along the fourth section 222P; and the second pin 246B continues to move downward in the D2' direction along the eighth section 224P. The second pin 264B moves along the side of the second island 224D.

Figure 34B:
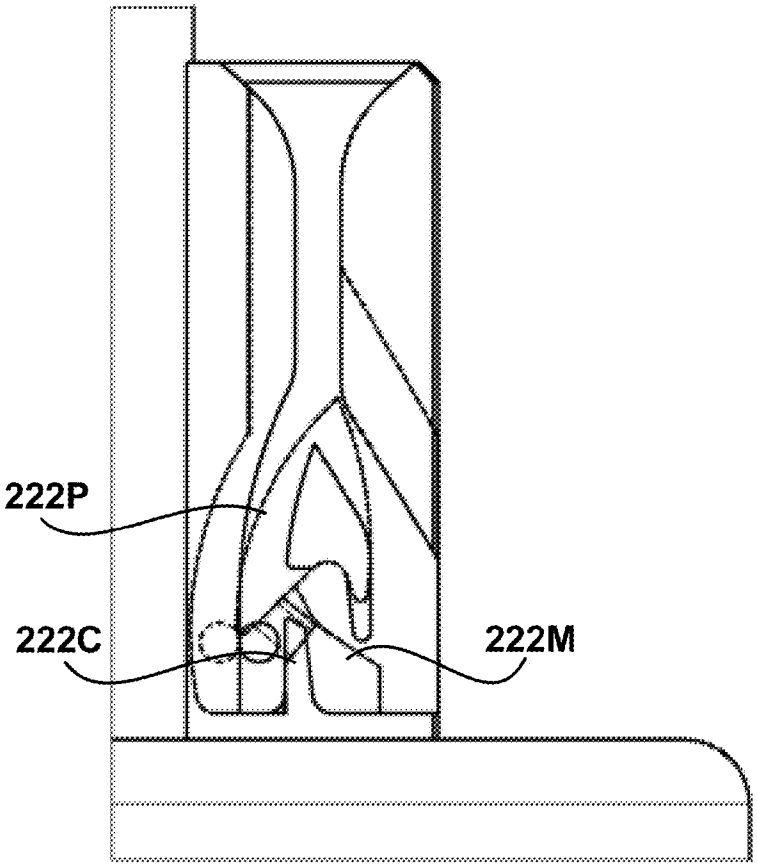
Figure 34A:
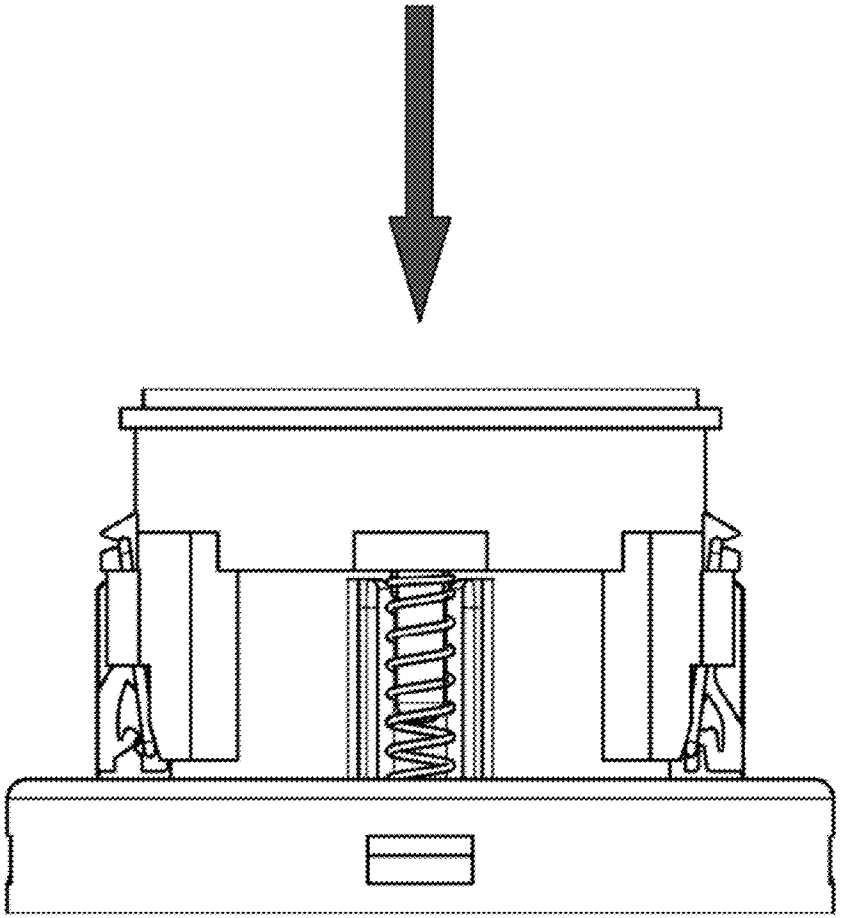

As shown in FIGS. 34A and 34B, the releasing member 230 is pushed downward further along the D2' direction. Once the second pin 264B moves downward to pass the fourth large protrusion 224E, the second pin 264B prone to move outward to correspond to the position of the first pin 264A. The first pin 264A is prevented from moving outward by the first protrusion 222C and prevented from moving inward by the inner side of the fourth section 222P, and thus only moves downward in the fourth section 222P. Since the first pin 264A and the second pin 264B are linked, the second pin 264B also moves downward to overlap with the first pin 264A.

Figure 35B:
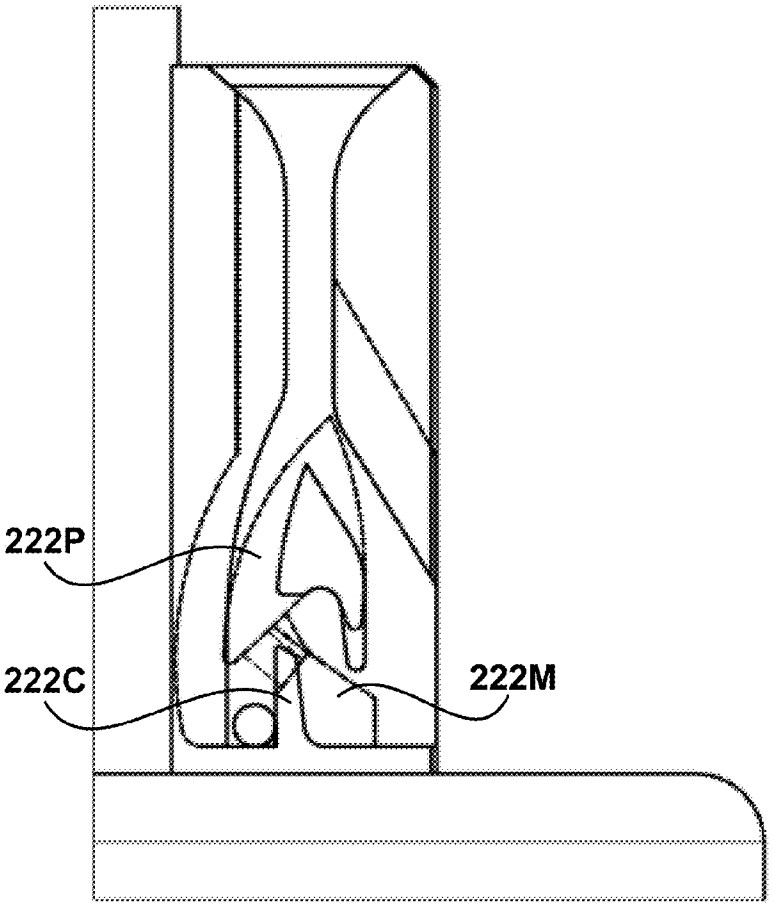
Figure 35A:
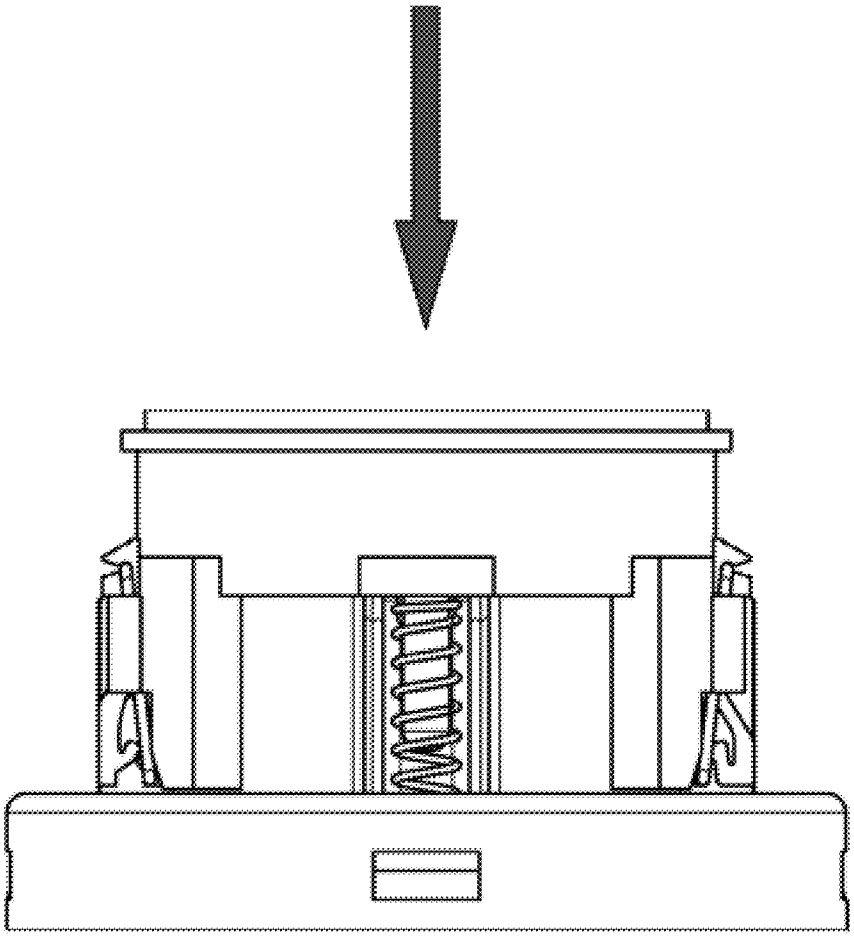

As a result, the first pin 264A and the second pin keep moving downward, and as shown in FIGS. 35A and 35B, the first pin 264A and the second pin 264B respectively move to the second end 222B of the first groove 222 and the second end 224B of the second groove 224, and the first pin 264A overlaps with the second pin 264B when viewing from the front of the plate 220. In other words, the second pin 264B is located right behind the first pin 264A.

Figure 36B:
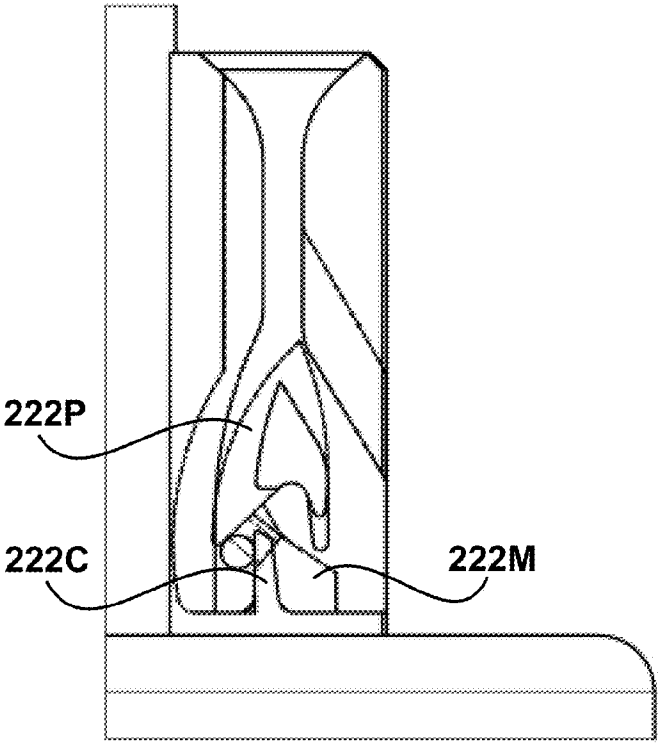
Figure 36A:
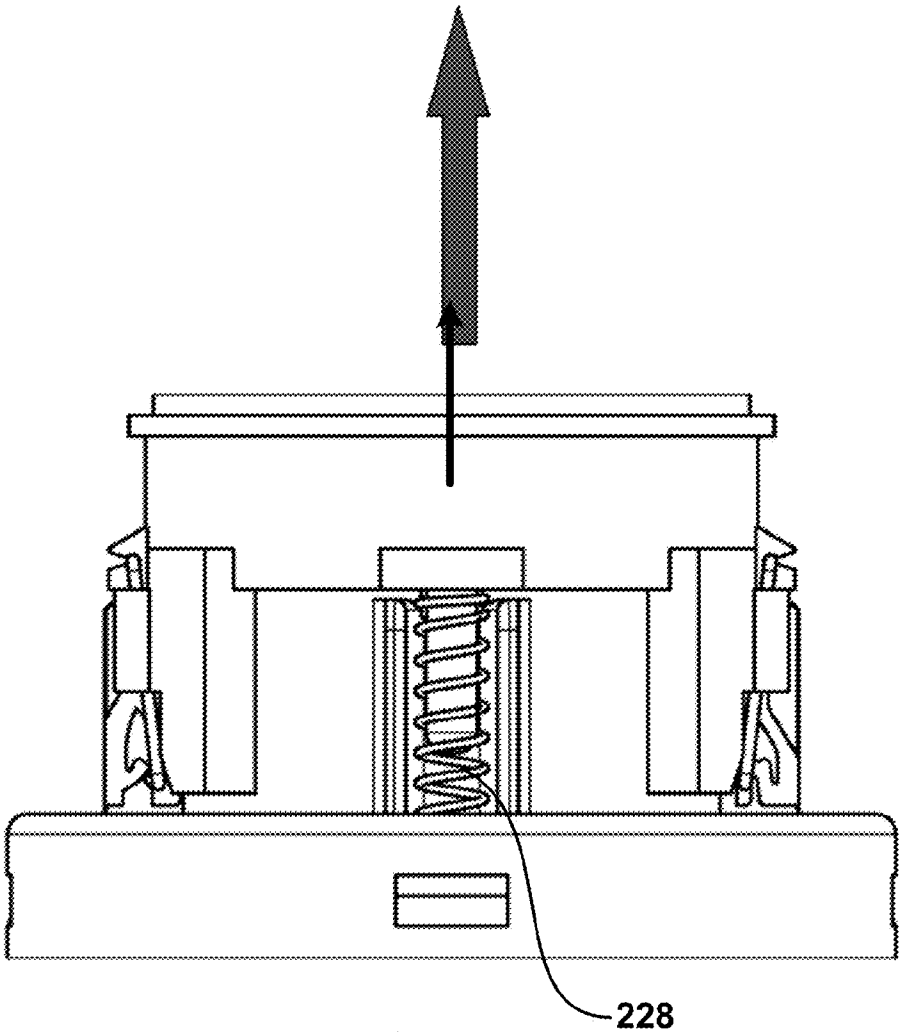

After that, the pressing force to the toner supply container 200 is removed. As shown in FIGS. 36A and 36B, after removing the pressing force, the elastic member 228 pushes the releasing member 230 upward along the D1' direction. The releasing member 230 in turn moves the hook member 260 upward. The first pin 264A moves upward along the inner side of the first protrusion 222C, and the second pin 264B moves upward corresponding to the first pin 264A along the inner side of the inner straight side 224C1. As shown in FIG. 36B, the second pin 264B first touches the fourth large protrusion 224E of the second island 224D.

Figure 37B:
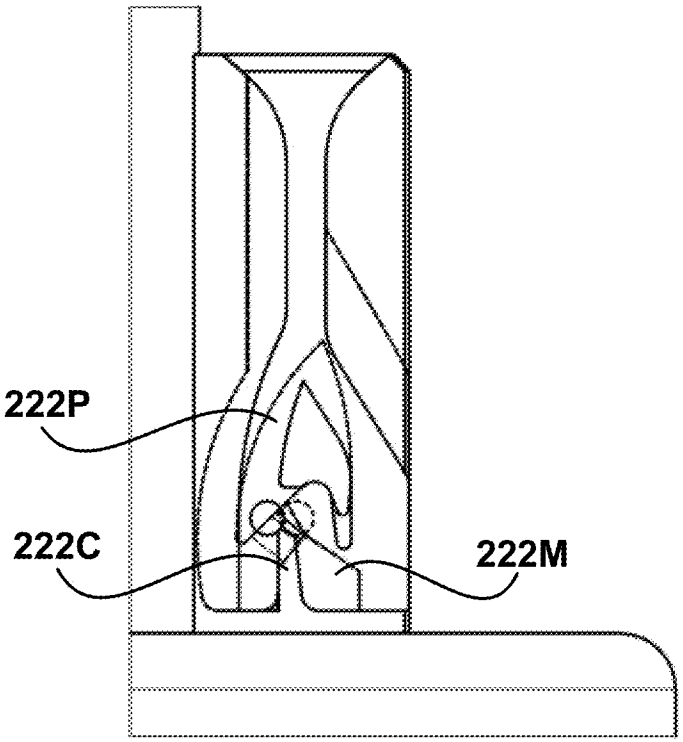
Figure 37A:
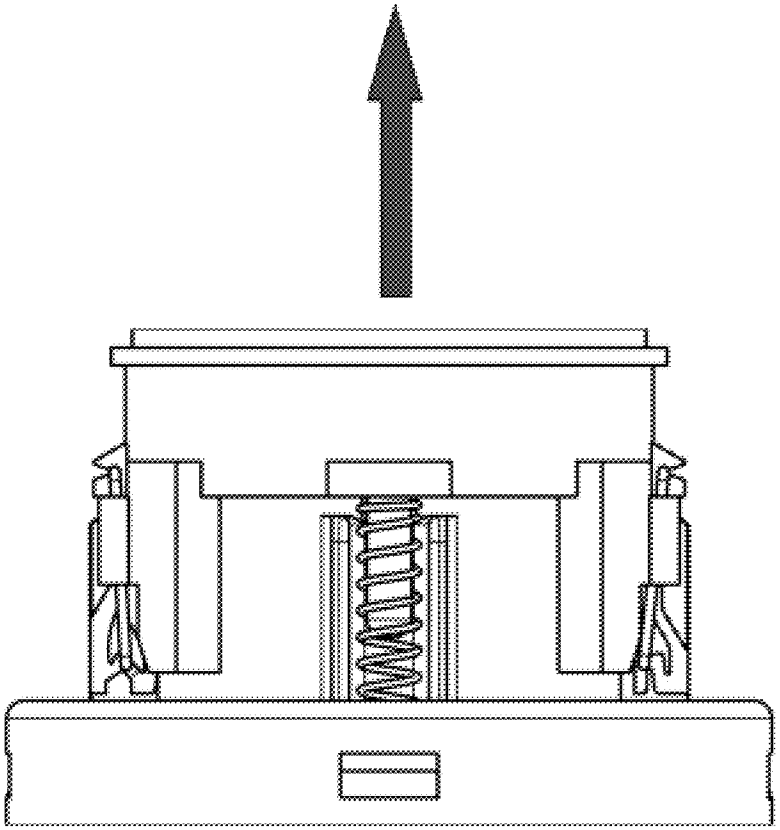

As shown in FIGS. 37A and 37B, the second pin 264B moves upward and outward along the outer side of the fourth large protrusion 224E. At this time, the first pin 264A still moves upward along the inner side of the first protrusion 222C. Due to the limitation of the fourth large protrusion 224E to the second pin 264B and the first protrusion 222C to the first pin 264A, an elastic force is formed on the hook member 260. The second pin 264B leads the move, and the first pin 264A fall behind the second pin 264B.

Figure 38B:
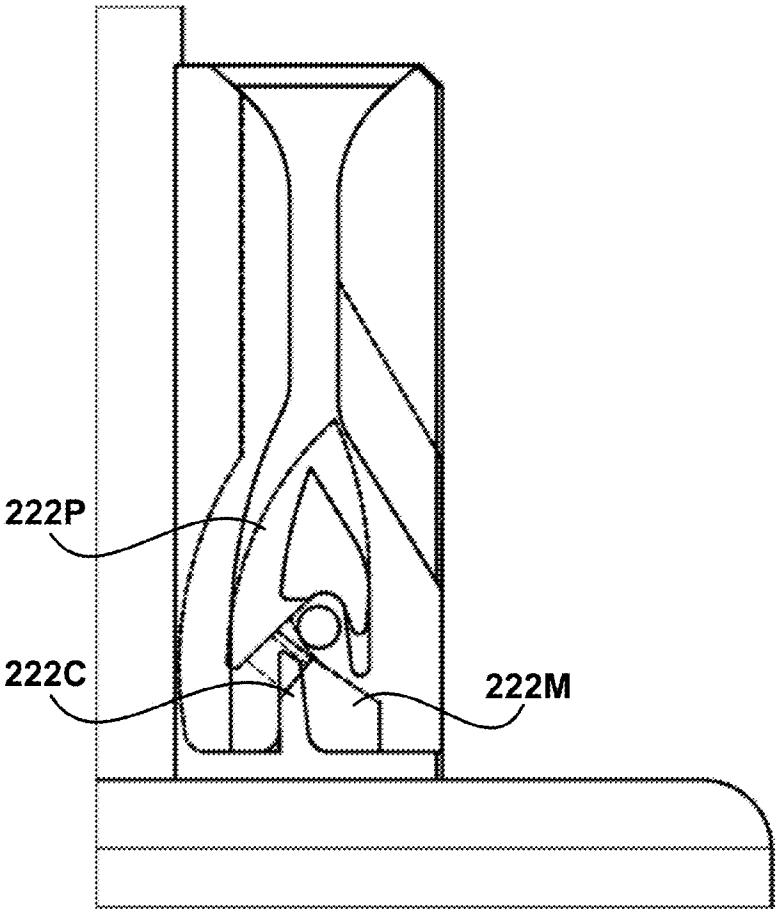
Figure 38A:
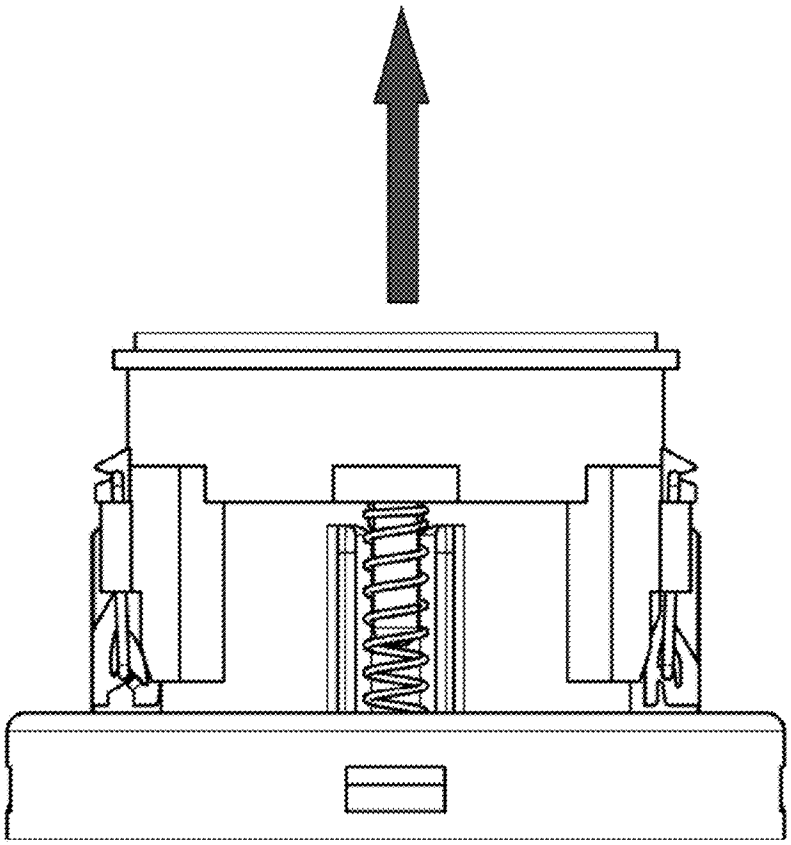

As shown in FIGS. 38A and 38B, the releasing member 230 continues moving upward along the D1' direction. The first pin 264A moves upward along the inner side of the first protrusion 222C, and passes the peak of the first protrusion 222C. Once the first pin 264A passes the peak of the first protrusion 222C, the limitation of the first protrusion 222C to the first pin 264A is removed. The elastic force of the hook member 260 then moves the first pin 264A to a position that overlaps with the position of the second pin 264B when viewing from the front of the plate 220. The second pin 264B moves along the outer side of the fourth large protrusion 224E.

Figure 39B:
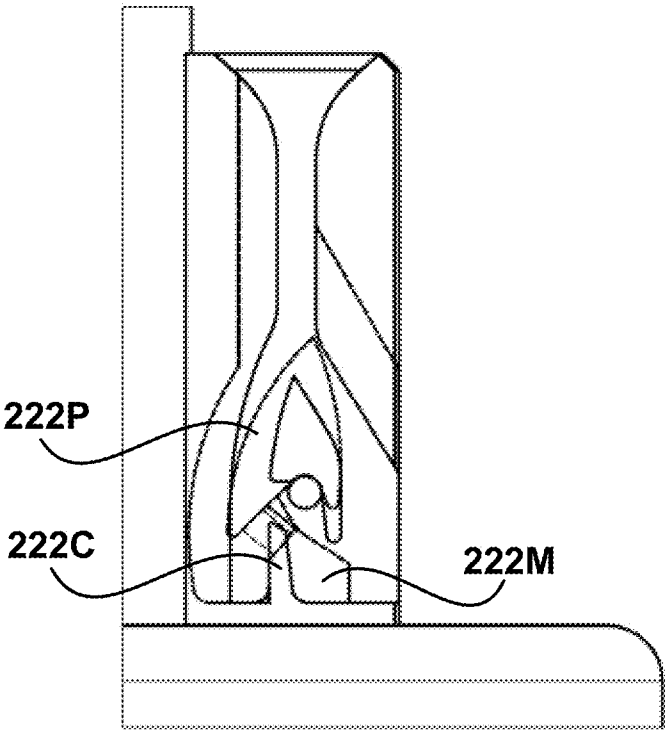
Figure 39A:
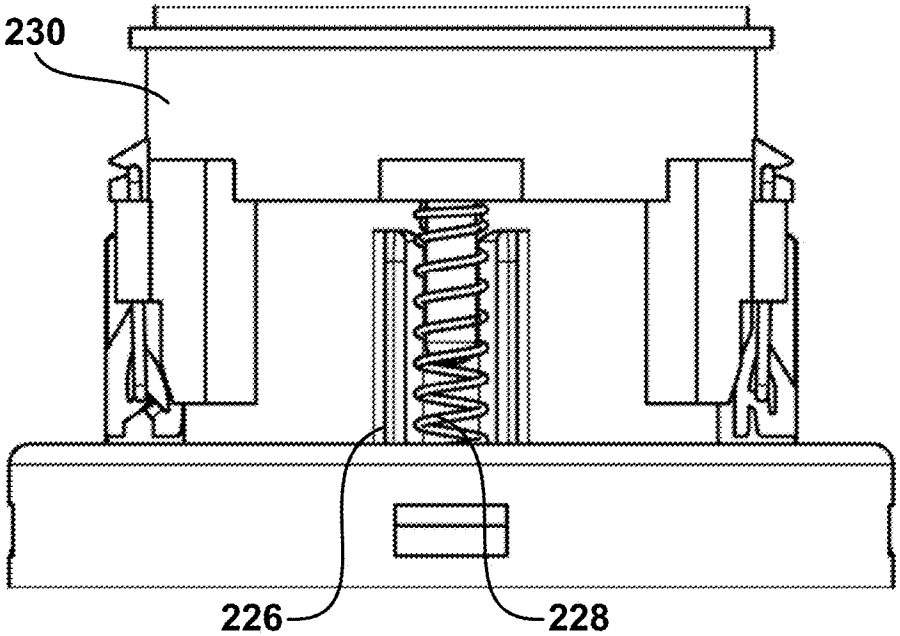

As shown in FIGS. 39A and 39B, the first pin 264A moves to the first notch 222H and stay still at the first notch 222H, and the second pin 264B moves to the second notch 224H and stay still at the second notch 224H. The position of the second notch 224H is right behind the first notch 222H, and the second pin 264B is located right behind the first pin 264A. The elastic member 228 is in a relaxed or stretched condition. The opening 235 is in a closed position, which is blocked by the sealing member 270. This state is named the close state, which is the same as the initial state shown in FIGS. 19A and 19B.

As described above, in certain embodiments of the present application, during operation, the structures of the first groove 222 and the second groove 224 result in the position differences between the first pin 264A and the second pin 264B. The position differences between the first pin 264A and the second pin 264B make the hook member 260 to have elastic deformation. Thus, elastic force exists in the hook member 260 due to the elastic deformation. When the elastic force of the hook member 260 is released, the elastic force tend to move one of the first pin 264A and the second pin 264B to move toward the other one of the first pin 264A and the second pin 264B. When the first pin 264A and the second pin 264B overlap, the elastic force of the hook member 260 is completely released. In other words, if there are no position differences between the first pin 264A and the second pin 264B, then there is not elastic force accumulated in the hook member 260. By the cooperation of the first pin 264A and the second pin 264B with the grooves 222/224, the islands 222D/224D, and the protrusions 222C/224C, the movements of the first pin 264A and the second pin 264B are limited in only one direction.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A toner supply container for supplying toner to an apparatus, comprising:

a container body having a middle member and a front member defining an inner space for accommodating the toner, the front member has a first capping portion, a first portion extending from the first capping portion in a first direction that is along a longitudinal axis of the container body and toward the front member, and a second portion extending from the first portion in the first direction;

a releasing mechanism, comprising:

a plate disposed on and perpendicular to an outer surface of the second portion, and having a first side and an opposite second side, wherein the first side of the plate has a first groove and a first island surrounded by the first groove, and the second side of the plate has a second groove and a second island surrounded by the second groove;

an elastic member located outside the second portion;

a releasing member, comprising:

a releasing portion slidably sleeved on the second portion of the container body, and comprising an opening in fluid communication with the inner space of the container body, an urging section located at a rear side of the releasing portion that faces the first portion of the container body, and a fixing structure extending from an outer side of the releasing portion and having a fixing groove, wherein two ends of the elastic member urge against the first portion of the container and the urging section of the releasing portion, respectively; and a protrusion portion extending from the releasing portion along the first direction, wherein the elastic member engages with the releasing portion;

an engaging member, having a base portion sleevably attached to the protrusion portion of the releasing member, and an engaging portion configured to receive a pressing force from a driving member of the apparatus; and a hook member having a first side and an opposite second side, wherein the first side is movably fixed to the fixing groove, and the second side has a first pin slidably received in the first groove, and a second pin slidably received in the second groove; and a sealing member sleeved on the first portion, the second portion, and the releasing portion, wherein the cooperation of the hook member, the first groove, and the second groove enables the first pin and the second pin moving in a one-way direction only.

2. The toner supply container of claim 1, wherein the first pin and the second pin substantially face each other.

3. The toner supply container of claim 1, wherein the first side of the plate has a front end away from the first portion and an opposite, rear end in contact with the first portion, a first protrusion extends from the rear end in the first direction;

the first island has a second large protrusion and a second small protrusion extending toward a second direction opposite to the first direction, a second front protrusion extending in the first direction, and a first notch disposed between the second large protrusion and the second small protrusion; and the first protrusion and the second small protrusion is close to the second portion, and the second large protrusion is away from the second portion.

4. The toner supply container of claim 3, wherein the second side of the plate has a front end away from the first portion and an opposite, rear end in contact with the first portion, a third protrusion extends from the rear end in the first direction, and has an inner straight side along the longitudinal direction and close to the second portion, an outer straight side along the longitudinal direction and away from the second portion, a peak facing the second notch, an inner slope connecting the peak and the inner straight side, and an outer slope connecting the peak and the outer straight side;

the second island has a fourth large protrusion and a fourth small protrusion extending toward the second direction, a fourth front protrusion extending in the first direction, and a second notch disposed between the second large protrusion and the second small protrusion; and the fourth small protrusion is away from the second portion, and the fourth large protrusion is close to the second portion, the peak is close to the second portion than that of the second notch.

5. The toner supply container of claim 4, wherein at an initial state, the first pin is located at the first notch, and the second pin is located at the second notch.

6. The toner supply container of claim 5, wherein at the initial state, when the pressing force is applied to the engaging member, the engaging member moves toward a second direction opposite to the first direction, the engaging member subsequently presses the releasing member, the urging portion of the releasing member presses the elastic member, the fixing structure presses the hook member, the first pin moves in the second direction along an inner side of the second large protrusion, the second pin moves in the second direction and outward along the outer slope, and the first pin is prevented from moving inward toward the second portion, such that the first pin and the second pin only move in one direction.

7. The toner supply container of claim 6, wherein the first pin and the second pin move respectively from the first notch and the second notch outward and upward toward the first ends and of the first side and the second side of the plate, such that the opening of the releasing portion is exposed from the sealing member for releasing toner from the container body, and the toner supply container is at a work state.

8. The toner supply container of claim 7, wherein at the work state, when the pressing force is applied again on the engaging member, the engaging member moves toward the second direction, the engaging member subsequently presses the releasing member, the urging portion of the releasing member presses the elastic member, the fixing structure presses the hook member, the second pin moves in the second direction and inward along an inner side of the second island between the fourth front protrusion and the fourth large protrusion, and the first pin is prevented from moving outward, such that the first pin and the second pin only move in one direction.

9. The toner supply container of claim 8, wherein the first pin and the second pin are moved respectively from the first ends and of the first side and second side of the plate inward and downward toward the first notch and the second notch, such that the opening of the releasing portion is closed by the sealing member.

10. The toner supply container of claim 4, wherein the first island and the first protrusion separates the first groove into four sections: a first section located at the rear side of the first island that is close to the first portion, a second section located at one side of the first island that is away from the second portion, a third section located in the front of the first island, and a fourth section located at the other side of the first island that is close to the second portion, the first section connects the second section and the fourth section from the rear side of the first groove, and the third section connects the second section and the fourth section from the front side of the first groove; and the second island and the third protrusion separates the second groove into four sections: a fifth section located at the rear side of the second island that is close to the first portion, a sixth section located at one side of the second island that is away from the second portion, a seventh section located in the front of the second island, and an eighth section located at the other side of the second island that is close to the second portion, the fifth section connects the sixth section and the eighth section from the rear side of the second groove, and the seventh section connects the sixth section and the eighth section from the front side of the second groove.

11. The toner supply container of claim 10, wherein a width of the third section is less than a width of the seventh section.

12. The toner supply container of claim 11, the fourth front protrusion corresponds to an outside of the third section that is away from the second portion.

13. The toner supply container of claim 1, wherein a width of the fixing groove is slightly smaller than a diameter of the first side of the hook member.

14. A releasing mechanism usable for a toner supply container, comprising:

a plate disposed on the toner supply container, and having a first groove and a second groove;

a releasing member, slidably sleeved on a front end of the toner supply container, and comprising an opening in fluid communication with an inner space of the toner supply container, and an urging section and a fixing structure located at a rear side of the releasing member;

an elastic member for providing an elastic force, wherein two ends of the elastic member urge against the toner supply container and the urging section of the releasing portion, respectively; and a hook member having a first side and an opposite second side, wherein the first side is movably fixed to the fixing structure, and the second side has a first pin slidably received in the first groove, and a second pin slidably received in the second groove, wherein the releasing member is configured to receive a pressing force from a driving member of an apparatus and the elastic force from the elastic member; and wherein the cooperation of the pressing force, the elastic force, the hook member, the first groove, and the second groove enables the first pin and the second pin moving in a one-way direction only.

15. The releasing mechanism of claim 14, further comprising a pair of retaining plates attached to the outer surface of the toner supply container for holding the elastic member therebetween.

16. The releasing mechanism of claim 14, further comprising an engaging member, wherein the engaging member has a base portion sleevably attached to the releasing member, and an engaging portion configured to receive the pressing force from the driving member of the apparatus.

17. The releasing mechanism of claim 14, wherein the first pin and the second pin substantially face each other.

18. The releasing mechanism of claim 14, wherein the fixing structure comprises a fixing groove, and the first side of the hook member is fixed into the fixing groove, and is rotatable in the fixing groove.

19. The releasing mechanism of claim 14, wherein the plate further comprises a first island surrounded by the first groove and a second island surrounded by the second groove, the first groove and the first island are disposed at a first side of the plate, and the second groove and the second island are disposed at a second side of the plate, the first side of the plate is opposite to the second side of the plate;

a first protrusion extends forward from a rear end of the plate to the first groove, the first island has a second large protrusion and a second small protrusion extending backward, a second front protrusion extending forward, and a first notch disposed between the second large protrusion and the second small protrusion, the first protrusion and the second small protrusion is located at an inner side of the toner supply container, and the second large protrusion is located at an outer side of the toner supply container;

a third protrusion extends forward from the rear end of the plate to the second groove, and has an inner straight side, an outer straight side, a peak facing the second island, an inner slope connecting the peak and the inner straight side, and an outer slope connecting the peak and the outer straight side, the second island has a fourth large protrusion and a fourth small protrusion extending backward, a fourth front protrusion extending forward, and a second notch disposed between the second large protrusion and the second small protrusion, the fourth small protrusion is located at the outer side of the toner supply container, and the fourth large protrusion is located at the inner side of the toner supply container; and the peak of the third protrusion is close to the inner side of the toner supply container than that of the second notch.

20. The releasing mechanism of claim 19, wherein at an initial state, the first pin is located in the first notch, and the second pin is located in the second notch, when the pressing force is applied, the first pin and the second pin move respectively from the first notch and the second notch outward and upward toward a front end of the plate, such that the opening of the releasing portion is exposed for releasing toner from the container body, and the toner supply container is at a work state; and when the pressing force is applied again, the first pin and the second pin are moved respectively from the front end of the plate inward and downward toward the first notch and the second notch, such that the opening of the releasing portion is closed by the sealing member.

* * * * *